US011808541B1

(12) United States Patent
Jung

(10) Patent No.: US 11,808,541 B1
(45) Date of Patent: Nov. 7, 2023

(54) CHARGING HANDLE

(71) Applicant: Aero Precision Inc., Tacoma, WA (US)

(72) Inventor: Jaeyoun Jung, Puyallup, WA (US)

(73) Assignee: AERO PRECISION, LLC, Tacoma, WA (US)

( * ) Notice: Subject to any disclaimer, the term of this patent is extended or adjusted under 35 U.S.C. 154(b) by 60 days.

(21) Appl. No.: 17/536,826

(22) Filed: Nov. 29, 2021

Related U.S. Application Data

(63) Continuation of application No. 29/759,731, filed on Nov. 24, 2020, which is a continuation of application No. 17/103,879, filed on Nov. 24, 2020, now Pat. No. 11,187,476.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 35/06; F41A 3/72
See application file for complete search history.

(56) References Cited

U.S. PATENT DOCUMENTS

| | | | | |
|---|---|---|---|---|
| 7,240,600 | B1 * | 7/2007 | Bordson | F41A 3/72 89/1.4 |
| 9,500,421 | B1 * | 11/2016 | Geissele | F41A 3/72 |
| 9,846,003 | B2 * | 12/2017 | Hwang | F41A 3/72 |
| 10,451,369 | B1 * | 10/2019 | Hunt | F41A 35/06 |
| 11,187,476 | B2 * | 11/2021 | Jung | F41A 3/72 |
| 11,346,623 | B2 * | 5/2022 | Bray | F41A 35/06 |

* cited by examiner

*Primary Examiner* — Bret Hayes
(74) *Attorney, Agent, or Firm* — John J. Bamert, Esq.; Bamert Regan PLLC

(57) ABSTRACT

Embodiments are directed toward a charging handle for a firearm. The charging handle preferably has a base, a shaft, a latch, and left and right levers pivotably coupled to the base by respective pivot pins and configured to disengage the latch from an upper receiver. The base preferably defines four substantially vertical mating surfaces. The entirety of each of the first and third mating surfaces contacts the left lever when pulled rearward. The entirety of each of the second and third mating surfaces contacts the right lever when pulled rearward. The third mating surface is preferably disposed at an acute angle to the first mating surface as measured forward and outward from the third mating surface. The fourth mating surface is preferably disposed at an acute angle to the second mating surface as measured forward and outward from the fourth mating surface. Accordingly, stress on the pivot pins is relieved.

22 Claims, 60 Drawing Sheets

CHARGING HANDLE

CROSS-REFERENCE TO RELATED APPLICATIONS

This application is a continuation of U.S. patent application Ser. No. 17/103,879, filed Nov. 24, 2020, titled "CHARGING HANDLE", and is a continuation of U.S. patent application Ser. No. 29/759,731, filed Nov. 24, 2020, titled "CHARGING HANDLE", which is a continuation of U.S. patent application Ser. No. 17/103,879, filed Nov. 24, 2020, titled "CHARGING HANDLE", the entirety of each of which is incorporated herein by reference.

TECHNICAL FIELD

The invention relates to charging handles for firearms and, more particularly, to charging handles for AR-pattern firearms.

BACKGROUND OF THE INVENTION

Many modern rifles have charging handles to permit the user to draw the bolt carrier out of battery, cock the hammer, and upon release of the handle, allow the bolt carrier to return into battery, thereby stripping a round from the magazine and chambering the round. Charging handles thus enable the user to remove rounds from the chamber to disarm the rifle or to clear a jammed or misfired round. Charging handles are repeatedly subjected to these actions, which are often violently performed to rapidly execute these functions. Charging handles also incur violent impacts when firearms are dropped. As a result, charging handles break down over time and eventually must be repaired or replaced.

For example, pivot pins in charging handles, such as the charging handle shown in FIG. 64 of U.S. Pat. No. 9,587,896 issued to Huang, are some of the first components to break down and require replacement. Some charging handles (see, for example, FIGS. 1-54 of Huang) are susceptible to providing inconsistent action or jamming as grease, grit, and grime (for example, lubrication and carbon exhausted from the firearm) accumulate in the charging handles or as the user applies inconsistent force across levers of left and right translating levers. Some of such charging handles eventually require pulling both of the opposite handle lobes at once to actuate the latch without jamming. Other charging handles have lobes or levers that are susceptible to chatter (see for example, U.S. Pat. No. 7,240,600 issued to Bordson, U.S. Pat. No. 8,336,436 issued to Kincel, or U.S. Pat. No. 10,012,461 issued to Curry).

Ambidextrous charging handles permit the user to draw the bolt carrier out of battery by pulling a lobe or a lever on either side of the firearm. In some ambidextrous charging handles (see for example, Curry), the right lobe or the right lever is highly susceptible to unintentional actuation due to snagging on environmental objects such as trees or bushes. In other ambidextrous charging handles (see for example FIG. 64 of Huang), the user is discouraged from pulling the right lever.

Accordingly, there is a need for charging handles having improved durability. There is also a need for charging handles having improved consistency and reliability. There is a further need for charging handles that reduce the likelihood of unintentional actuation while encouraging use of either lever of the charging handle.

BRIEF SUMMARY OF THE INVENTION

It is therefore an object of the present invention to provide charging handles that have improved durability.

It is also an object of the present invention to provide charging handles that achieve the above object and that also increase reliability of the firearms in which the charging handles are installed.

It is another object of the present invention to provide charging handles that achieve the above objects and that also reduce debris exhausted at the user's face.

It is a further object of the present invention to provide charging handles that achieve the above objects and that also protect against unintentional actuation.

The invention achieves the above objects, as well as other objects and advantages that will become apparent from the description that follows, by providing a charging handle for a firearm, such as an AR-pattern firearm. In a preferred embodiment, the charging handle includes a base, a shaft, a latch, a left lever, and a right lever. The shaft has a proximal end portion that extends from the base and a distal end portion that is configured to engage a bolt carrier of the firearm. The shaft defines a longitudinal axis of the charging handle that extends through the proximal end portion of the shaft and the distal end portion of the shaft. The charging handle defines a forward direction that extends in a direction from the proximal end portion of the shaft toward the distal end portion of the shaft. The charging handle defines outward directions, such as left and right outward directions, as horizontally extending orthogonal to and away from the longitudinal axis. The latch is configured to selectively engage an upper receiver of the firearm. The left lever is pivotably coupled to the base. The left lever is configured to move the latch into or out of engagement with the upper receiver. The right lever is pivotably coupled to the base. The right lever is configured to move the latch into or out of engagement with the upper receiver. The base defines a first mating surface, a second mating surface, a third mating surface, and a fourth mating surface. The first, second, third, and fourth mating surfaces are substantially vertical. An entirety of each of the first and third mating surfaces is configured to contact the left lever when the user pulls the left lever to its fully rearward position. An entirety of each of the second and fourth mating surfaces is configured to contact the right lever when the user pulls the right lever to its fully rearward position. The third mating surface is disposed at an acute angle to the first mating surface as measured forward and outward from the third mating surface. The fourth mating surface is disposed at an acute angle to the second mating surface as measured forward and outward from the fourth mating surface.

In alternative embodiments, the third mating surface extends forward and rearward of the first mating surface. In alternative embodiments, the fourth mating surface extends forward and rearward of the second mating surface. In alternative embodiments, the base has an upper body portion and a lower body portion that is spaced apart from and below the upper body portion. In alternative embodiments, the lower body portion defines the first and second mating surfaces. In alternative embodiments, the upper body portion defining the third and fourth mating surfaces.

In alternative embodiments, the charging handle has first and second springs and a spacer coupled to the base. In alternative embodiments, the first spring extends from the spacer to the left lever. In alternative embodiments, the second spring extends from the spacer to the right lever.

In alternative embodiments, the base defines a cavity. In alternative embodiments, one of the left and right levers has a cam follower disposed in the cavity. In alternative embodiments, the other of the left and right levers has a cam disposed in the cavity. In alternative embodiments, the cam is configured to selectively engage the cam follower to actuate the one of the left and right levers. In alternative embodiments, the first and second springs are disposed in the cavity. In alternative embodiments, the spacer encloses the cam follower, the cam, and the first and second springs in the cavity.

In alternative embodiments, the first and second springs are disposed at an acute angle to each other as measured forward and inward of the first and second springs. In alternative embodiments, the first and second springs are disposed at substantially symmetrical angles relative to the longitudinal axis as measured forward and inward of the first and second springs. In alternative embodiments, the second spring has a different spring constant than the first spring.

In alternative embodiments, the base has a backstop that extends upward. In alternative embodiments, the backstop defines a receptacle that is configured to capture matter rearwardly expelled from the firearm.

In alternative embodiments, the shaft has a series of serrations on an outer face of the shaft. In alternative embodiments, the serrations are disposed on a distal half of the shaft. In alternative embodiments, the serrations are disposed rearward of an alignment mechanism of the shaft.

In alternative embodiments, one of the left lever or the right lever defines a front face that is configured to be gripped by the user's fingers. In alternative embodiments, the front face defines a slot that has a major axis that is substantially horizontal. The slot is preferably configured to reduce vertical slippage of a user's fingers.

In alternative embodiments, each of the first mating surface and the second mating surface has an area of at least 3, 3.5, 4, 4.5, 5, 5.5, 6, 6.5, or 7 $mm^2$, and each of the third mating surface and the fourth mating surface has an area of at least 1.5, 1.75, 2, 2.25, 2.5, 2.75, 3, 3.25, 2.5, or 4 $mm^2$.

In alternative embodiments, the left lever has a cam follower. In alternative embodiments, the cam follower is disposed between the upper body portion and the lower body portion. In alternative embodiments, the right lever has a cam disposed between the upper body portion and the lower body portion. In alternative embodiments, the cam is configured to selectively engage the cam follower of the left lever to actuate the left lever responsive to the user pulling the right lever. In alternative embodiments, the latch is coupled to the left lever. In alternative embodiments, the latch is configured to pivot responsive to movement of the left lever. In alternative embodiments, the lower body portion has a left lobe that defines the first mating surface and a right lobe that defines the second mating surface. In alternative embodiments, the first and second mating surfaces are arranged in a plane that is substantially vertical and substantially orthogonal to the longitudinal axis. In alternative embodiments, the upper body portion defines the third mating surface and the fourth mating surface. In alternative embodiments, the third and fourth mating surfaces intersect the plane. In alternative embodiments, the third and fourth mating surfaces are disposed at acute angles to the plane as measured forward of the plane and outward from the third and fourth mating surfaces. In alternative embodiments, the left and right levers are respectively coupled to the base by first and second pivot pins. The mating surfaces facilitate relieving stress that the pivot pins incur during use.

In alternative embodiments, the spacer is coupled to the base and disposed between the upper body portion and the lower body portion. In alternative embodiments, the first and second springs are disposed between the upper and lower body portions. In alternative embodiments, the first spring has a first end portion and a second end portion. The first end portion of the first spring preferably contacts the spacer, and the second end portion of the first spring preferably contacts the left lever. In alternative embodiments, the first spring is configured to bias the left lever away from the spacer. In alternative embodiments, the first spring is configured to bias the latch into engagement with the upper receiver. In alternative embodiments, the second spring has a third end portion and a fourth end portion. The third end portion of the second spring preferably contacts the spacer, and the fourth end portion of the second spring preferably contacts the right lever. In alternative embodiments, the second spring is configured to bias the right lever away from the spacer. In alternative embodiments, the second spring is configured to bias the cam out of engagement with the cam follower.

In alternative embodiments, the cam follower and the cam are disposed between the upper body portion and the lower body portion. In alternative embodiments, the cam follower and the cam are disposed forward of the spacer.

In alternative embodiments, one or both of the first and second springs includes compression springs. In alternative embodiments, one or both of the first and second springs is disposed forward of the spacer. In alternative embodiments, the first and second springs are disposed on opposite sides of the longitudinal axis from each other. In alternative embodiments, the first and second springs are transverse to the longitudinal axis. In alternative embodiments, the first and second springs are disposed at acute angles to the longitudinal axis as measured forward and inward of the first and second springs.

In alternative embodiments, the backstop extends upward from the upper body portion.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENTS OF THE INVENTION

A charging handle in accordance with the principles of the invention is generally indicated at reference number 8 in the various figures of the attached drawings wherein numbered elements in the figures correspond to like numbered elements herein.

Figure 1:
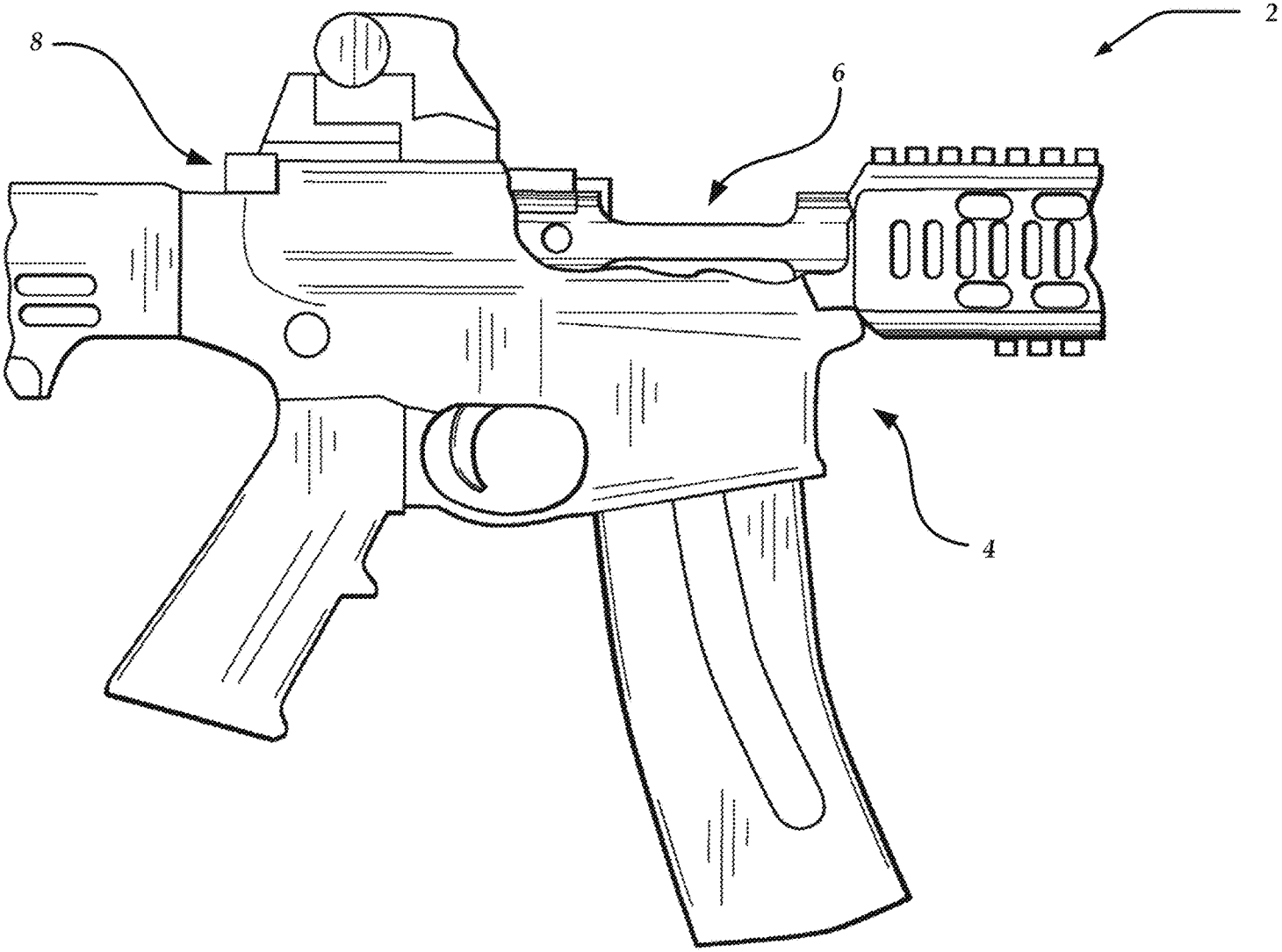
FIG. 1 is a partial right elevational view of a firearm having a charging handle.
Figure 2:
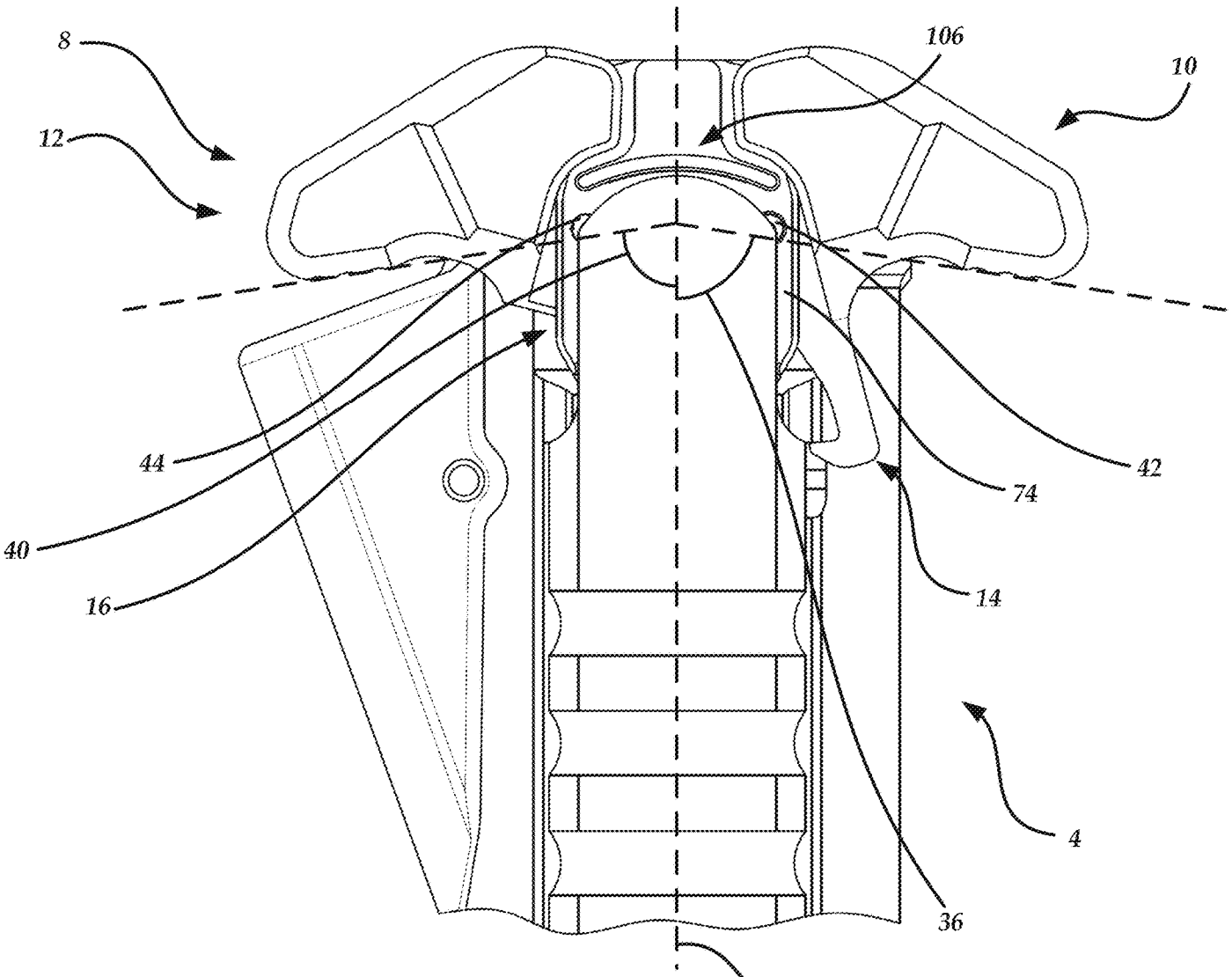
FIG. 2 is a top plan view of a first embodiment of the charging handle installed in a firearm.
Figure 3:
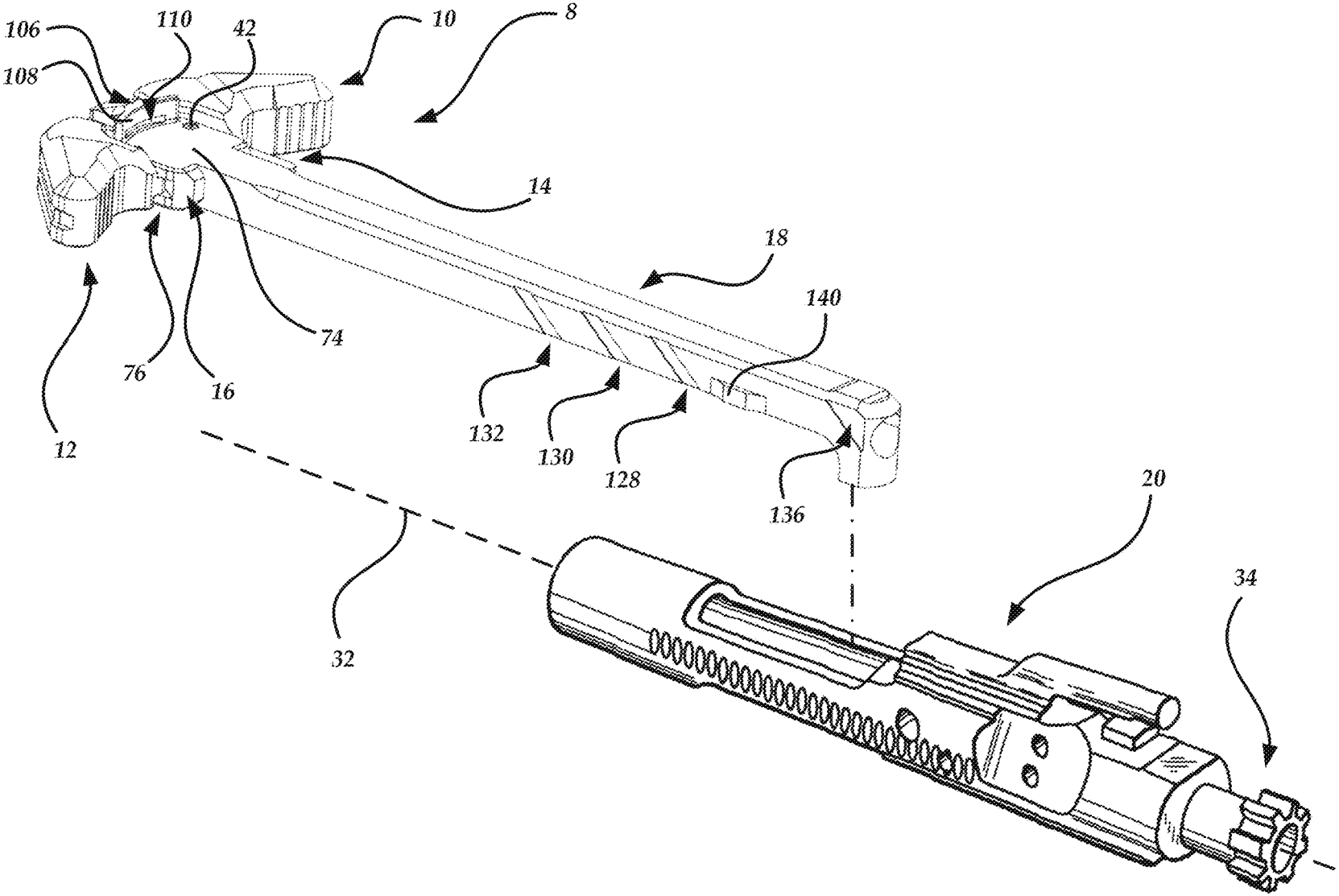
FIG. 3 is front-right view of the charging handle of FIG. 2 with a bolt carrier.

FIG. 1 shows the charging handle in use with a firearm 2 (for example, an AR-15 pattern rifle) having a receiver 4, a bolt carrier 6 installed in the receiver 4, and the charging handle 8 mounted on the receiver 4. As shown in the overhead view of FIG. 2, the charging handle 8 has a left lever 10 and a right lever 12. Preferably, pulling either or both of the levers 10, 12 transitions a latch 14 from a latched configuration (see FIG. 4) in which the latch 14 engages the receiver 4 and an unlatched configuration (as shown in FIG. 2). As shown in FIG. 3, the charging handle 8 has a base or main body 16 and a shaft 18 that is fixedly coupled to and that extends from the base 16. The levers 10, 12 and the latch 14 are coupled to the base 16. The shaft 18 engages a bolt carrier 20. Accordingly, when the charging handle 8 is transitioned to the unlatched configuration, pulling the charging handle 8 along the longitudinal axis 32 of the bolt carrier 20 cocks the bolt 34.

Figure 4:
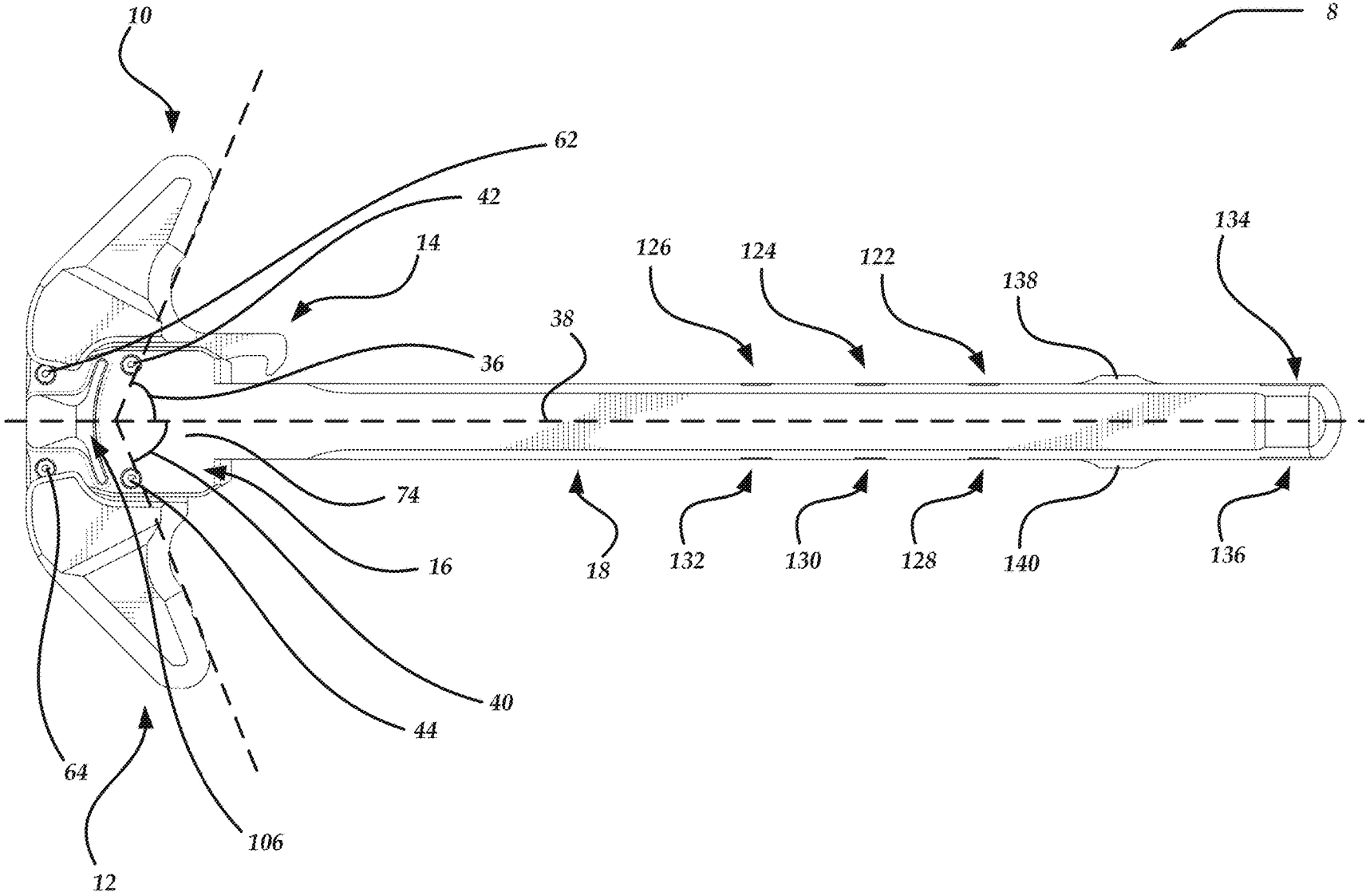
FIG. 4 is a top plan view of the charging handle of FIG. 2 in a latched configuration.
Figure 5:
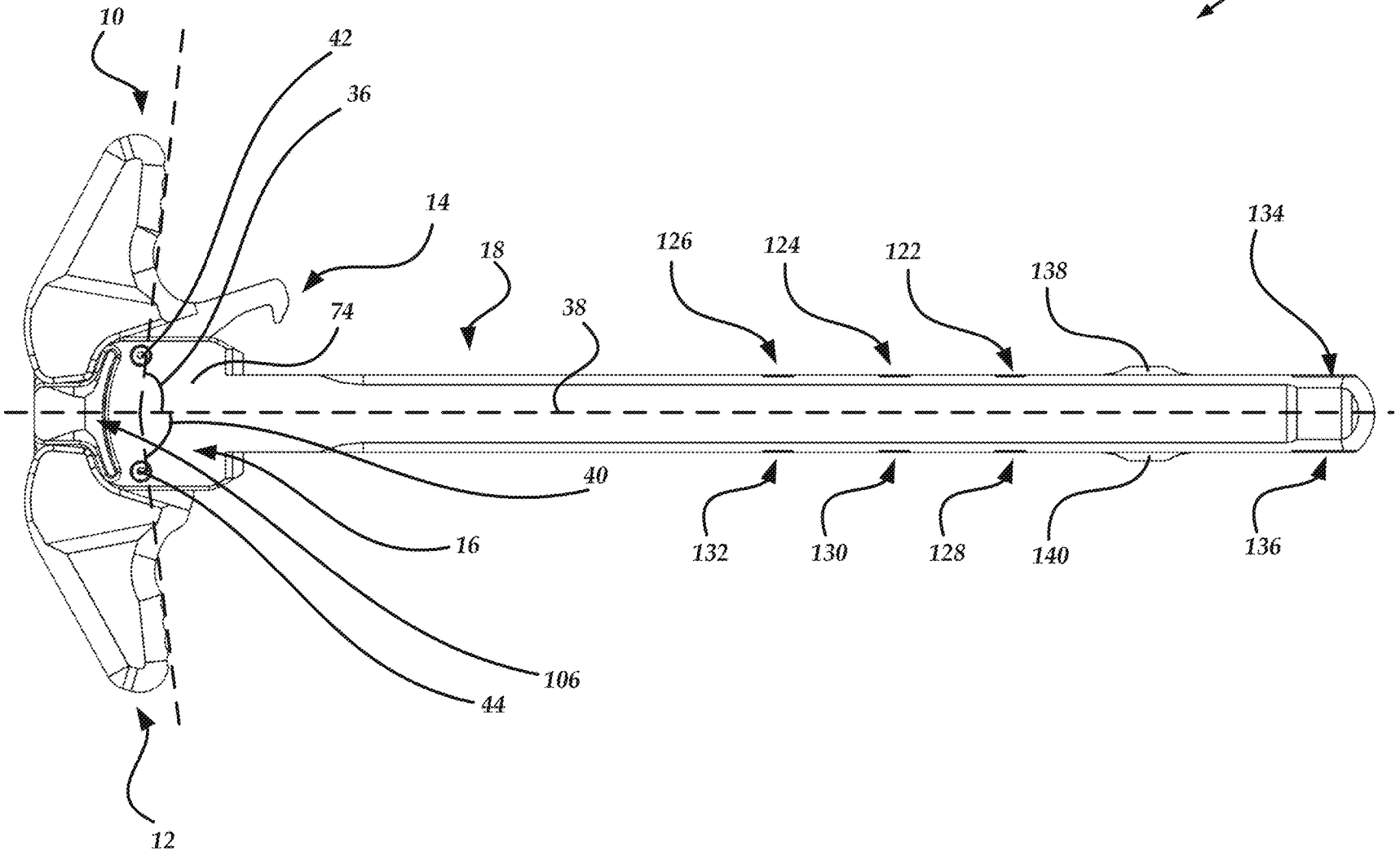
FIG. 5 is a top plan view of the charging handle of FIG. 2 in an unlatched configuration based on the right lever or both levers being pulled.
Figure 6:
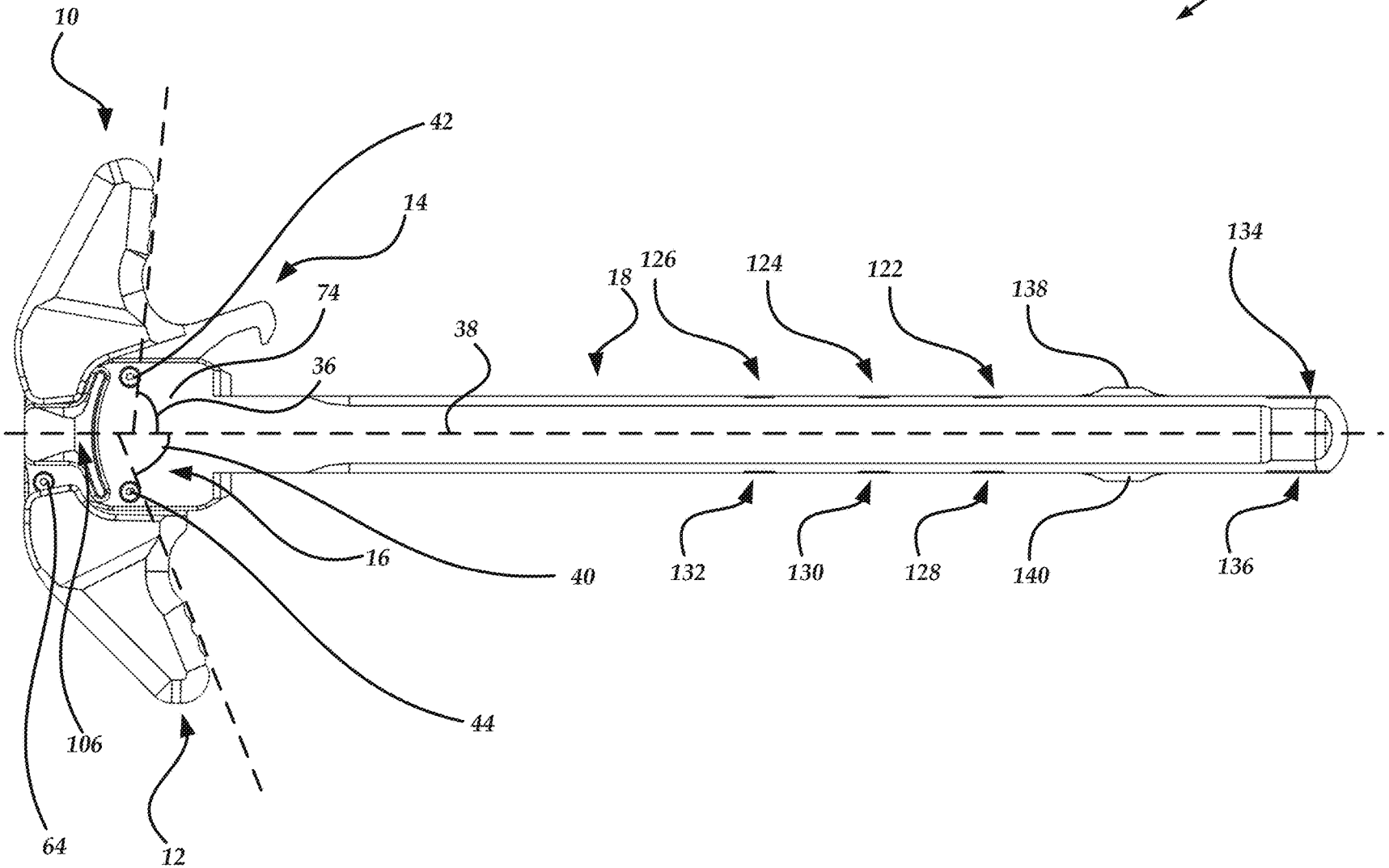
FIG. 6 is a top plan view of the charging handle of FIG. 2 in the unlatched configuration based on the left lever being pulled.

FIG. 4 shows the charging handle 8 in the latched configuration. FIG. 5 shows the charging handle 8 in the unlatched configuration responsive to the user pulling only the right lever 12 or both the left and right levers 10, 12. FIG. 6 shows the charging handle 8 in the unlatched configuration responsive to the user pulling only the left lever 12. The front face of the left lever 10 preferably forms an angle 36 with respect to the longitudinal axis 38 of the charging handle 8, and the front face of the right lever 12 preferably forms an angle 40 with respect to the longitudinal axis 38. In the latched configuration, the angles 36, 40 are preferably between 55° and 80°, 60° and 75°, or 65° and 70° (see FIG.

4). When the user pulls one or both of the levers 10, 12 into the unlatched configuration, the angle 36 or 40 for each pulled lever 10, 12 (or both levers 10, 12 when only the right lever 12 is pulled) is preferably between 65° and 90°, 70° and 90°, 75°, and 90°, or 80° and 85° (see FIGS. 2, 5, 6, and 9). This angle in the unlatched configuration improves the ability of the user to pull the charging handle 8 rearward, especially compared to right or obtuse angles. Accordingly, the charging handle 8 is preferably an ambidextrous charging handle, but some embodiments may have the right lever 12 in a fixed position such that it does not actuate the latch 14.

Figure 7:
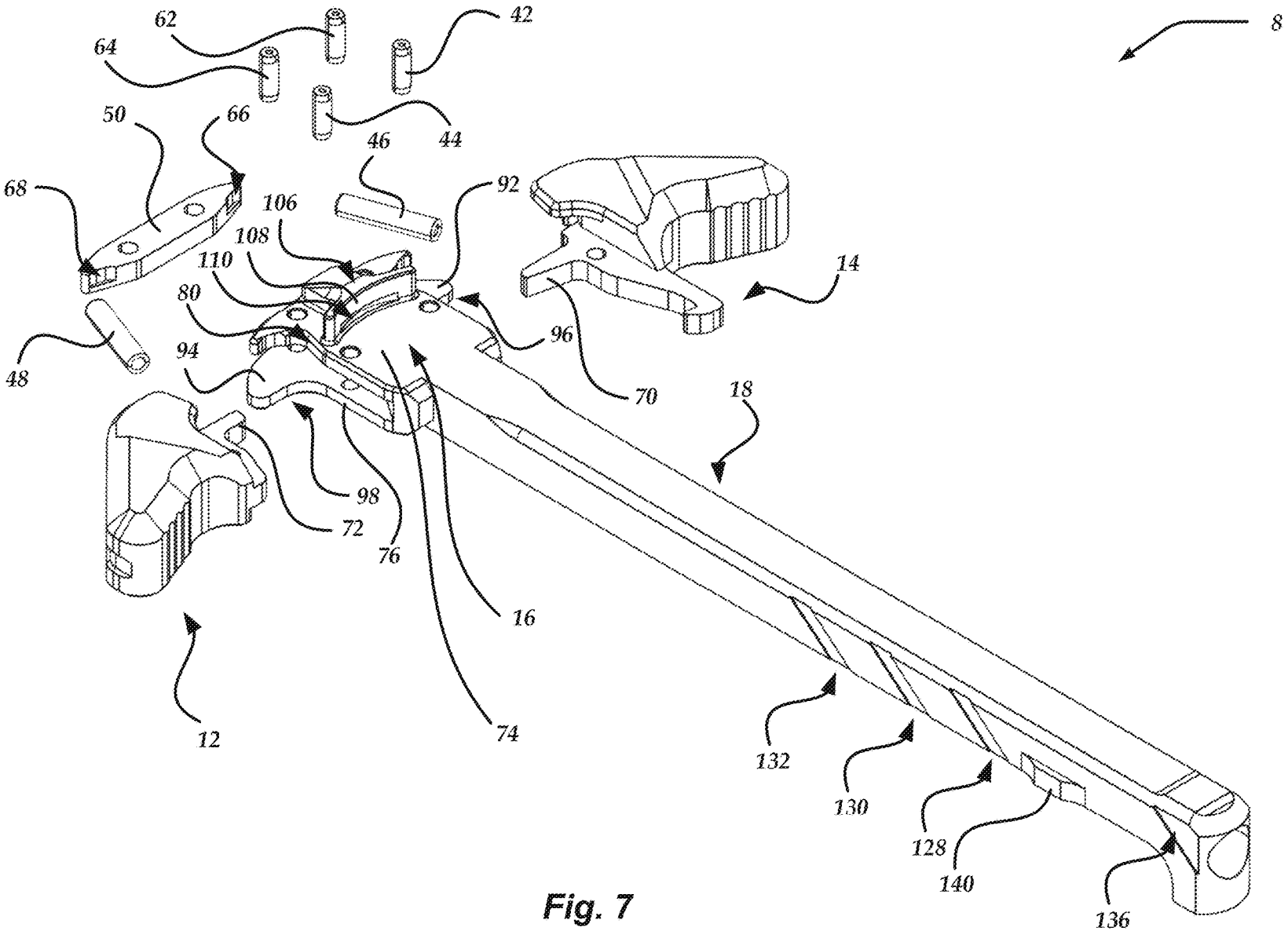
FIG. 7 is front-right isometric exploded view of the charging handle of FIG. 2.
Figure 8:
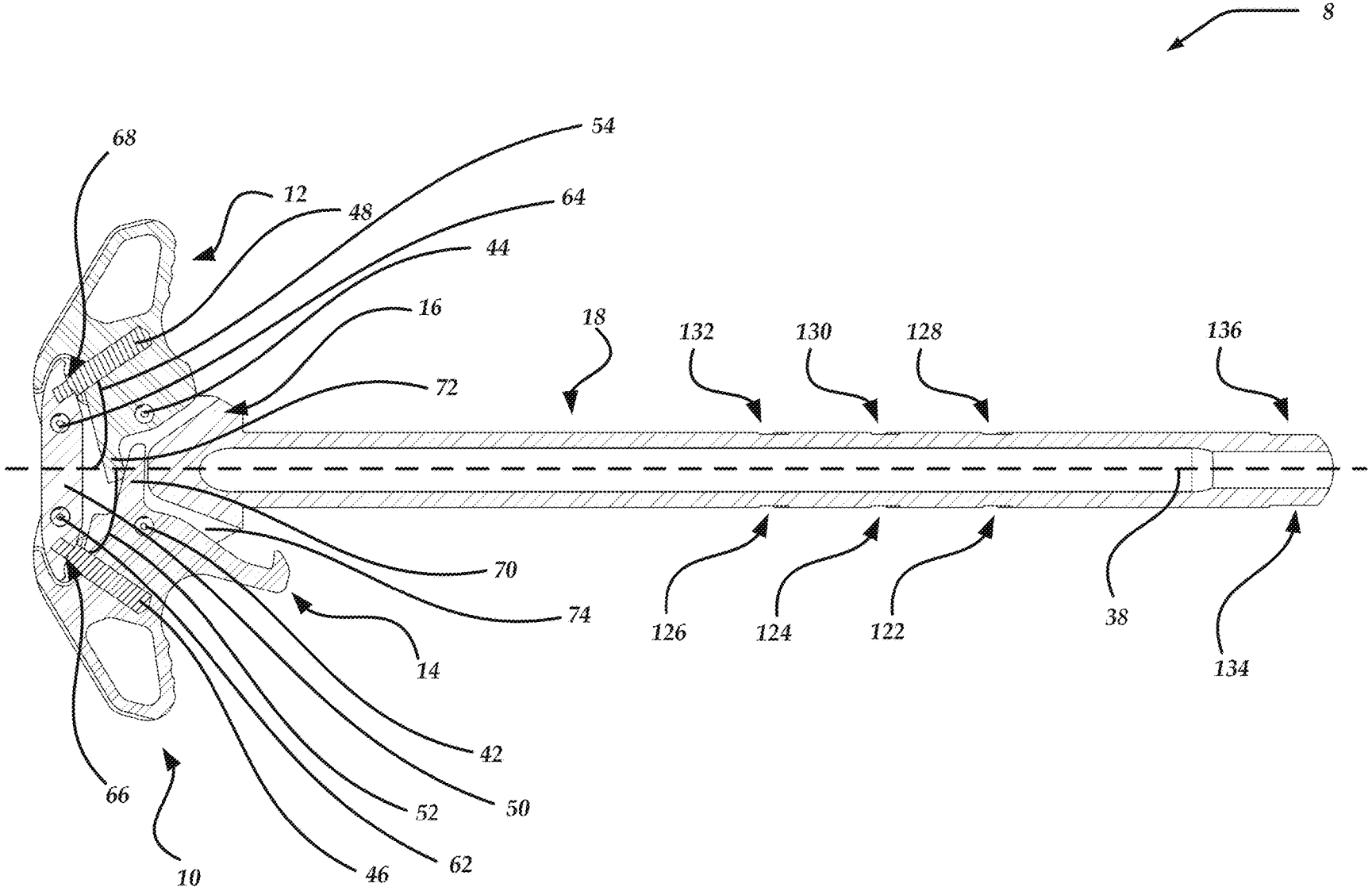
FIG. 8 is a cross-sectional view of the charging handle of FIG. 2 in the unlatched configuration, taken along line 8-8 in FIG. 17.
Figure 9:
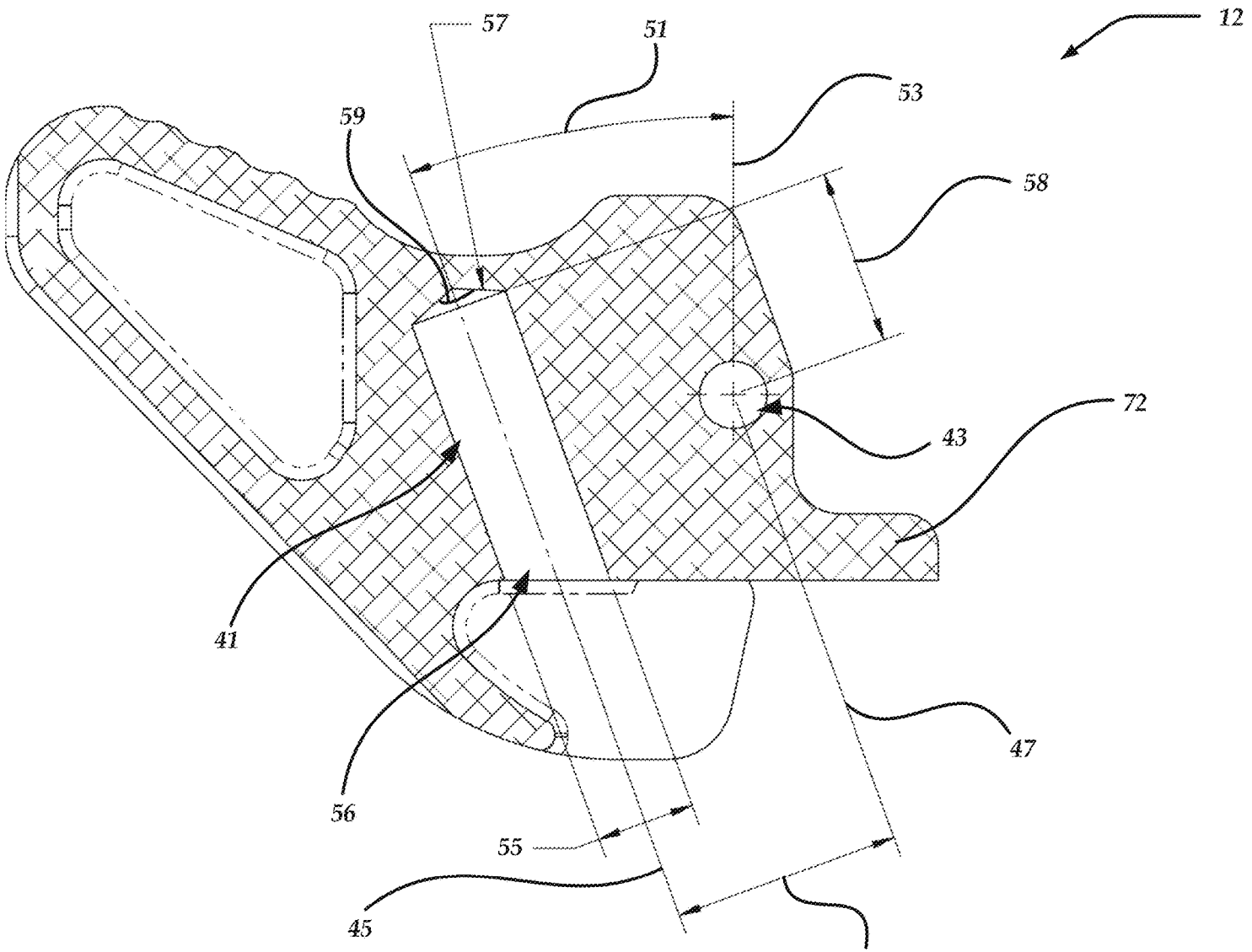
FIG. 9 is a cross-sectional view of the charging handle of FIG. 2, taken along line 8-8 in FIG. 17.

As shown in the exploded view of FIG. 7, respective pins 42, 44 preferably pivotably couple the left and right levers 10, 12 to the base 16. Respective bias elements 46, 48 (such as compression coil springs, which are schematically represented by cylindrical bodies in FIG. 7) preferably bias the left and right levers 10, 12 toward the latched configuration by biasing the levers 10, 12 away from a spacer 50. As shown in FIG. 8, the bias elements 46, 48 are preferably disposed at respective angles 52, 54 that are preferably between 20° and 45°, 25° and 40°, or 30° and 35° relative to the longitudinal axis 38 of the charging handle 8 as measured on the forward and inward sides of the bias elements 46, 48. As shown in FIG. 9, each lever 10, 12 preferably defines a receptacle, such as the receptacle 41 in the right lever 12, that is configured to receive a respective one of the bias elements 46, 48. Each lever 10, 12 preferably defines a receptacle, such as the receptacle 43, that is configured to receive a respective one of the pins 42, 44. The bias-element receptacle 41 preferably defines a central axis 45 that is offset from an axis 47 that is parallel to the central axis 45 and that extends through the central axis of the pin receptacle 43. The distance 49 of such offset is preferably at least (or optionally equal to or less than) 0.15, 0.2, 0.25, 0.3, 0.35, 0.4, or 0.45 inches. The central axis 45 is preferably disposed at an angle 51 with respect to an axis 53 that extends through the central axis of the pin receptacle 43 and, when the lever 12 is in the latched configuration, is parallel to the longitudinal axis 38 of the charging handle 8. The angle 51 is preferably at least (or optionally equal to or less than) 10, 15, 20, 25, 30, or 35 degrees. The bias-element receptacle 41 preferably defines a diameter 55, which is preferably at least (or optionally equal to or less than) 0.05, 0.1, 0.15, 0.2, or 0.25 inches. The receptacle 41 preferably defines an elongate portion 56 and an end portion 57. The end portion 57 is preferably offset from the central axis of the pin receptacle 43 by a distance 58 as measured parallel to the central axis 45 of the receptacle 41, and such distance 58 is preferably at least (or optionally equal to or less than) 0.15, 0.2, 0.25, 0.3, or 0.35 inches. The end portion 57 preferably has a conical shape with an angle 59 that, as measured along the diameter 55 of the receptacle 41, is preferably at least (or optionally equal to or less than) 115, 125, 135, 145, or 155 degrees. The receptacle in the left lever 10 is preferably arranged in the left lever 10 in the same manner as the receptacle 41 in the right lever 12, except mirrored.

The bias elements 46, 48 are preferably disposed at an acute angle relative to each other, as measured on the forward, inner sides of the bias elements 46, 48 and, most preferably, are disposed at an acute angle relative to each other in both the latched and unlatched configurations. This bias arrangement preferably facilitates enhancing the smoothness of the pulling action as felt by the user. Returning to FIG. 7, the spacer 50 preferably protects internal components such as the bias elements 46, 48 from the external environment and facilitates keeping grease or oil inside the base 16 for extended use. Pins 62, 64 preferably couple the spacer 50 to the base 16. Accordingly, when installed in the firearm 2, pulling the left lever 10 toward the rear of the firearm 2 preferably compresses the left bias element 46, pivots the lever 10 and the latch 14 about the pivot pin 42, and transitions the latch 14 out of engagement with the receiver 4 (see FIG. 6) to permit pulling the charge handle 8 rearward. As a result of the arrangement of the preferred embodiment described herein, the charging handle 8 preferably facilitates consistent action and feel to the user without jamming or chatter, which increases reliability as well as the user's familiarity with and thus trust in and speed of use of the firearm 2 in which the charging handle 8 is installed.

The bias elements 46, 48 preferably have different spring constants. The left bias element 46 preferably has a greater spring constant than the right bias element 48. Accordingly, actuating the right lever 12 preferably requires more force than actuating the left lever 10 but less than double the force required to actuate the left lever 10. The differential spring constants of the charging handle 8 preferably facilitate protecting against unintentional actuation of the right lever 12 while requiring the user to apply less than double the force to actuate the right lever 12 as compared to the left lever 10. The spacer 50 preferably defines a left receptacle 66 that is configured to receive the left bias element 46 and a right receptacle 68 that is configured to receive the right bias element 48. Accordingly, in addition to or instead of replacing one or both of the bias elements 46, 48 to customize one or both of the spring constants, the spring differential may be effectively customized by swapping the spacer 50 with another spacer having a different shape or size or having differently shaped or size receptacles so as to increase or decrease preloading of one or both of the bias elements 46, 48. Thus, not only does the present bias element and spacer arrangement of the charging handle 8 improve usability and reliability of the firearm 2, but the present arrangement also improves the ability of the user to customize the firearm 2. Another version of the charging handle 8 that is mirrored about the vertical plane that extends through the longitudinal axis 38 of the charging handle 8 may be provided for left-eye-dominant users.

As shown in the cross-sectional view of FIG. 8, the left lever 10 preferably has a cam follower 70, and the right lever 12 preferably has a cam 72 that selectively engages the cam follower 70 when the user pulls the right lever 12 toward the rear of the firearm 2. Accordingly, pulling the right lever 12 rearward preferably causes both the left and right levers 10, 12 to pivot about their respective pivot pins 42, 44 and thereby causes the latch 14 to pivot about the pivot pin 42 to transition the charging handle from the latched configuration to the unlatched configuration.

As shown in FIG. 7, the base 16 preferably has an upper body portion 74 and a lower body portion 76 that is spaced apart from and below the upper portion 74. The upper body portion 74 and the lower body portion 76 preferably define a cavity in which the cam follower 70 and the cam 72 are enclosed by the spacer 50. As shown in the cross-sectional view of FIG. 10, the upper body portion 74 preferably has left and right mating surfaces 78, 80 that, when the user pulls the levers 10, 12, contact corresponding mating surfaces on the levers 10, 12 and thereby limit rotation of the levers 10, 12 about the pins 42, 44. As shown in the underside view of FIG. 11, the lower body portion 76 preferably has left and right lobes 92, 94 that have respective mating surfaces 96, 98 that, when the user pulls the levers 10, 12, contact corresponding mating surfaces on the levers 10, 12 and thereby limit rotation of the levers 10, 12 about the pins 42, 44. Accordingly, at least one of the mating surfaces 78, 80, 96, 98 faces generally forward. Each of the left and right mating surfaces 78, 80 preferably has an area of at least 3, 3.5, 4, 4.5, 5, 5.5, 6, 6.5, or 7 $mm^2$. Each of the mating surfaces 96, 98 preferably has an area of at least 1.5, 1.75, 2, 2.25, 2.5, 2.75, 3, 3.25, 2.5, or 4 $mm^2$. The entirety of each of the mating surfaces 78, 80, 96, 98 preferably contacts the respective lever 10, 12 when such lever is disposed in the rearmost position. Accordingly, when the user pulls the levers 10, 12, the base 16 preferably has significant surface area in contact with the levers 10, 12 to facilitate transferring force from the levers 10, 12 to the base 16 and thereby reduce stress on the pivot pins 42, 44.

Figure 10:
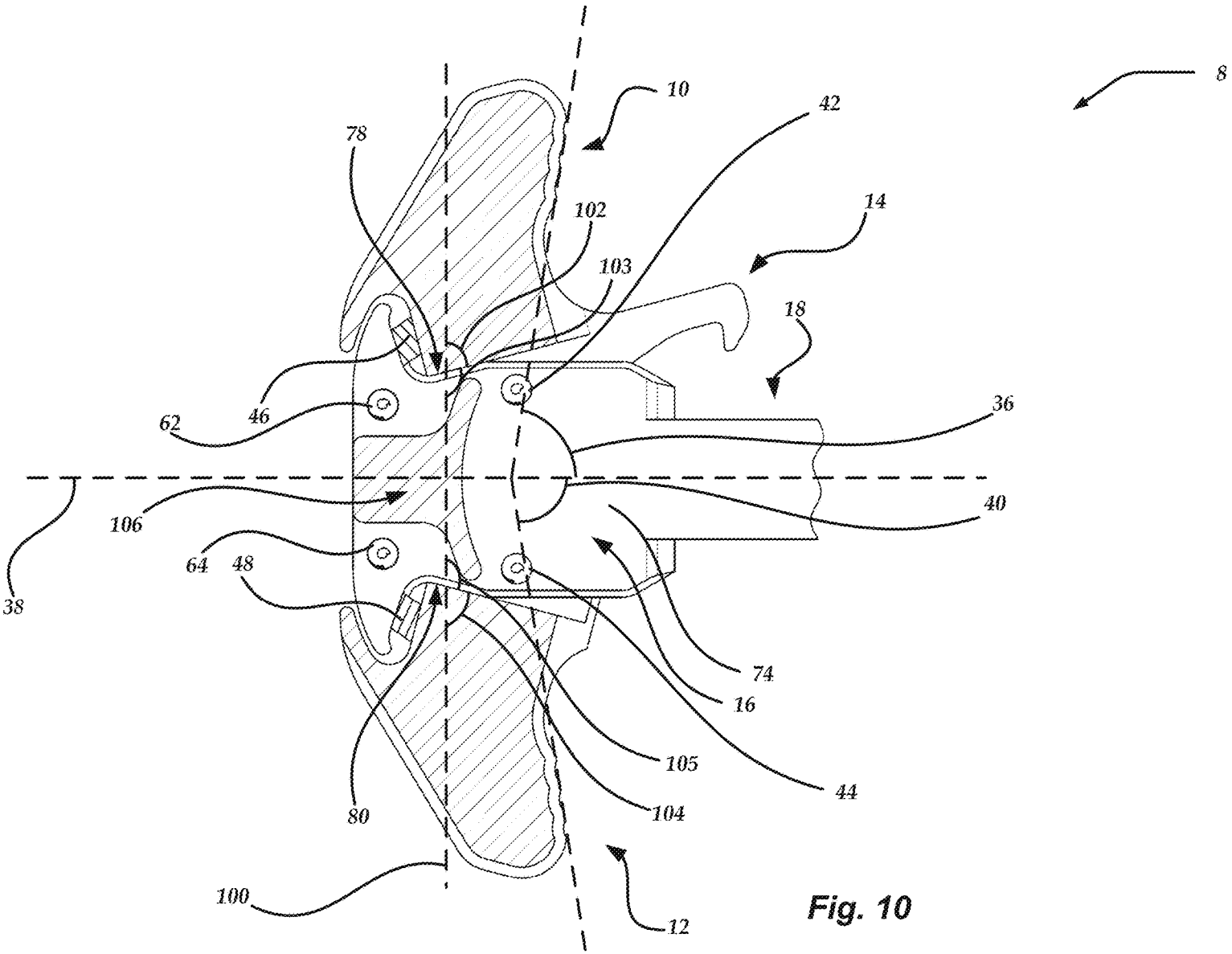
FIG. 10 is a cross-sectional view of the charging handle of FIG. 2 in the unlatched configuration, taken along 10-10 in FIG. 17.
Figure 11:
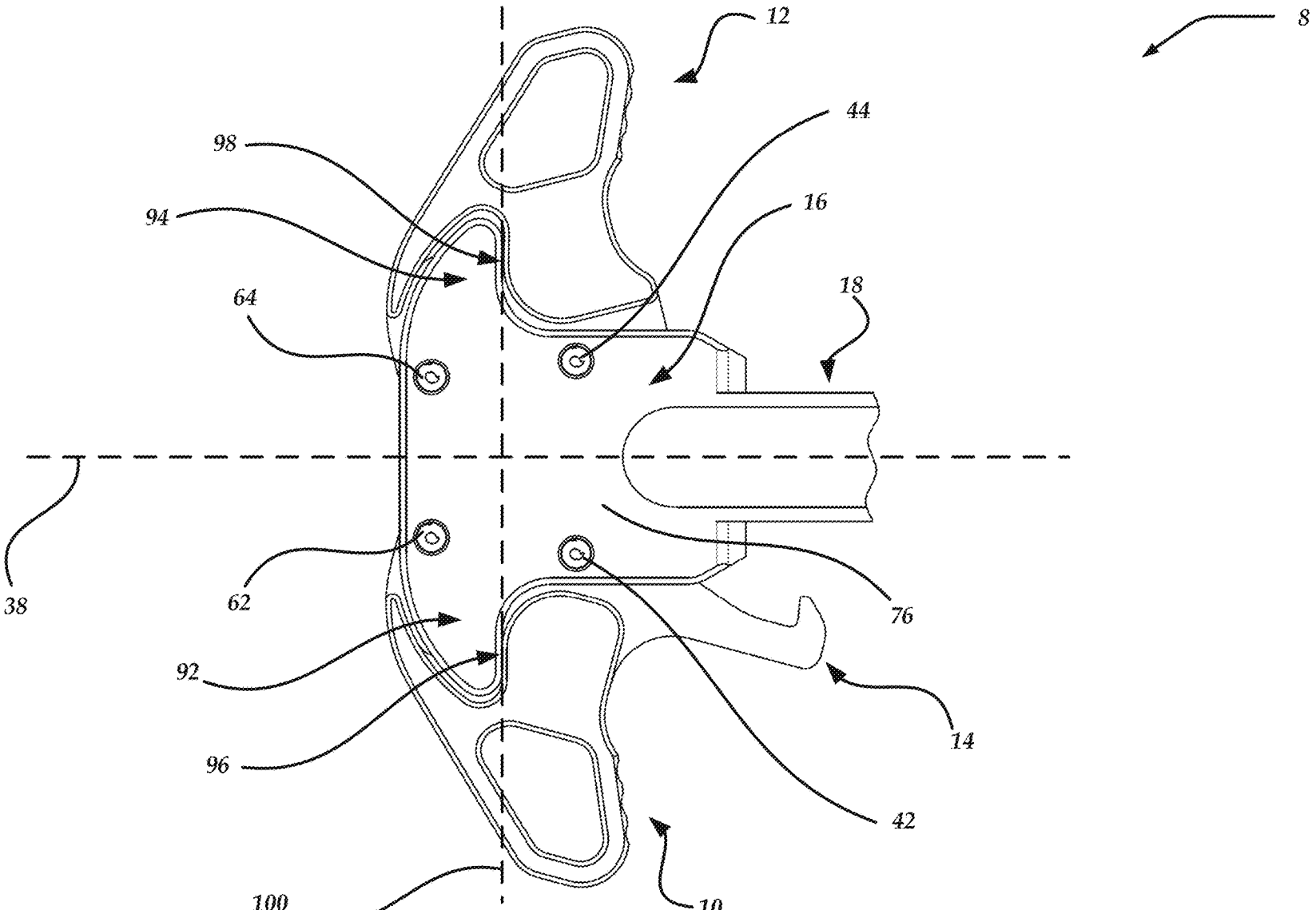
FIG. 11 is a partial bottom view of the charging handle of FIG. 2 in the unlatched configuration.

The lower mating surfaces 96, 98 are preferably substantially orthogonal to the longitudinal axis 38 of the charging handle 8. The lower mating surfaces 96, 98 are preferably co-planar with each other and disposed in a plane 100. As shown in FIG. 10, the upper mating surfaces 78, 80 preferably extend both rearward and forward of the plane 100. The upper mating surfaces 78, 80 are preferably disposed at acute angles, such as angles 102, 104 (for example, acute angles between 87.5° and 55°, between 85° and 65°, between 80° and 60°, or approximately 75°) or angles 103, 105 (for example, acute angles between 2.5° and 35°, between 5° and 25°, between 10 and 20°, or approximately 15°) to the plane 100 as measured forward of the plane 100 and outward from the upper mating surfaces 78, 80. The major axes of the mating surfaces 78, 80, 96, 98 are preferably substantially horizontal. Accordingly, when the user pulls the levers 10, 12, the levers 10, 12 are preferably effectively wedged between the upper mating surfaces 78, 80 and the lower mating surfaces 96, 98. The upper mating surfaces 78, 80 are therefore preferably configured to impede the torque on the levers 10, 12 about the lower mating surfaces 96, 98, which are configured to receive the rearward pulling force applied by the user, to reduce strain on the pivot pins 42, 44. The upper and lower body portions 74, 76 are preferably configured to, in combination with the spacer 50 and the levers 10, 12, to enclose the internal components of the charging handle 8 such as the bias elements 46, 48 and the pivot pins 42, 44, thereby protecting such components from the external environment and facilitating keeping grease or oil inside the base 16 for extended use. As a result of the preferred arrangement described herein, which provides surface-to-surface contact as provided by the mating surfaces 78, 80, 96, 98 (as opposed to point-to-point contact), the charging handle 8 preferably facilitates significantly improved durability.

Figure 12:
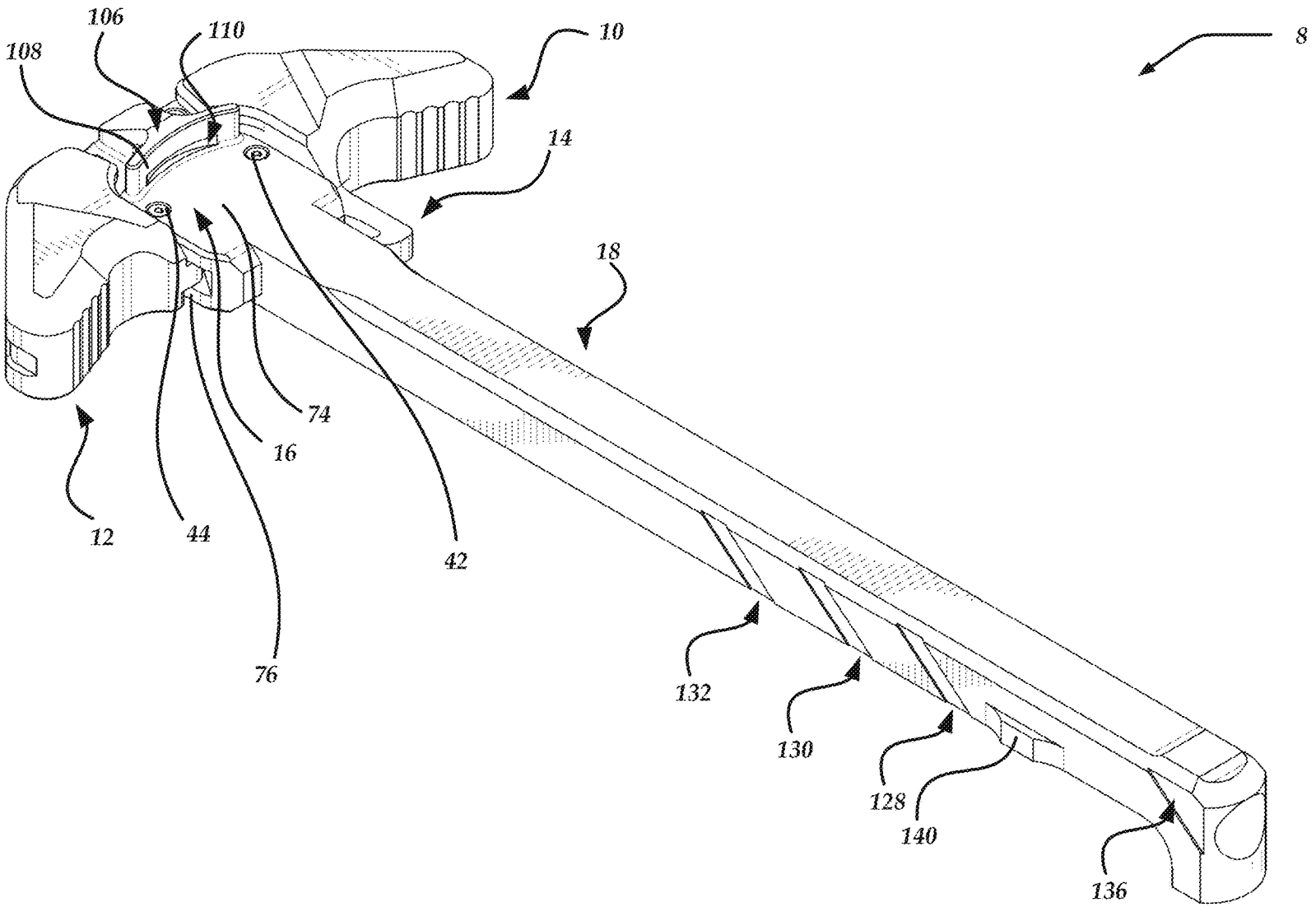
FIG. 12 is a front-right isometric view of the charging handle of FIG. 2.

As shown in FIG. 12, the base 16 preferably has a backstop 106 that projects upward from the upper body portion 74. The backstop 106 preferably has a front face 108 that defines a receptacle 110 that is configured to capture matter rearwardly expelled from the firearm 2, such as oil, debris, dust, or gas, to prevent such matter from hitting the user's face. The receptacle 110 preferably has a major axis that is substantially horizontal and substantially orthogonal to the longitudinal axis 38. The backstop 106 is therefore configured to both capture matter expelled from the firearm 2 and to redirect and slow uncaptured matter, guiding such uncaptured matter to the sides and away from the user's eyes.

Figure 13:
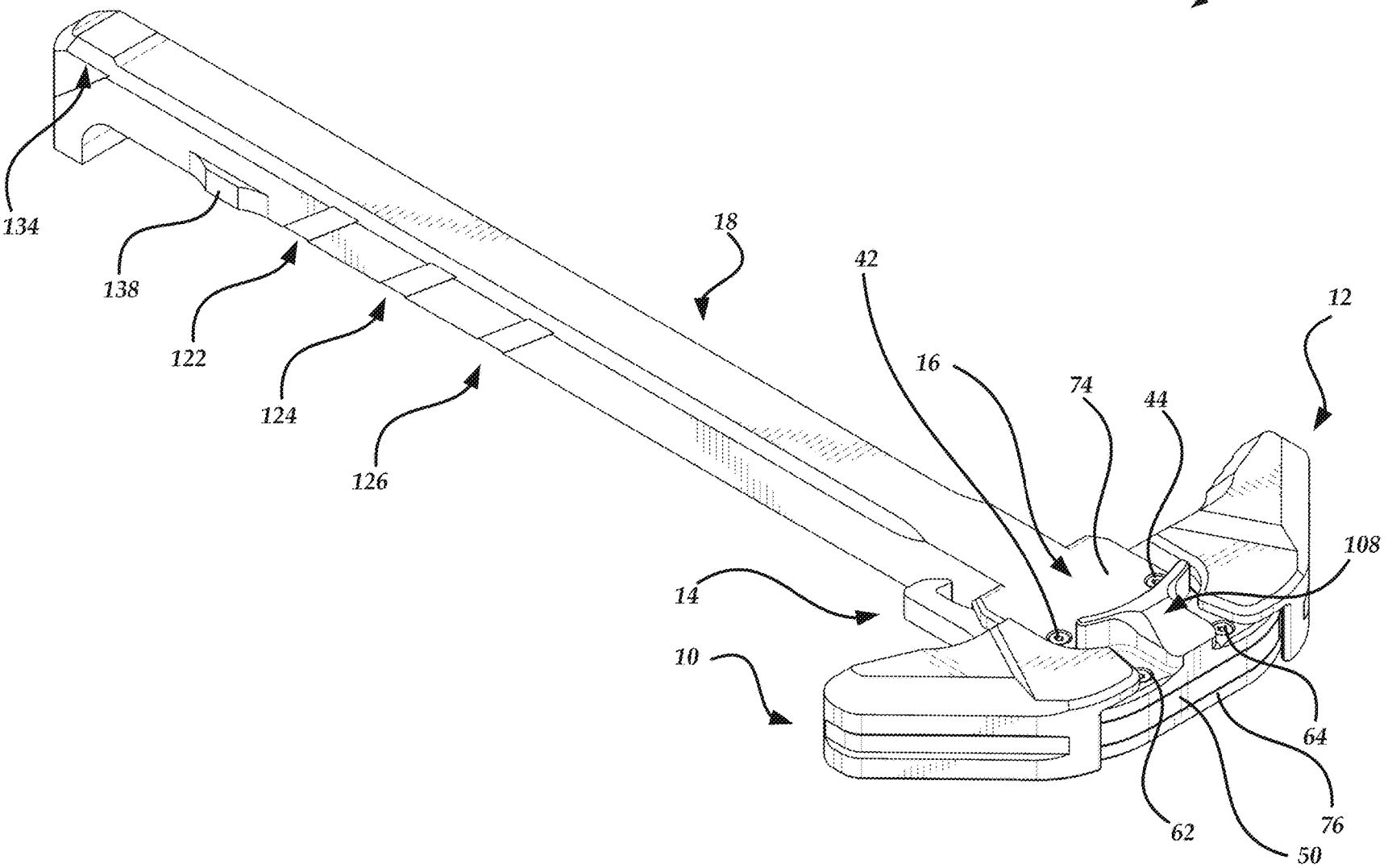
FIG. 13 is a rear-left isometric view of the charging handle of FIG. 2.
Figure 14:
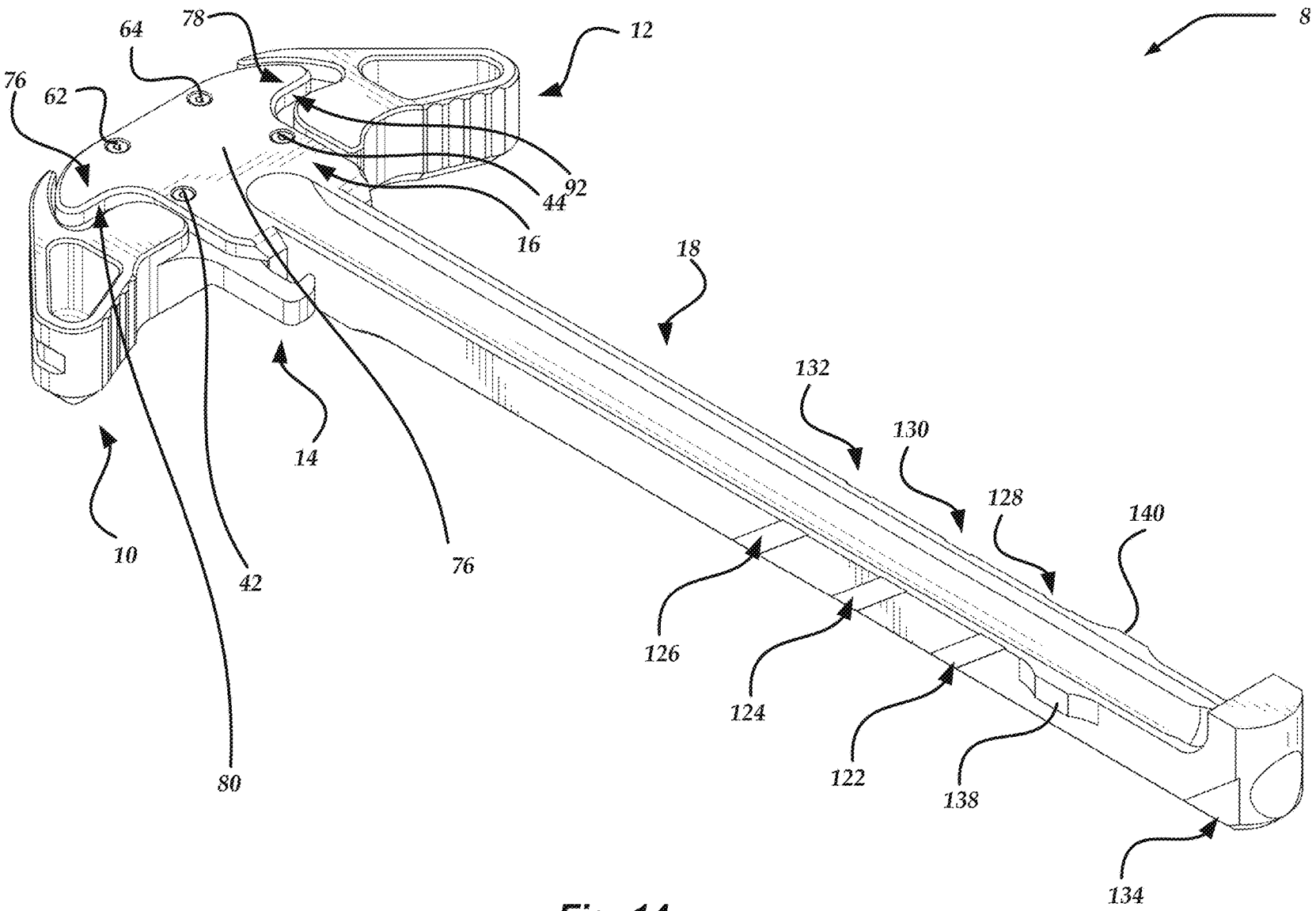
FIG. 14 is a front-left isometric view of the charging handle of FIG. 2.
Figure 15:
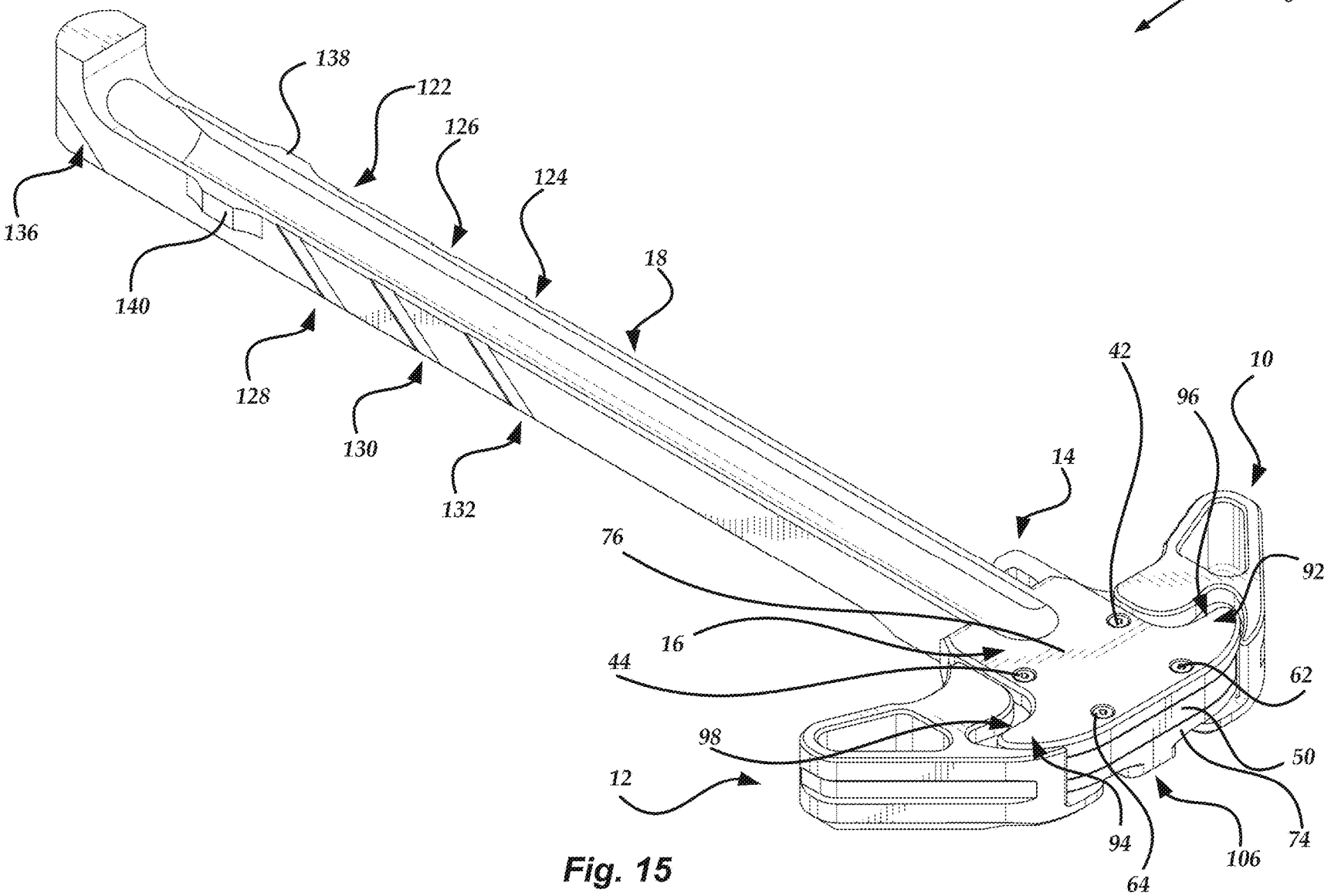
FIG. 15 is a rear-right isometric view of the charging handle of FIG. 2.
Figure 16:
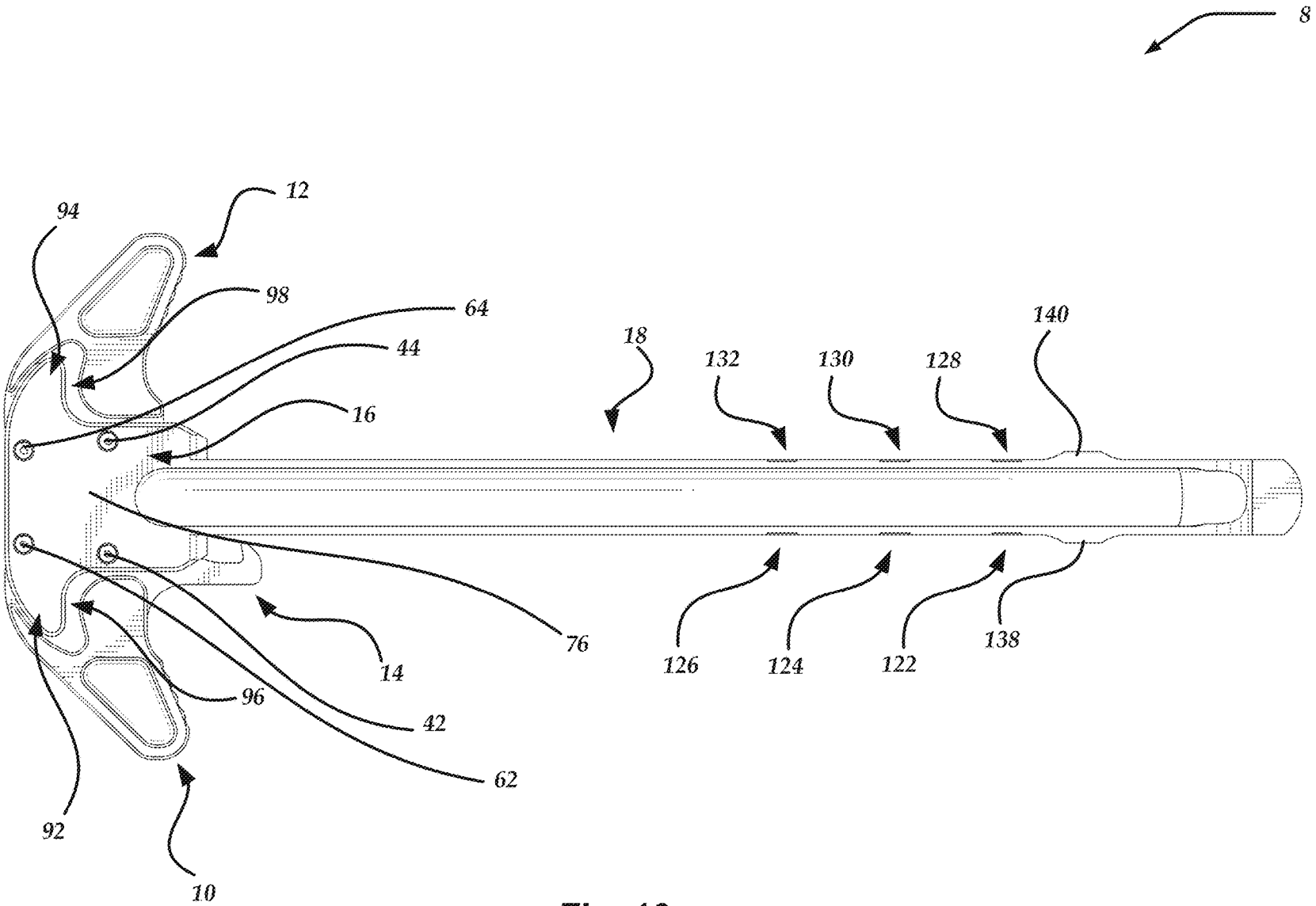
FIG. 16 is a bottom plan view of the charging handle of FIG. 2.
Figure 17:
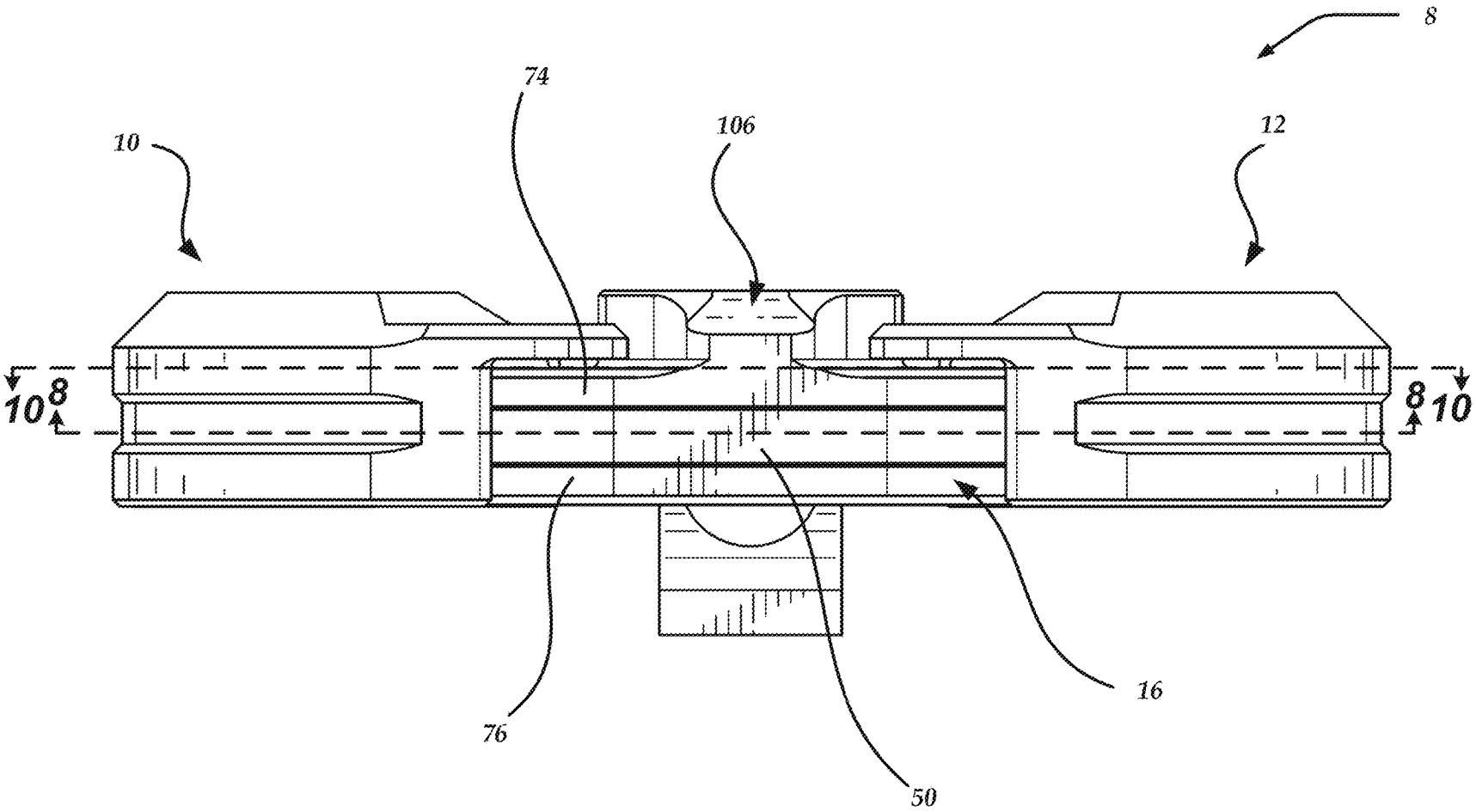
FIG. 17 is a rear elevational view of the charging handle of FIG. 2.
Figure 18:
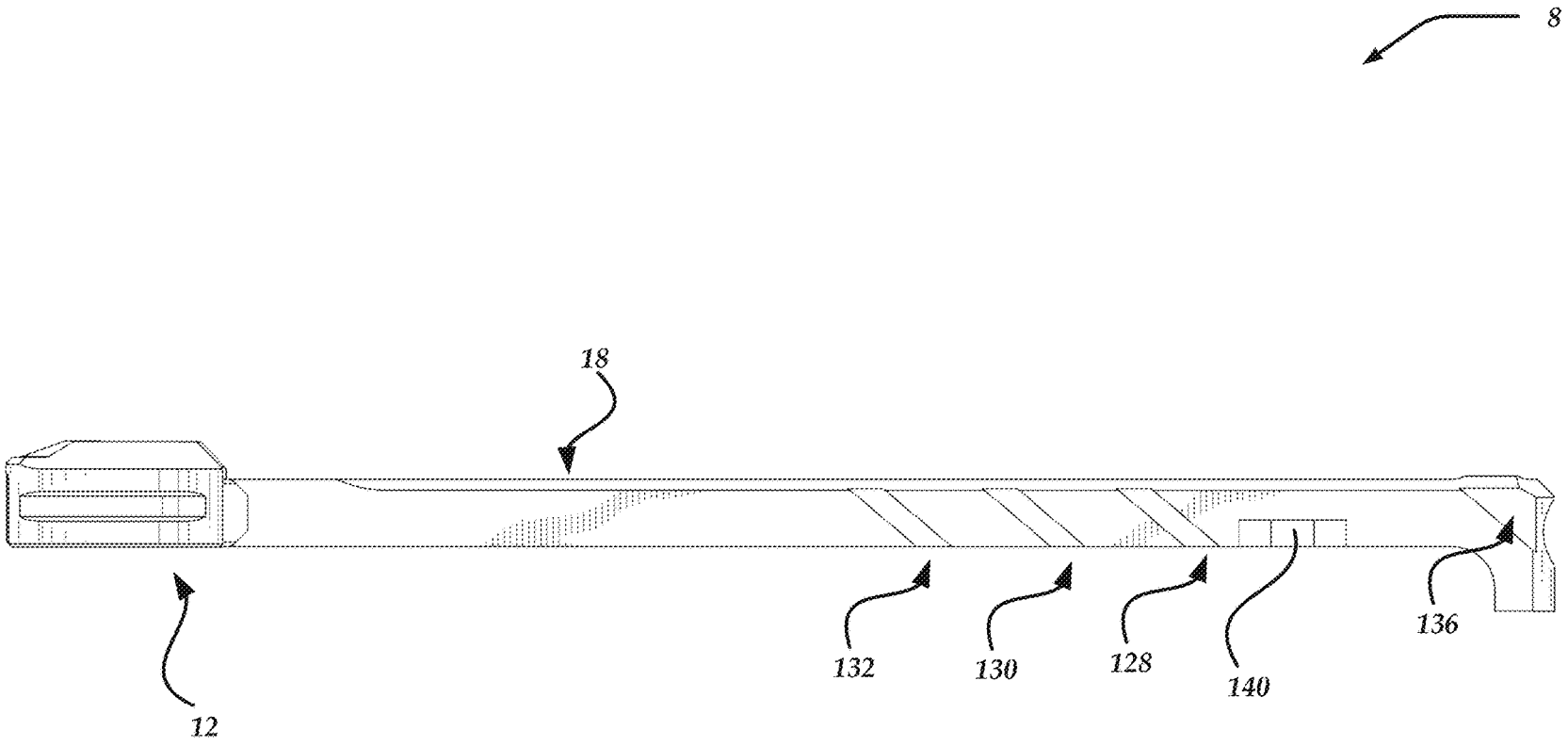
FIG. 18 is a right elevational view of the charging handle of FIG. 2.

As shown in FIGS. 13 and 14, the shaft 18 is preferably configured to clean or lubricate the firearm 8 during use. The left face of the shaft 18 preferably defines one or more recesses such as recesses 122, 124, 126 (see FIG. 13). The right face of the shaft 18 preferably defines one or more recesses such as recesses 128, 130, 132 (see FIG. 12). The recesses 122-132 are preferably spaced apart from each other and therefore define a series of serrations on the left face of the shaft 18 and a series of serrations on the right face of the shaft 18. The distal end portion of the shaft 18 preferably defines a recess 134 on the left side (see FIG. 13) and a recess 136 on the right side (see FIG. 12). These recesses 122-136 and the edges that define the recesses 122-136 preferably facilitate cutting debris and carbon buildup in the firearm 2 as the charging handle 8 moves forward or rearward in the firearm 2. These recesses 122-136 preferably facilitate retaining lubricant in such recesses. The recesses 122-132 are preferably disposed in the distal half of the shaft 18 and rearward of the left and right alignment mechanisms 138, 140. The recesses 134, 136 are preferably disposed forward of the alignment mechanisms 138, 140. As a result of the arrangement of the preferred embodiment described herein, the charging handle 8 preferably facilitates improving reliability of the firearm 8 because the shaft 18 cleans or lubricates the firearm 8 during use.

Figure 21:
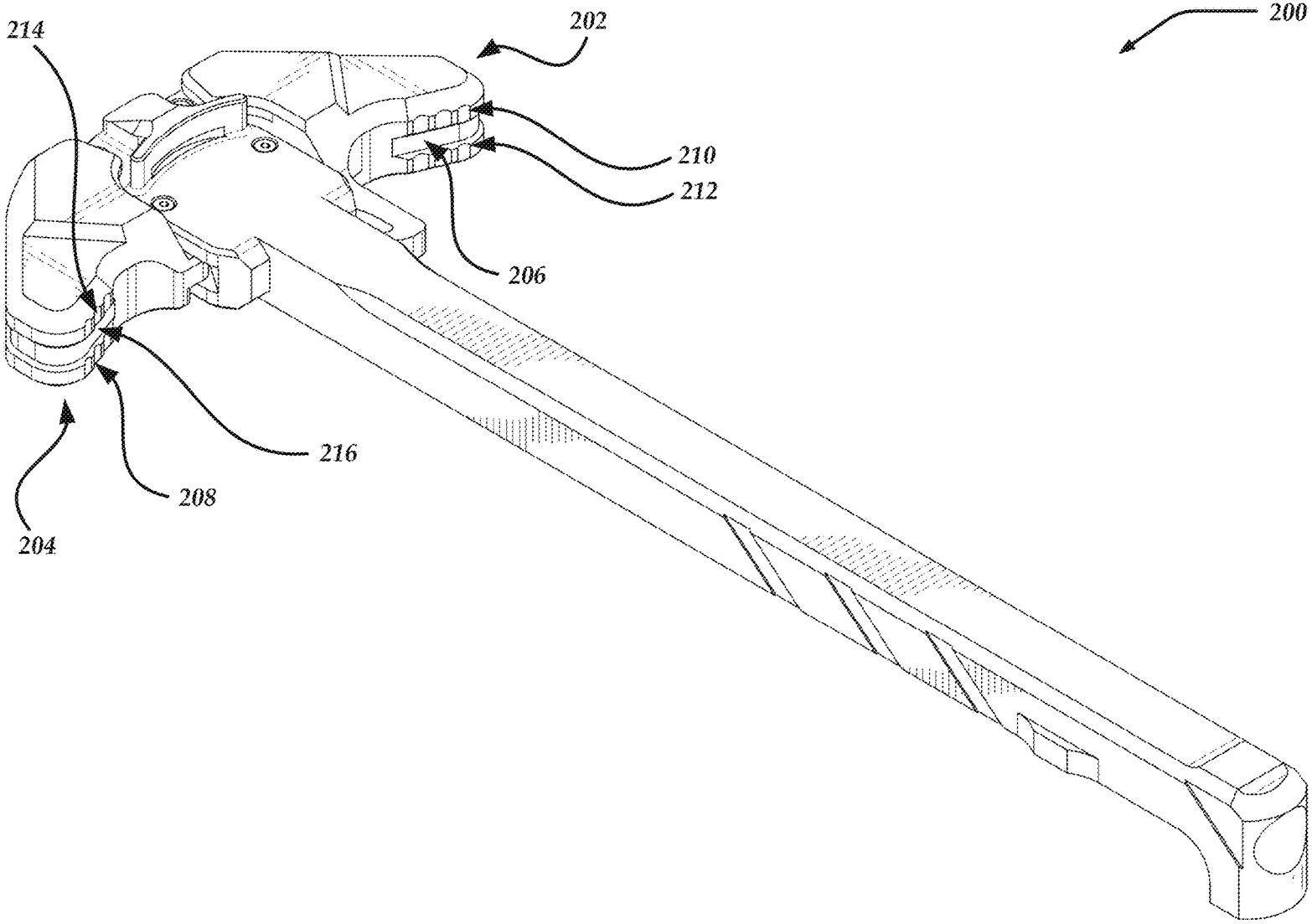
FIG. 21 is a front-right isometric view of a second embodiment of the charging handle.
Figure 22:
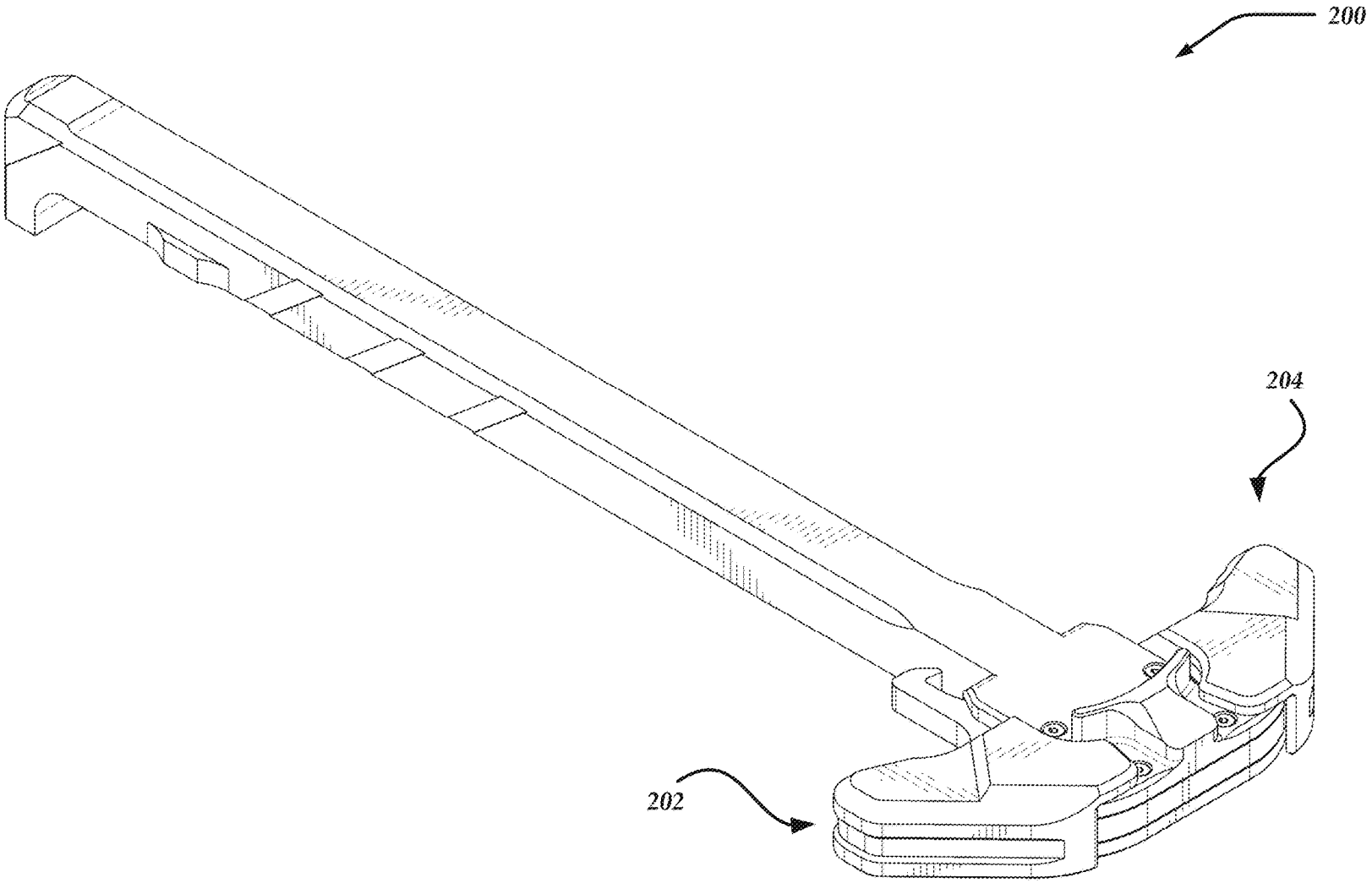
FIG. 22 is a rear-left isometric view of the charging handle of FIG. 21.
Figure 23:
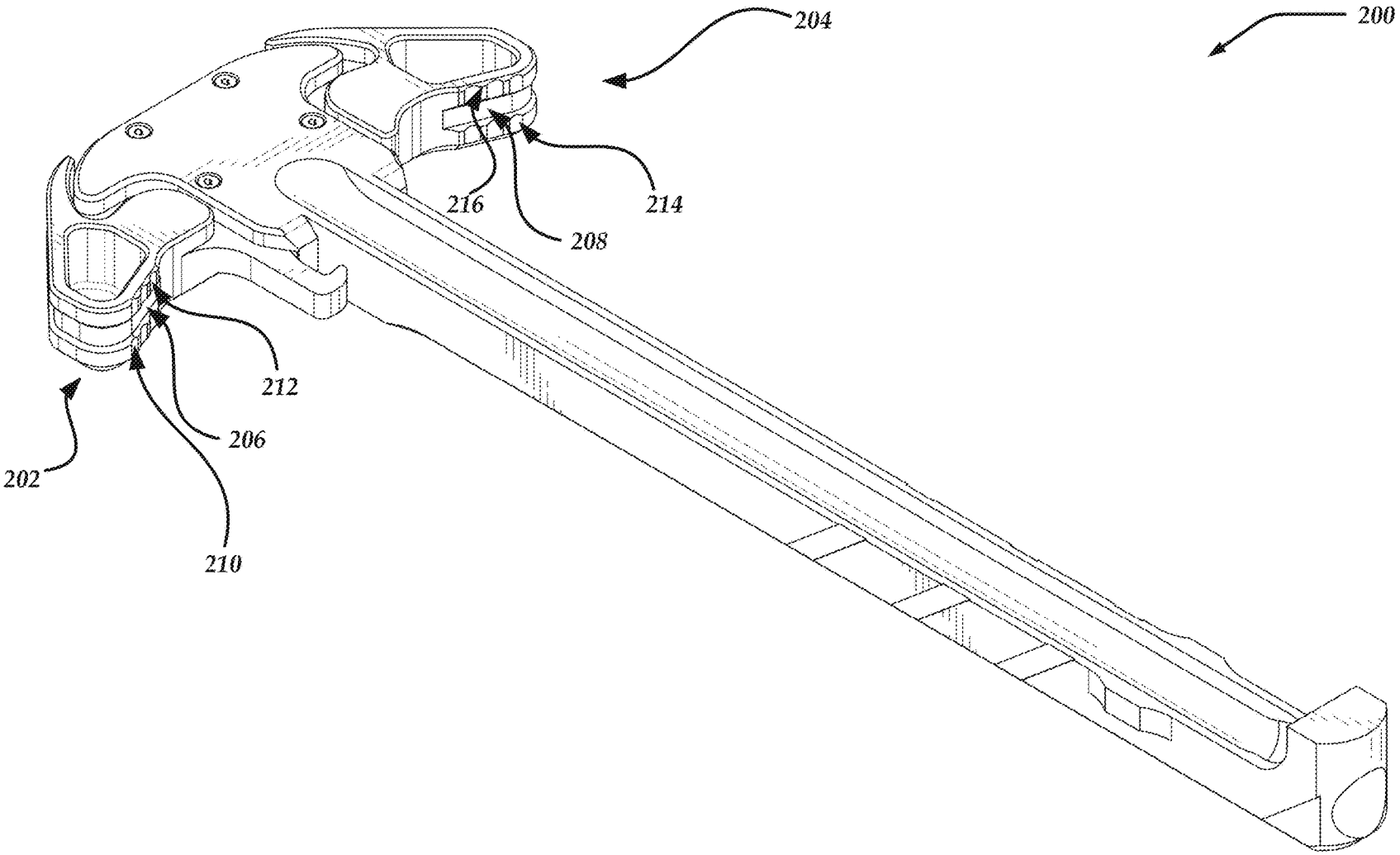
FIG. 23 is a front-left isometric view of the charging handle of FIG. 21.
Figure 24:
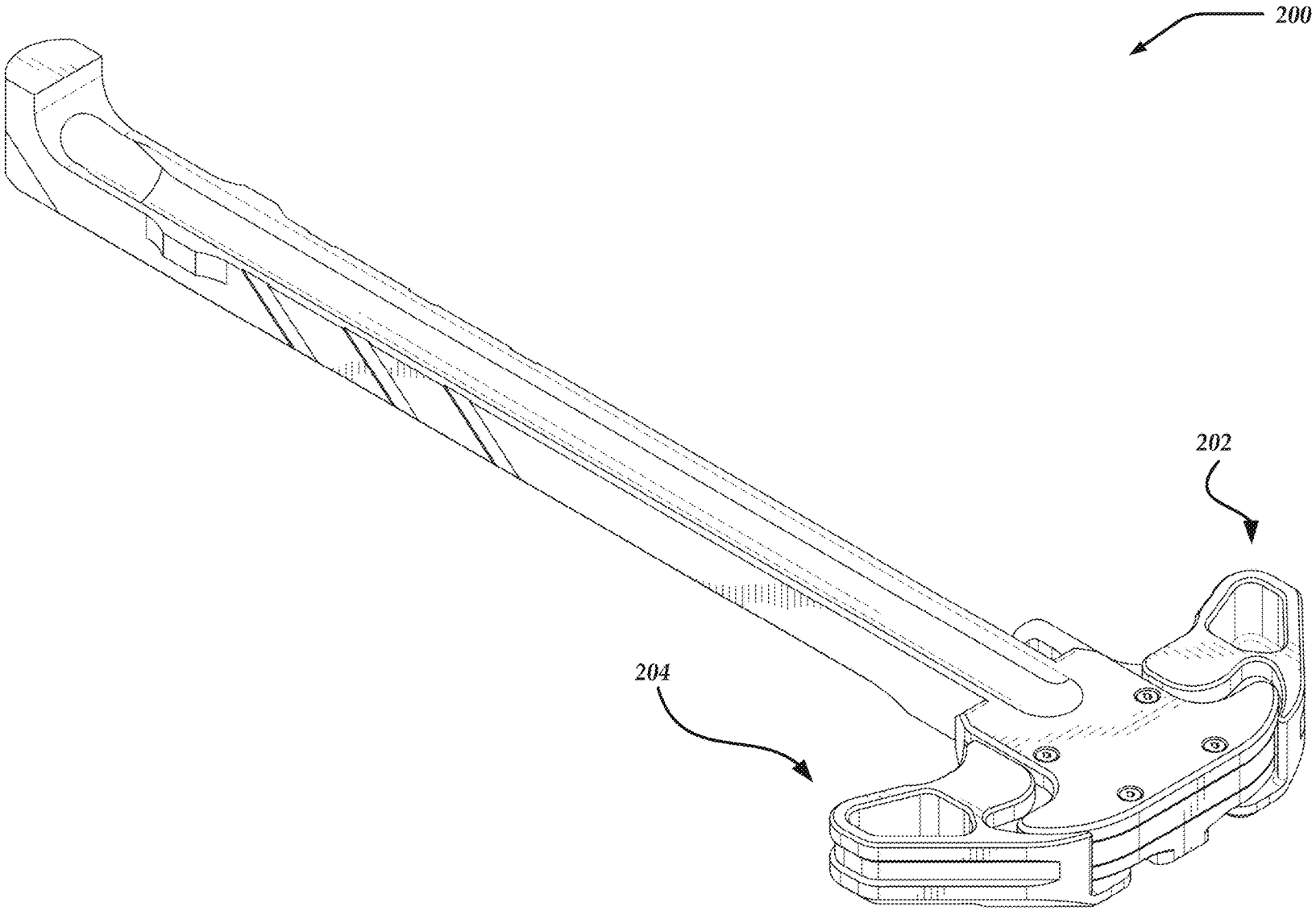
FIG. 24 is a rear-right underside perspective view of the charging handle of FIG. 21.
Figure 25:
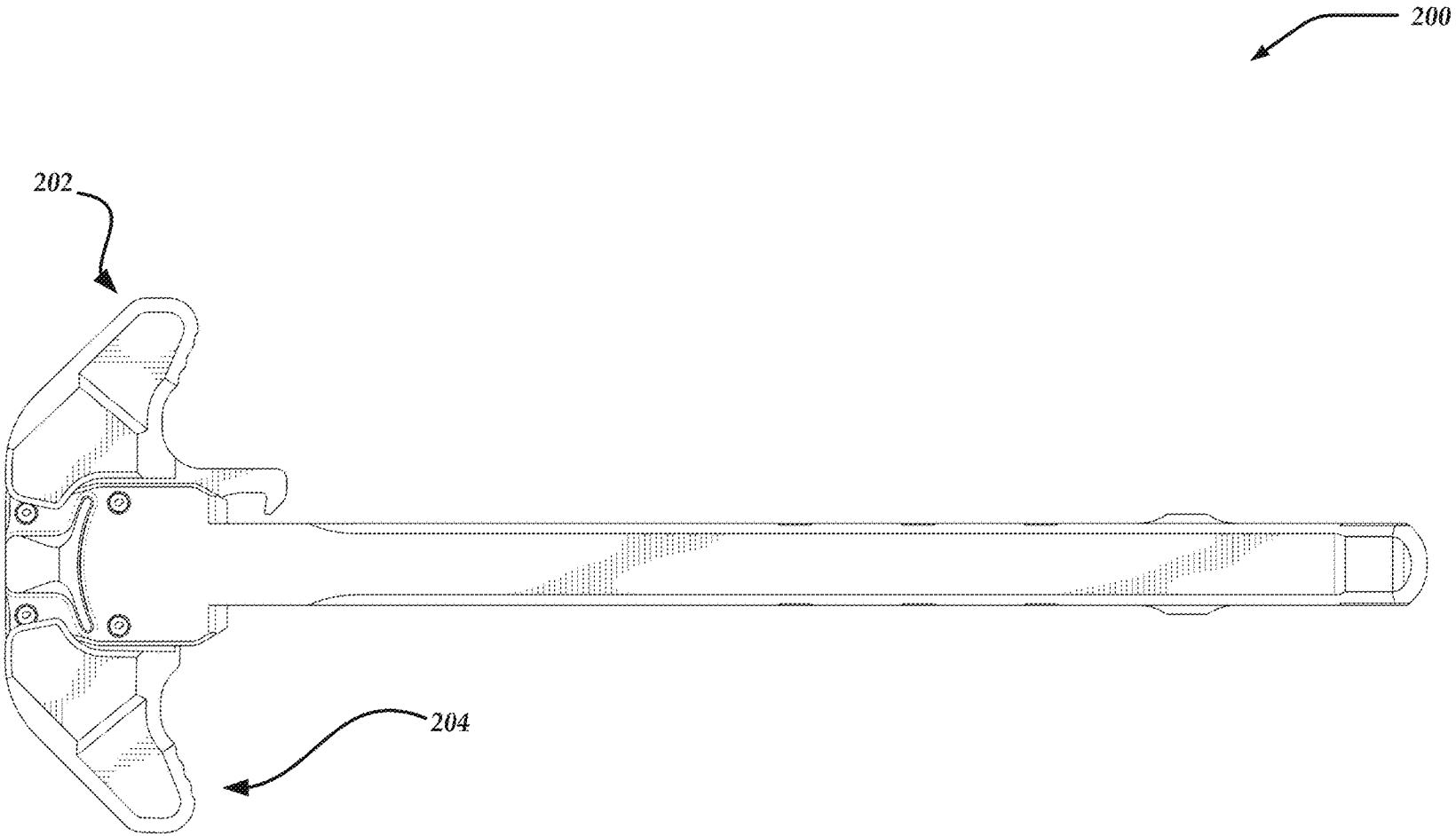
FIG. 25 is a top plan view of the charging handle of FIG. 21.
Figure 26:
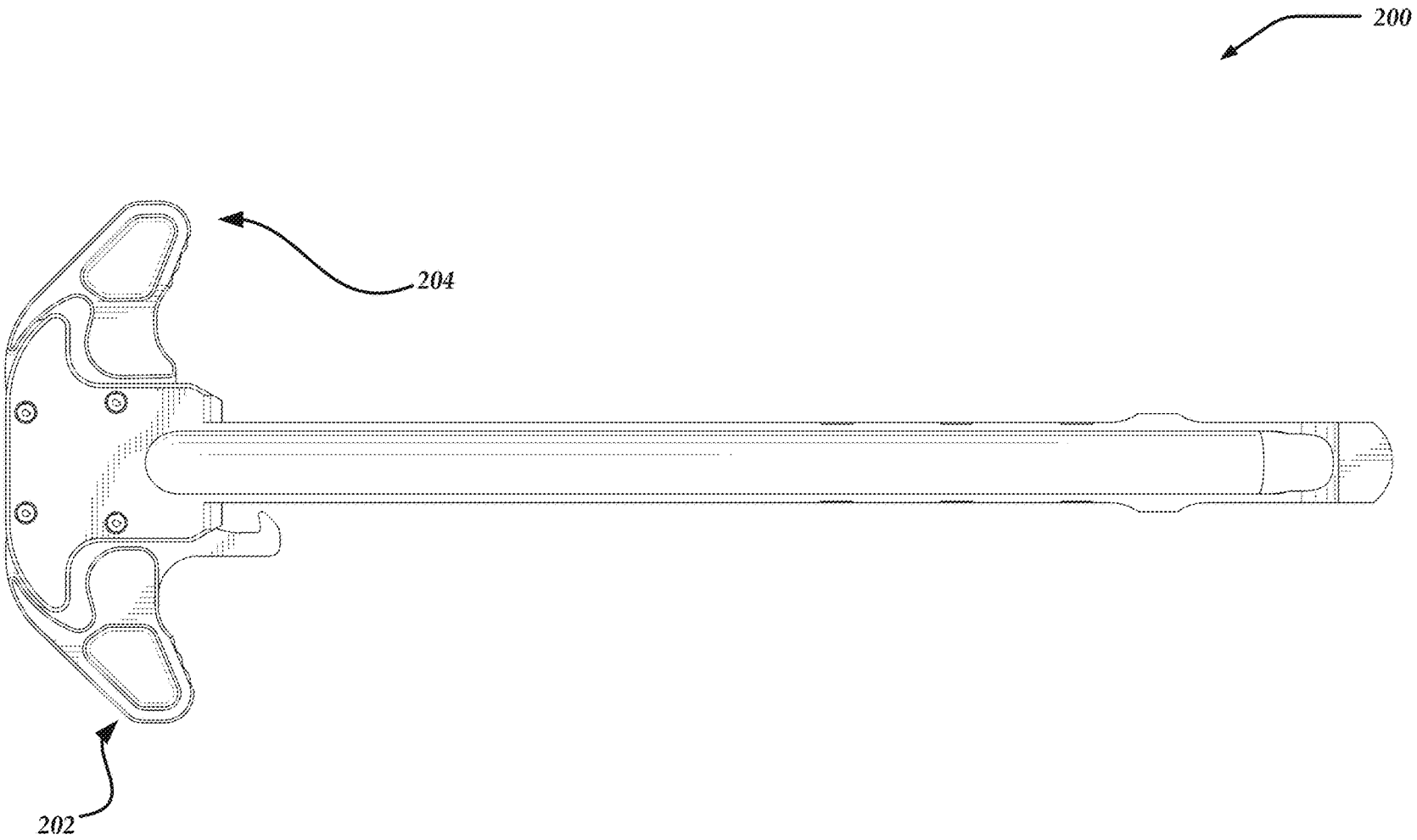
FIG. 26 is a bottom plan view of the charging handle of FIG. 21.
Figure 27:
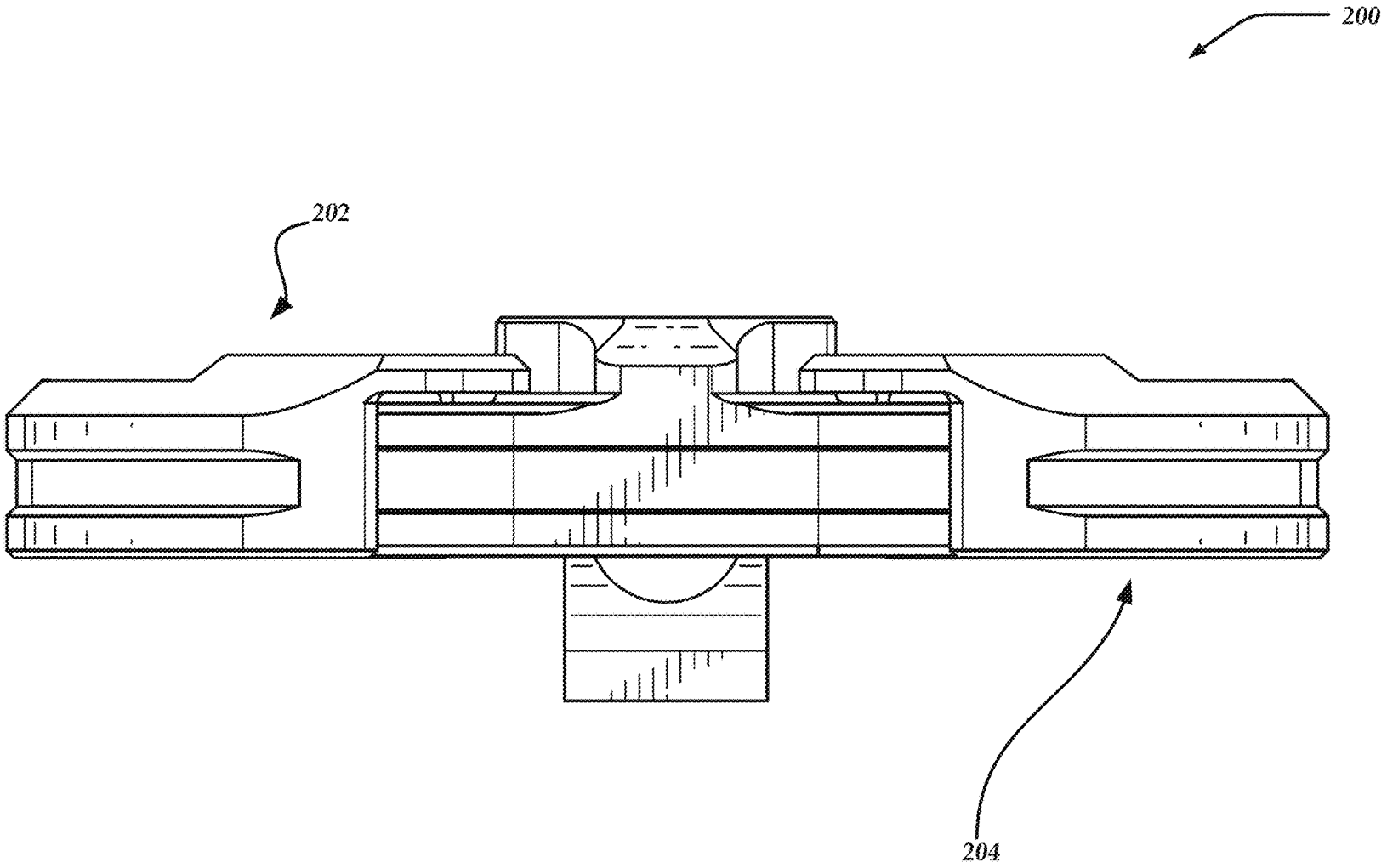
FIG. 27 is a rear elevational view of the charging handle of FIG. 21.
Figure 28:
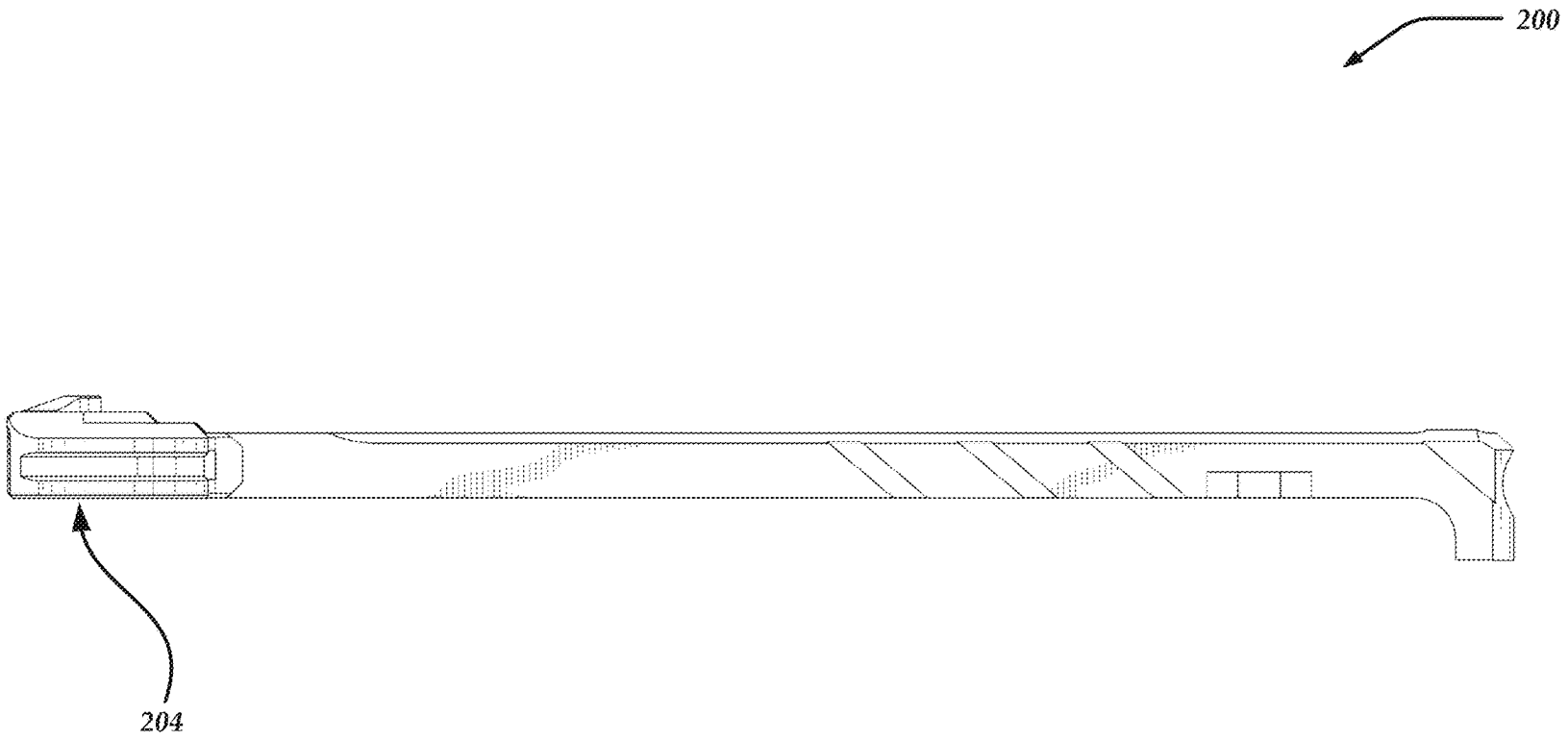
FIG. 28 is a right elevational view of the charging handle of FIG. 21.
Figure 29:
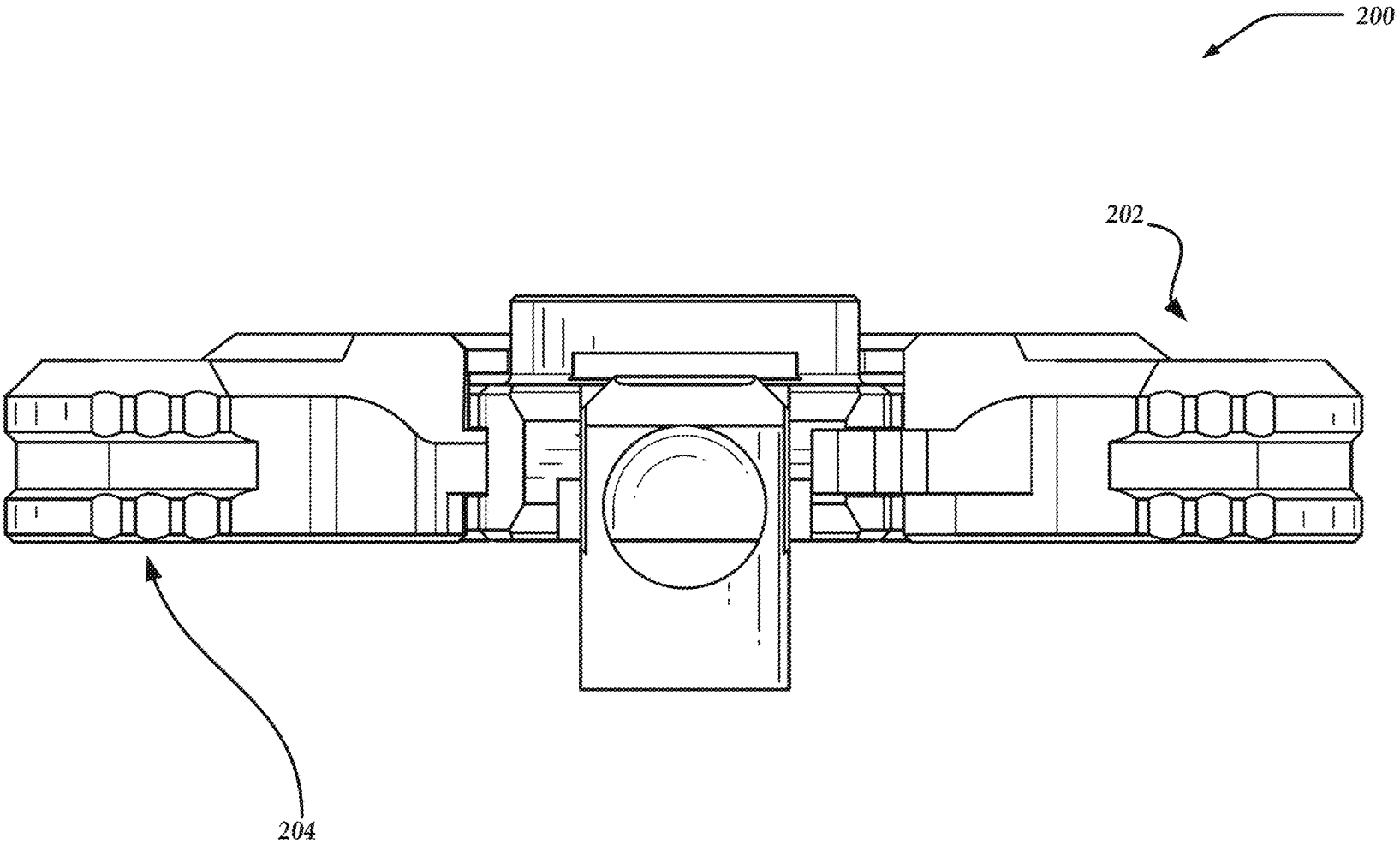
FIG. 29 is a front elevational view of the charging handle of FIG. 21.
Figure 30:
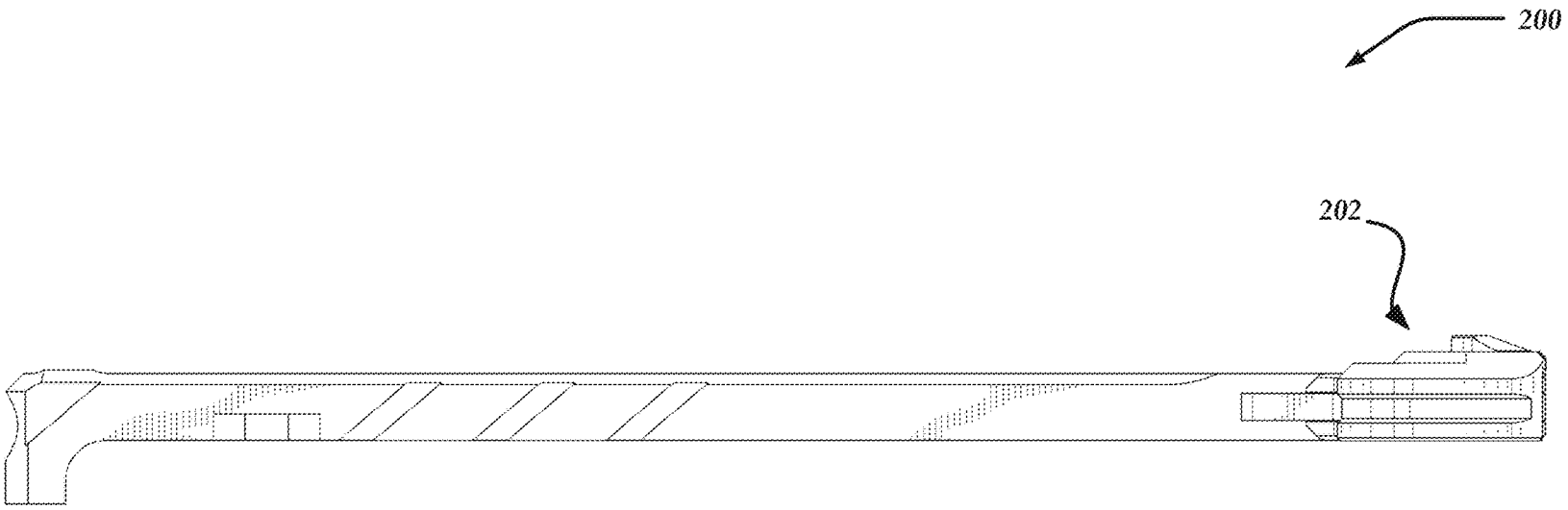
FIG. 30 is a left elevational view of the charging handle of FIG. 21.
Figure 31:
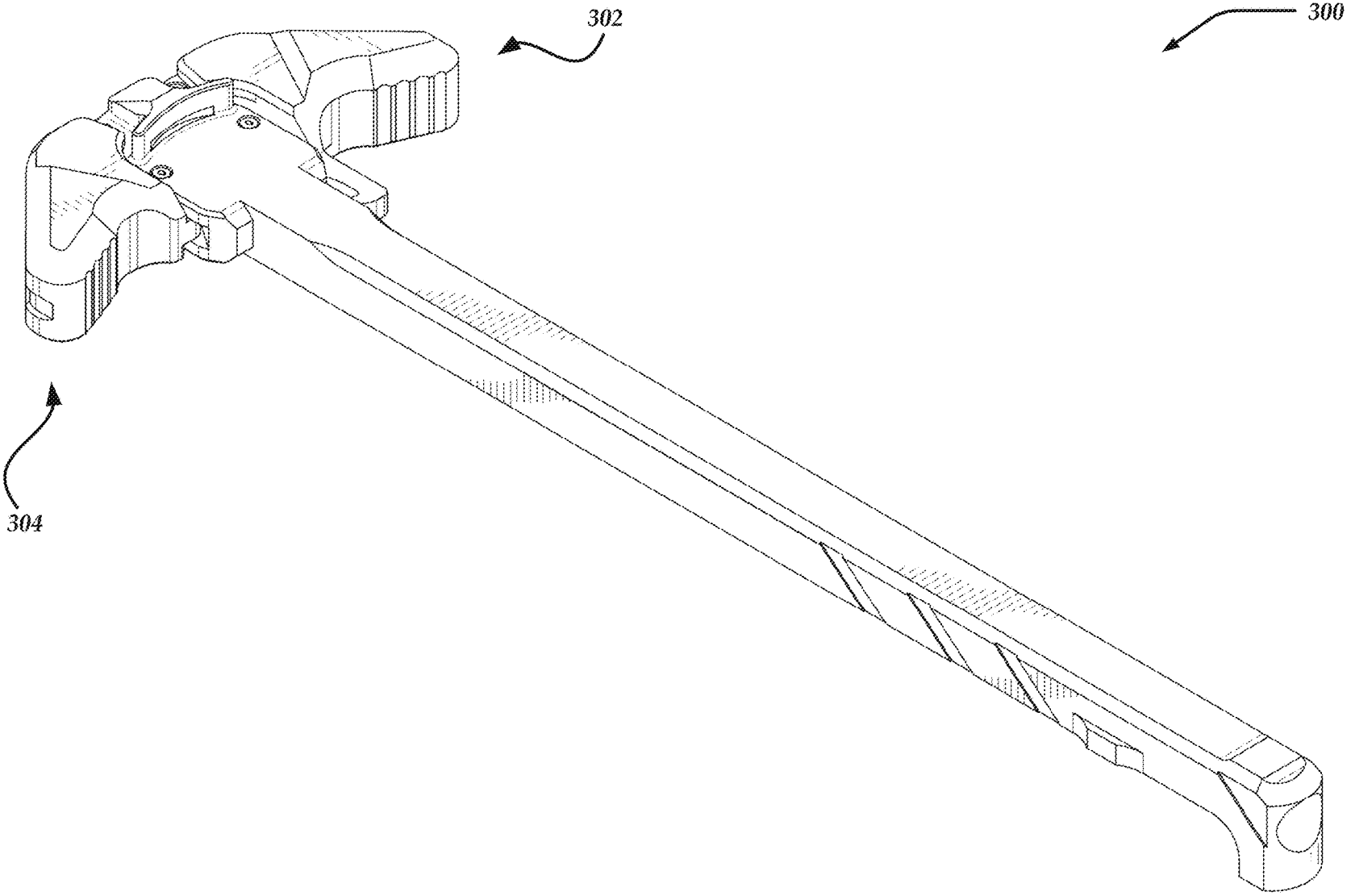
FIG. 31 is a front-right isometric view of a third embodiment of the charging handle.
Figure 32:
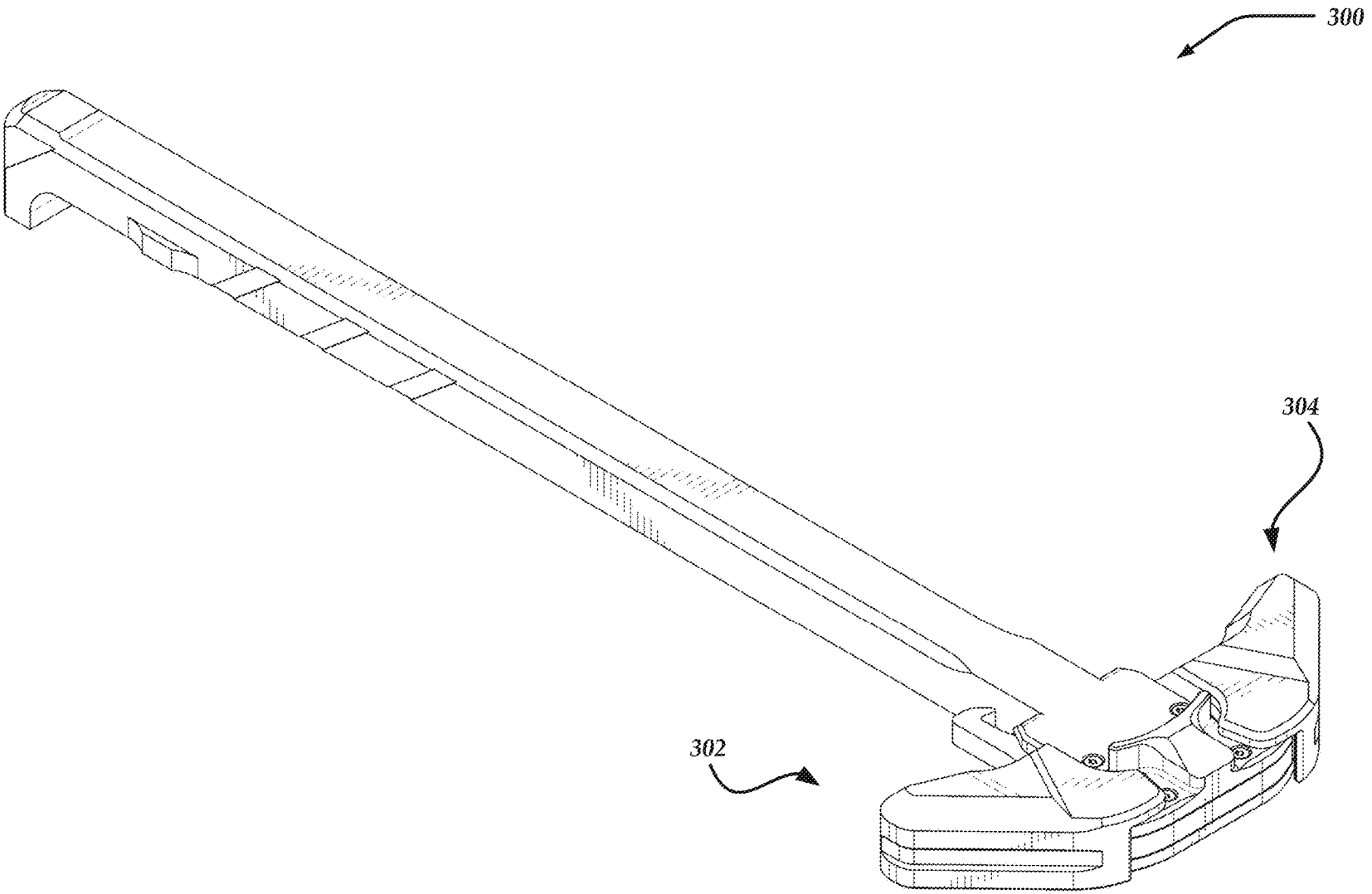
FIG. 32 is a rear-left isometric view of the charging handle of FIG. 31.
Figure 33:
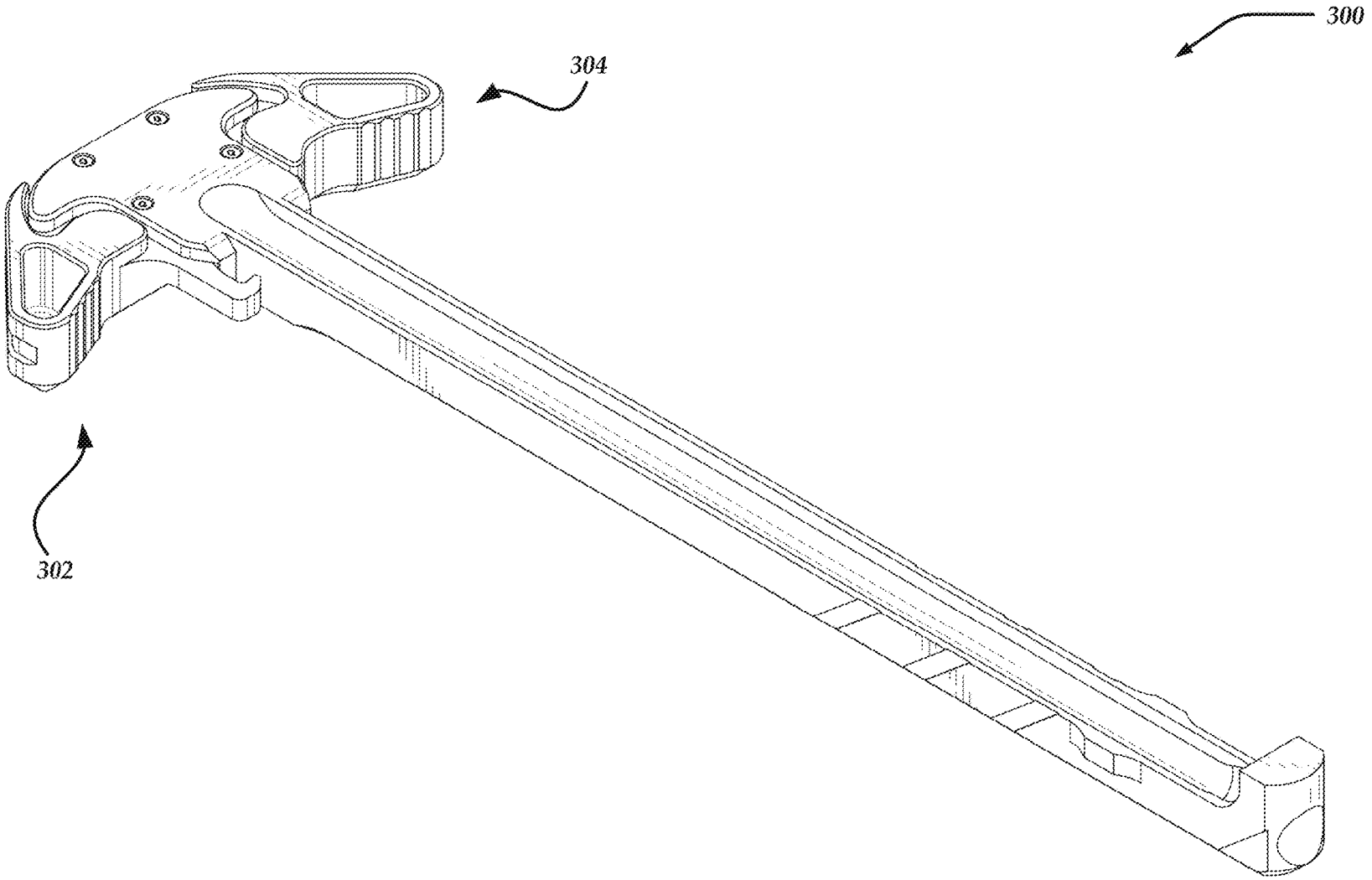
FIG. 33 is a front-left, underside isometric perspective view of the charging handle of FIG. 31.
Figure 34:
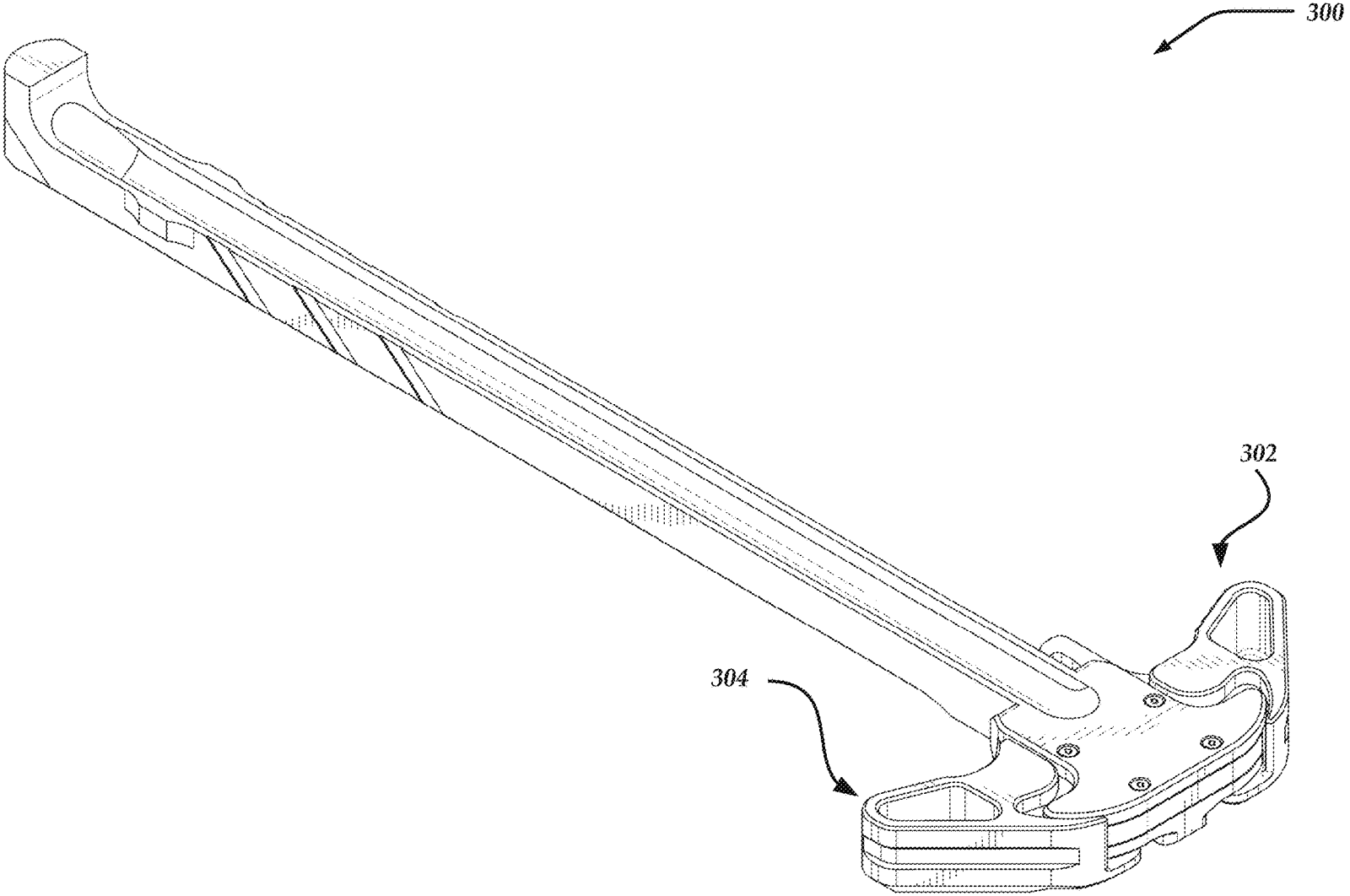
FIG. 34 is a rear-right isometric view of the charging handle of FIG. 31.
Figure 35:
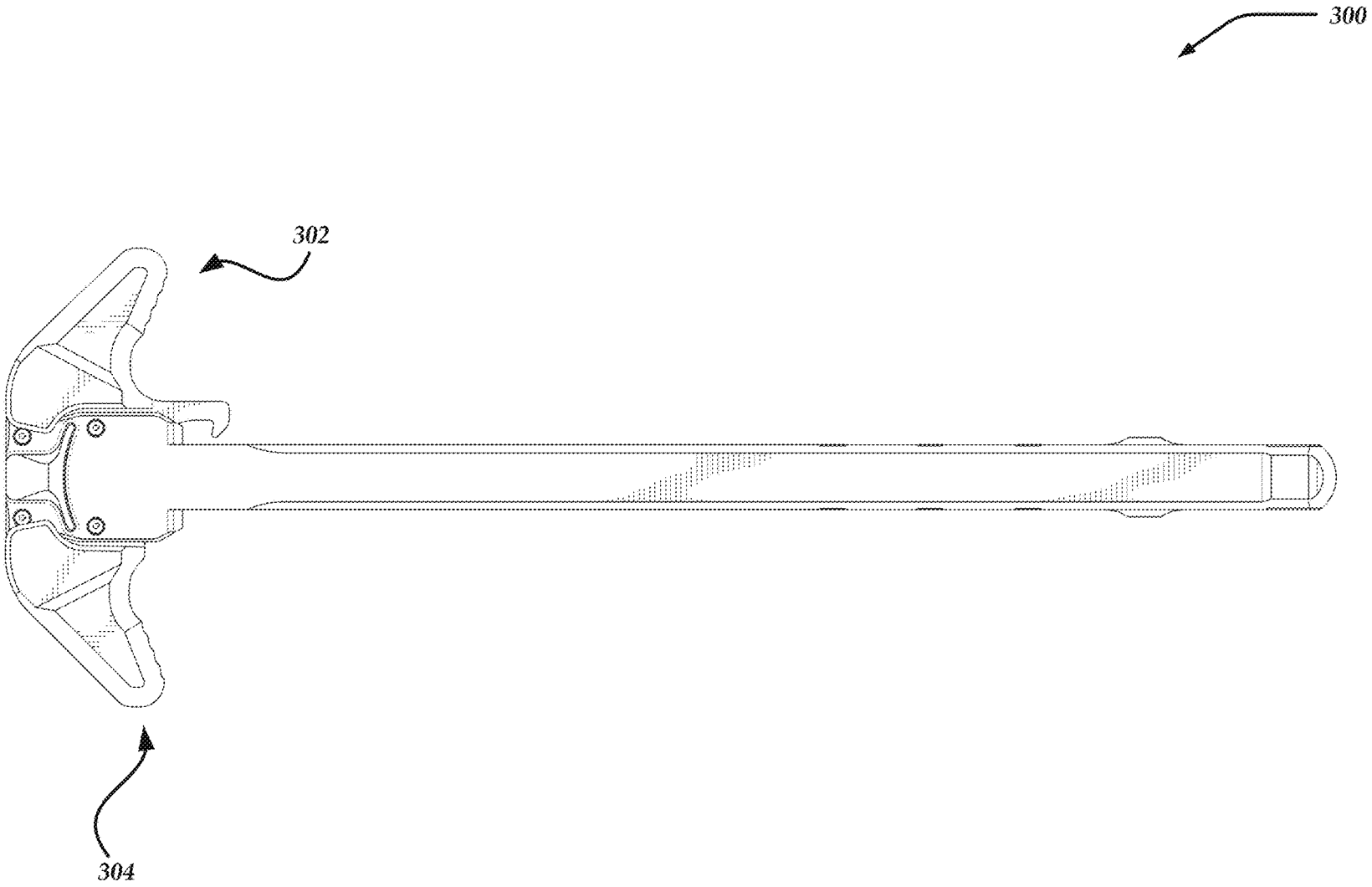
FIG. 35 is a top plan view of the charging handle of FIG. 31.
Figure 36:
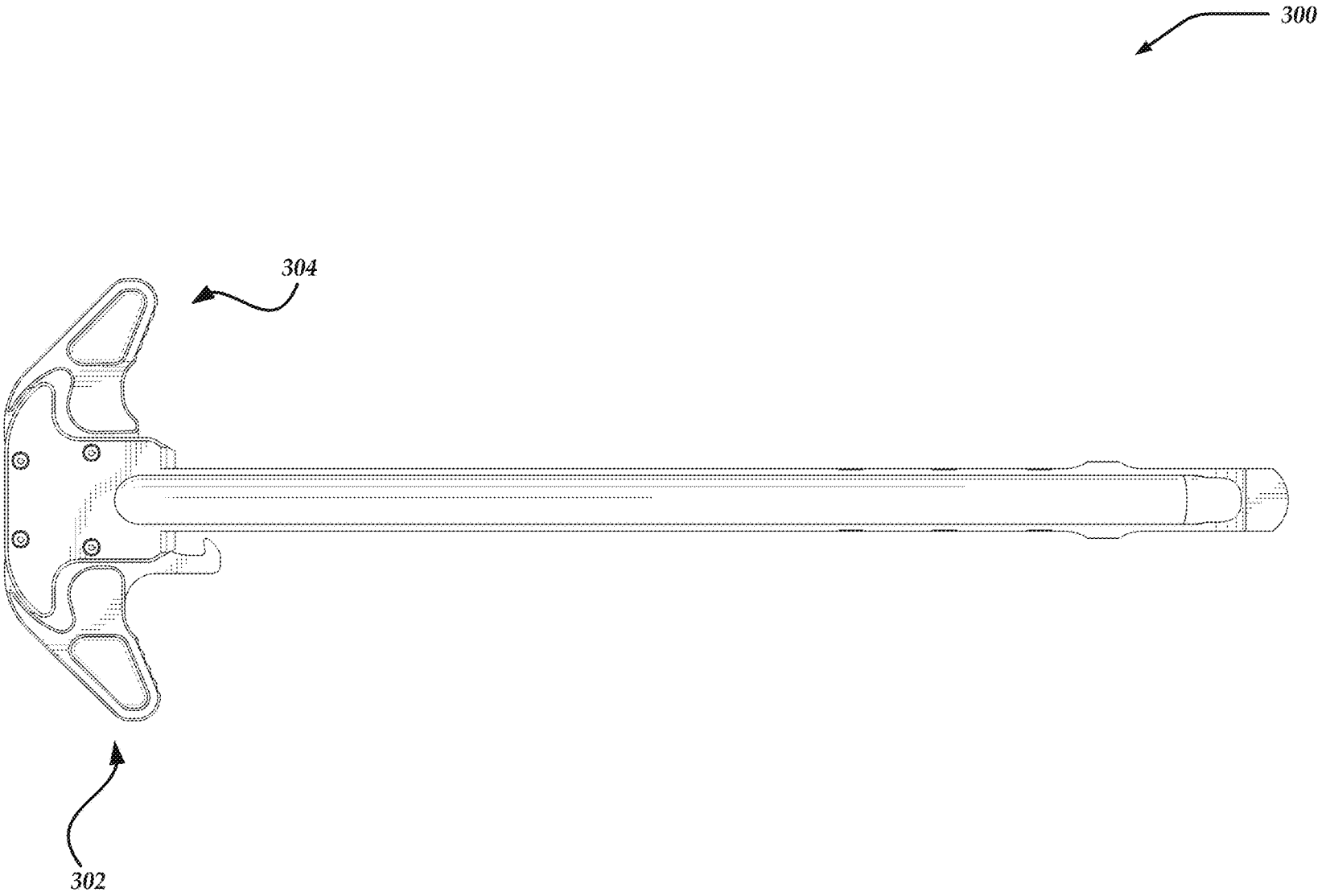
FIG. 36 is an underneath plan view of the charging handle of FIG. 31.
Figure 37:
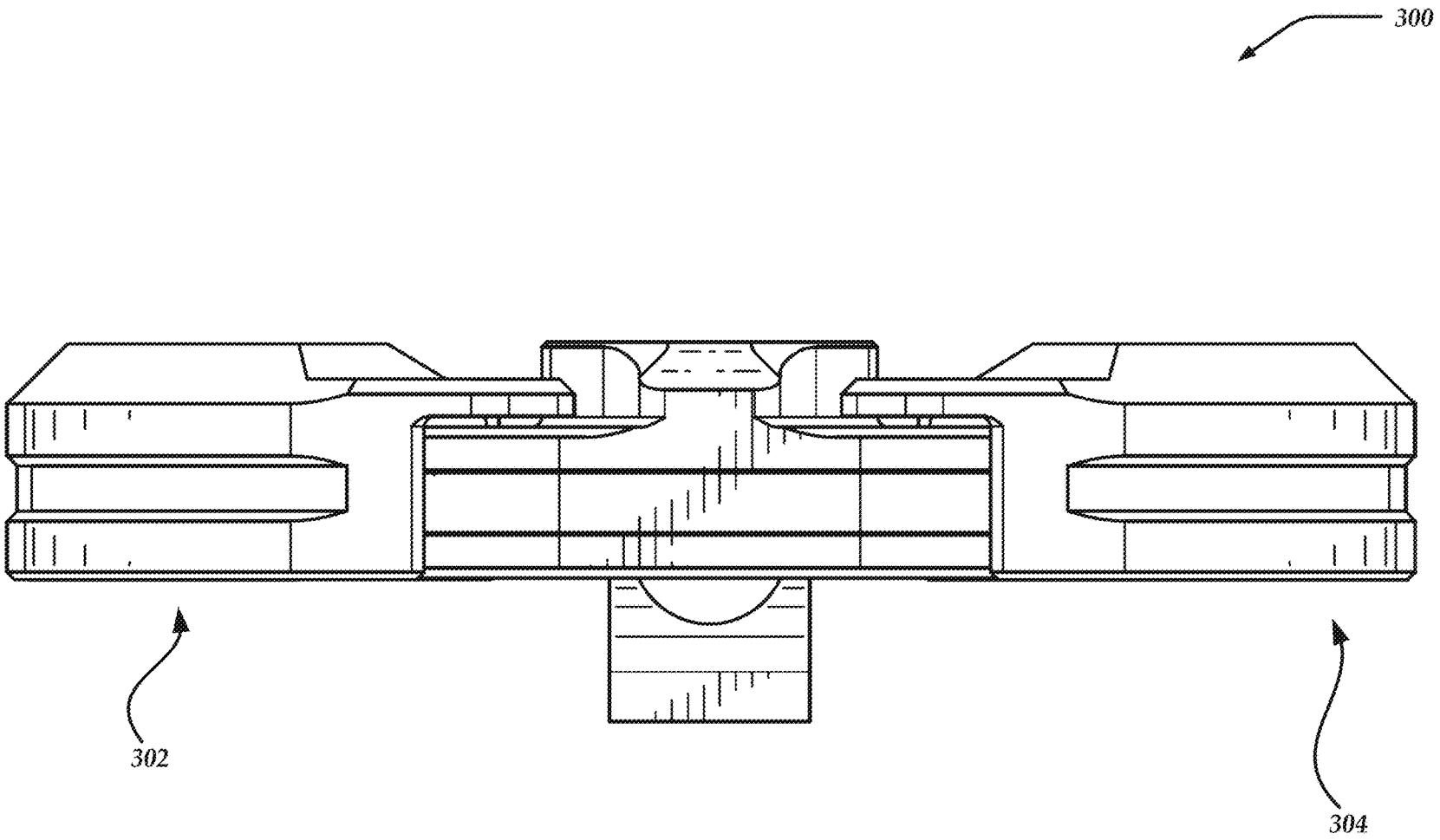
FIG. 37 is a rear elevational view of the charging handle of FIG. 31.
Figure 38:
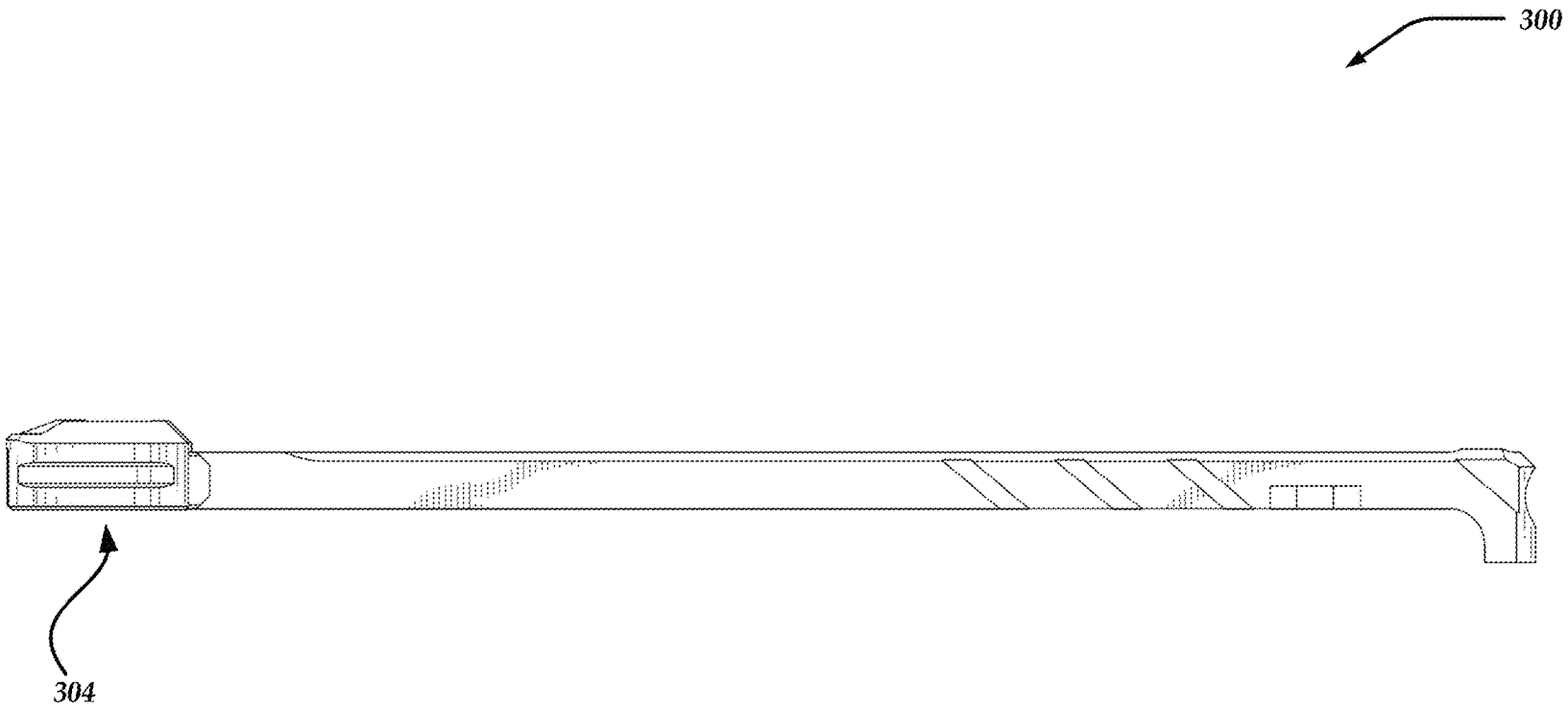
FIG. 38 is a right elevational view of the charging handle of FIG. 31.
Figure 39:
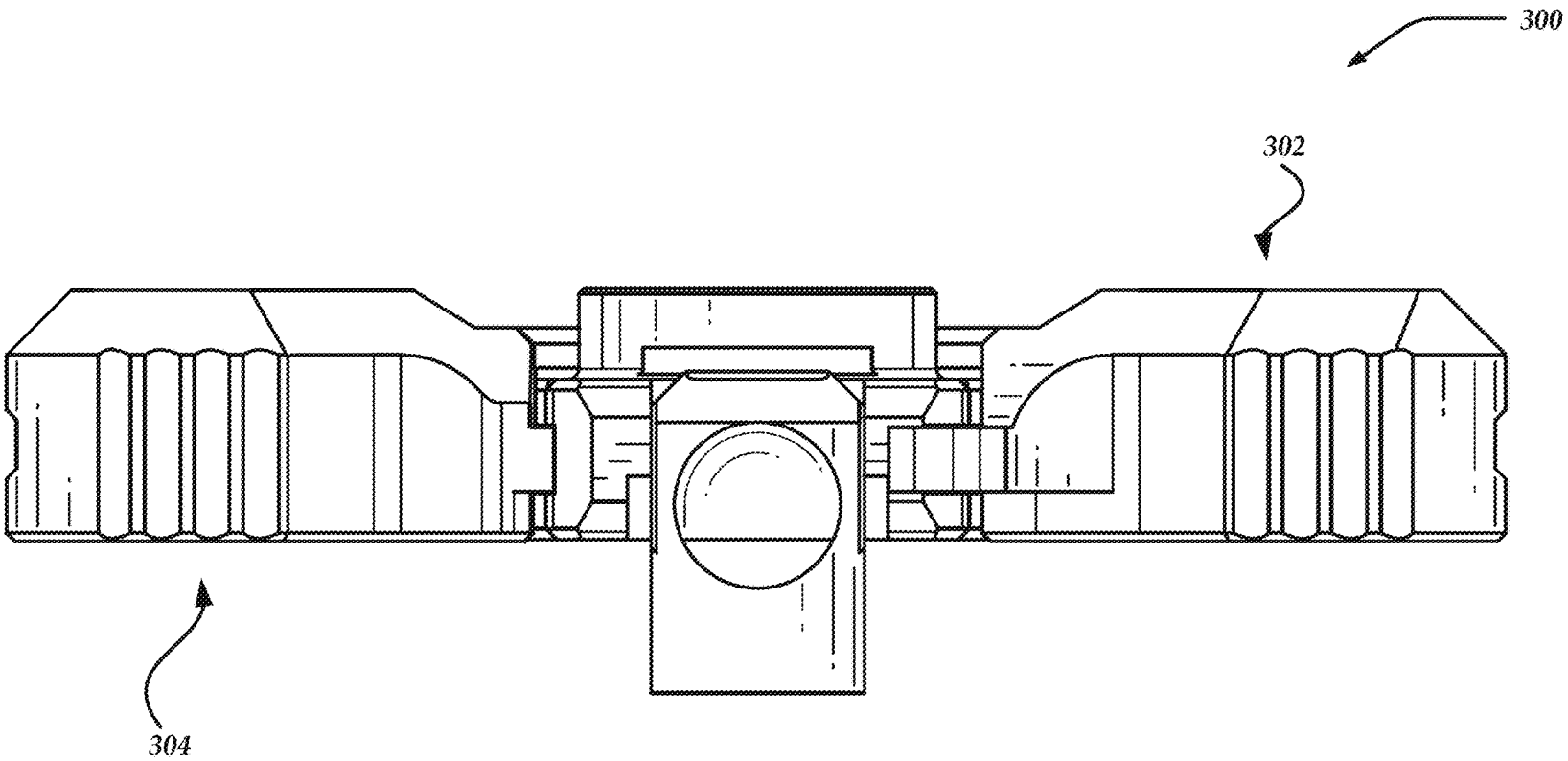
FIG. 39 is a front elevational view of the charging handle of FIG. 31.
Figure 40:
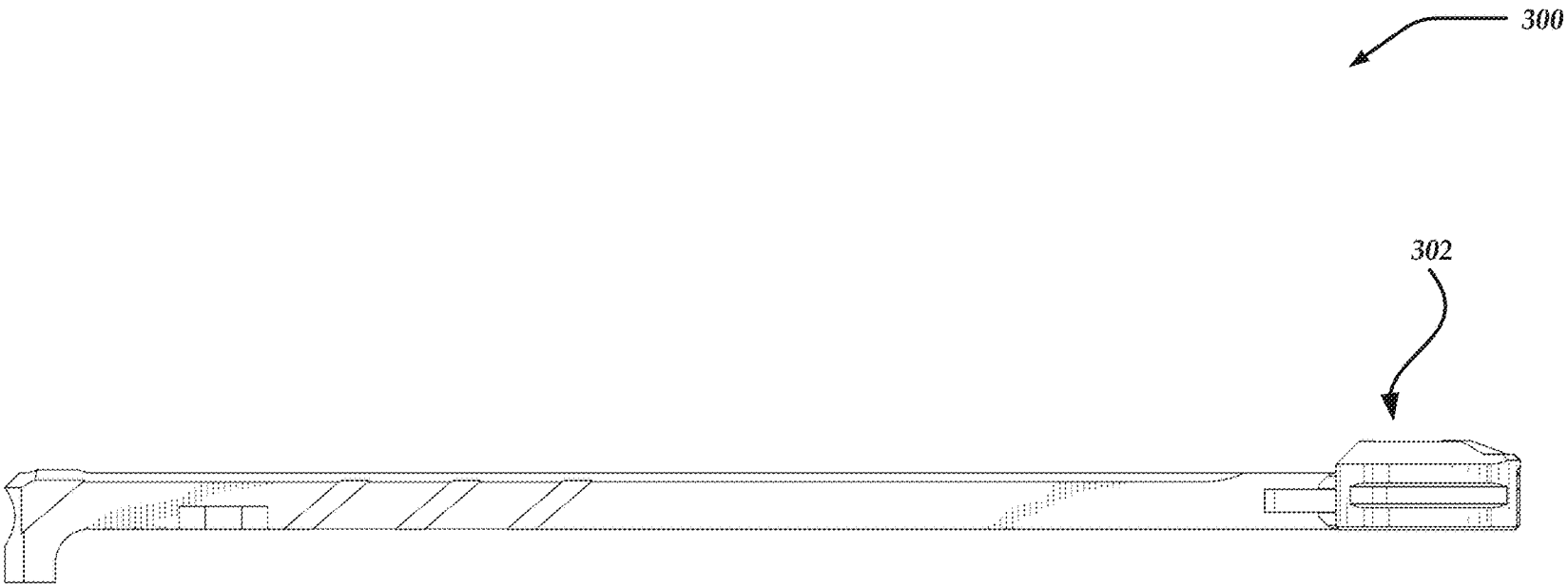
FIG. 40 is a left elevational view of the charging handle of FIG. 31.
Figure 41:
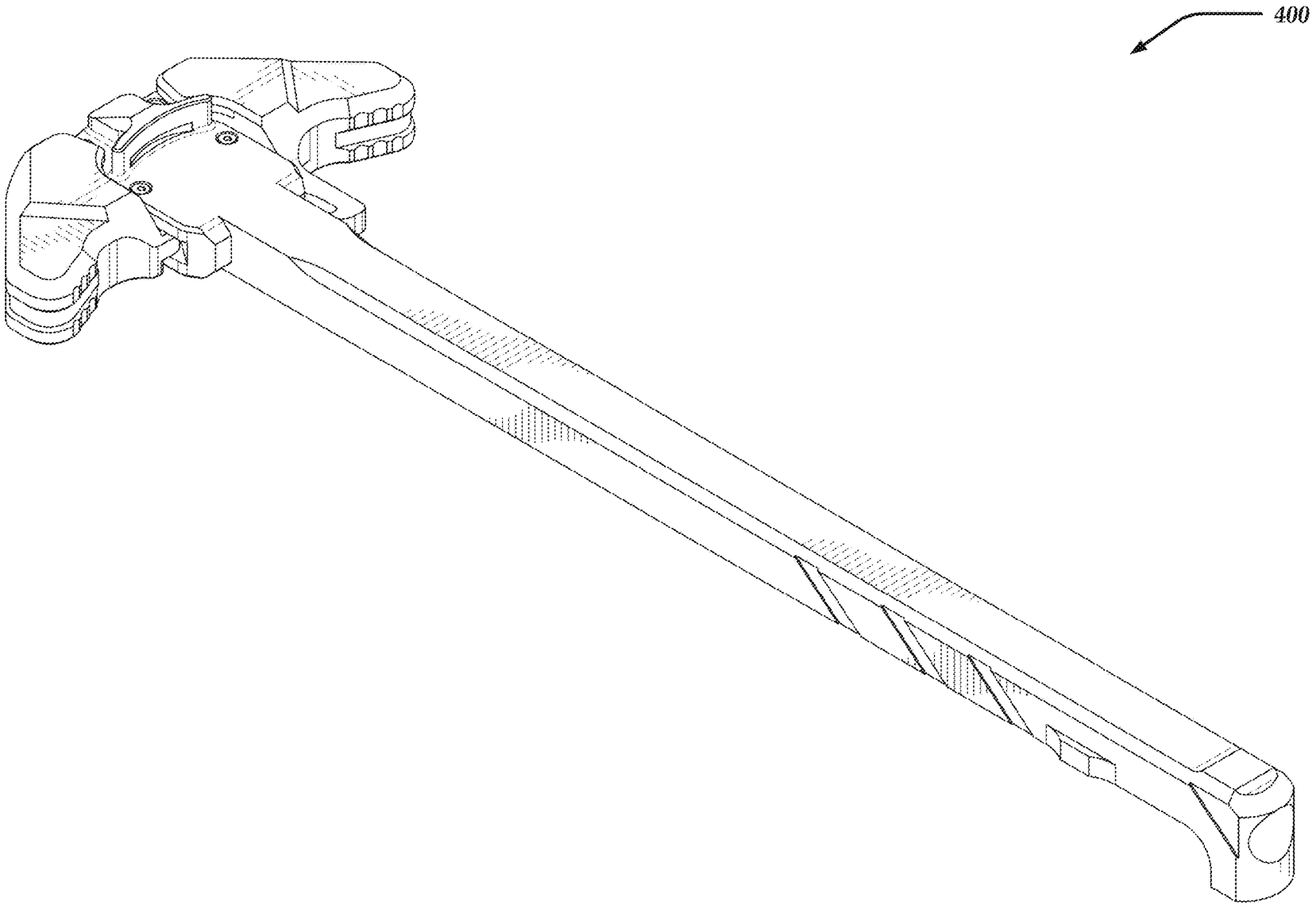
FIG. 41 is a front-right, topside isometric perspective view of a fourth embodiment of the charging handle.
Figure 42:
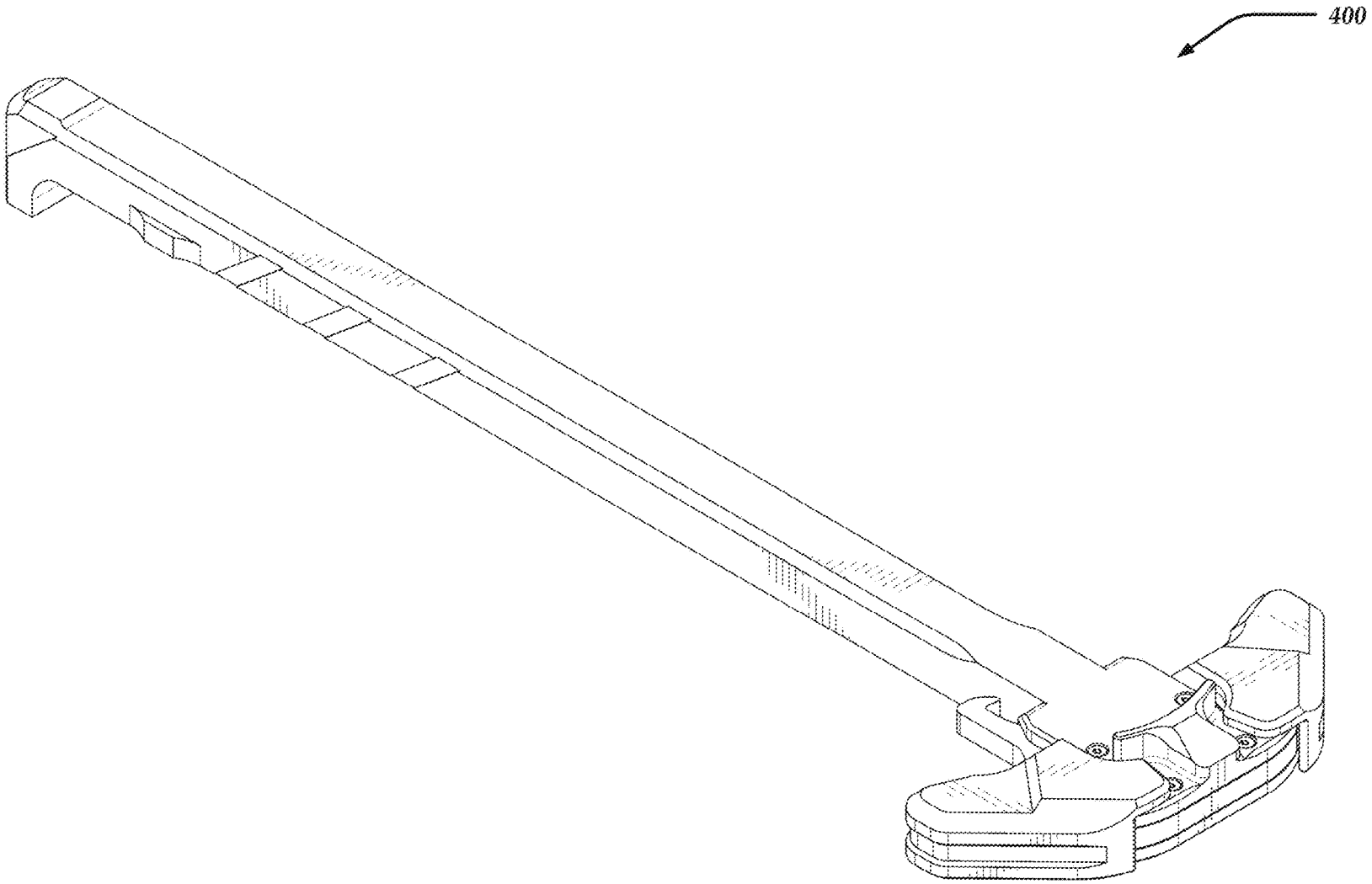
FIG. 42 is a rear-left isometric view of the charging handle of FIG. 41.
Figure 43:
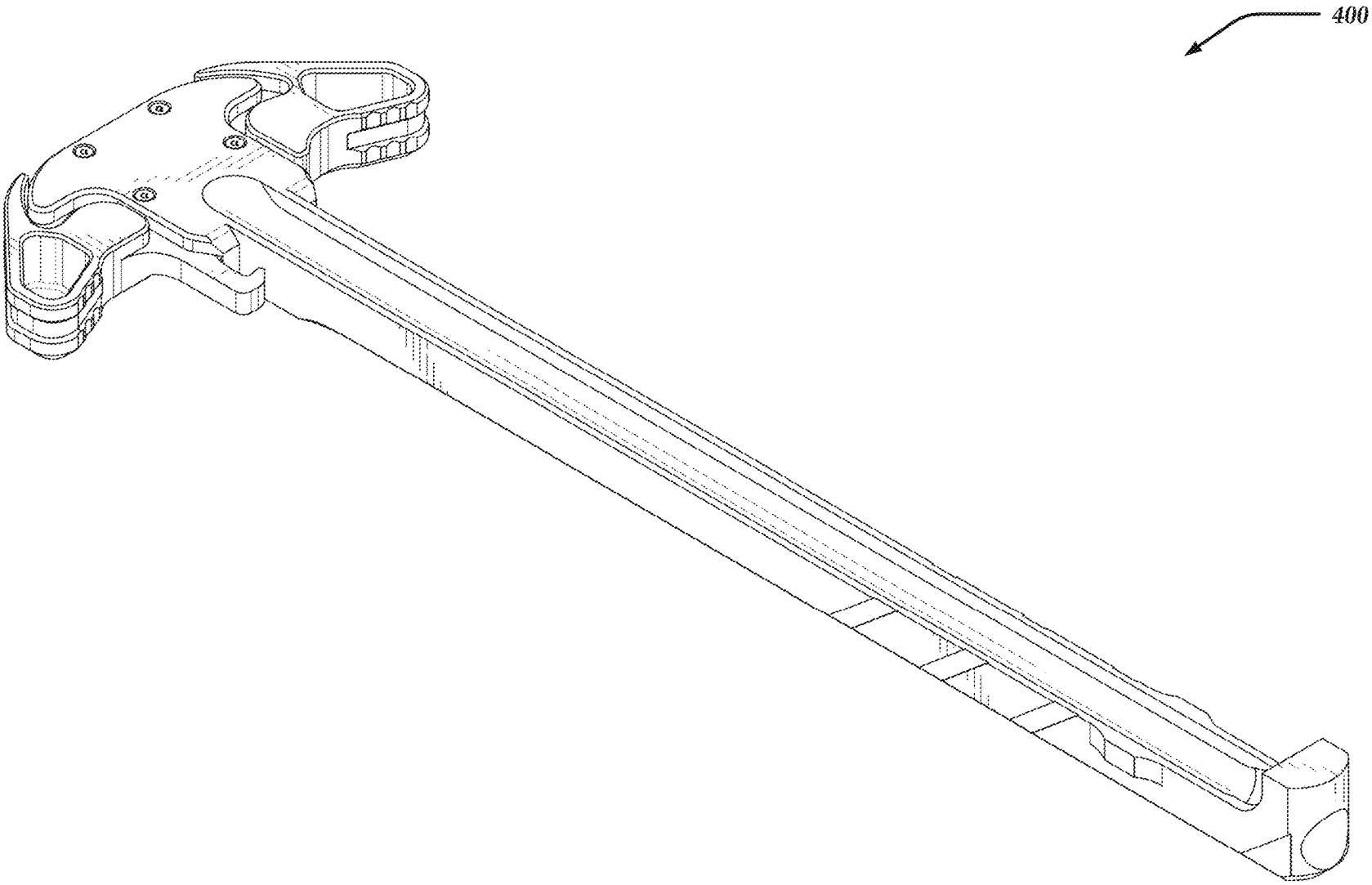
FIG. 43 is a front-left isometric view of the charging handle of FIG. 41.
Figure 44:
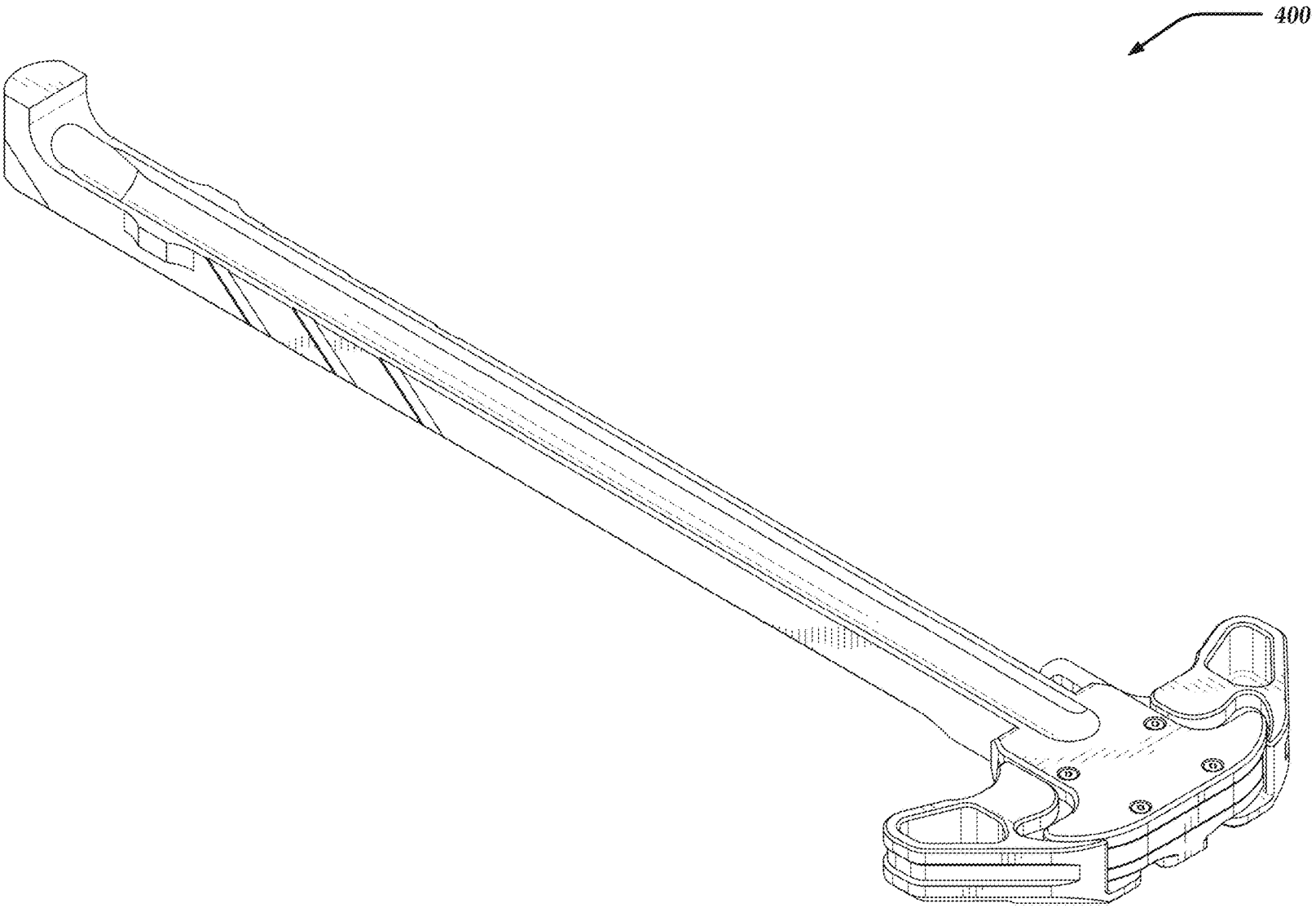
FIG. 44 is a rear-right isometric view of the charging handle of FIG. 41.
Figure 45:
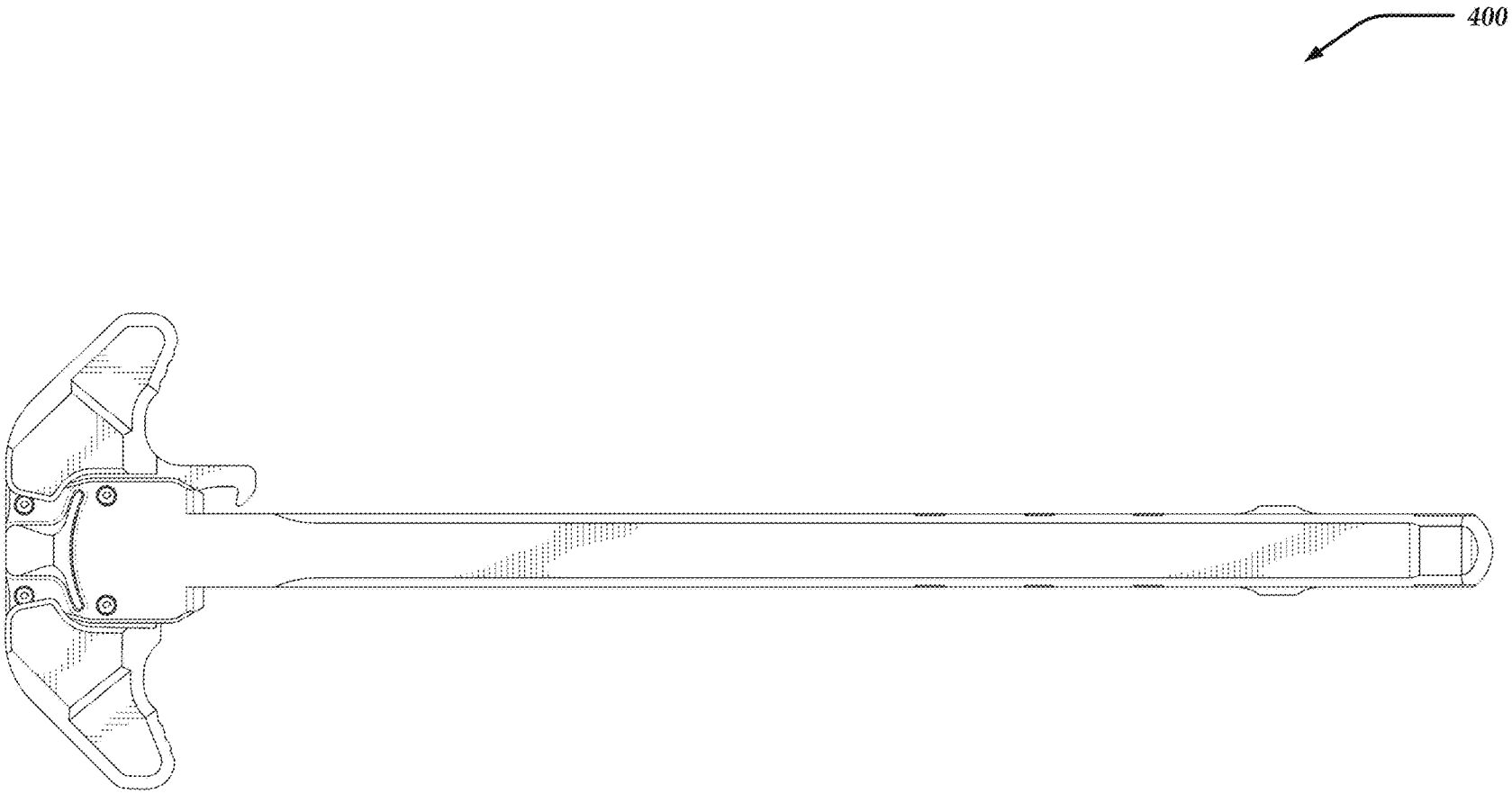
FIG. 45 is a top plan view of the charging handle of FIG. 41.
Figure 46:
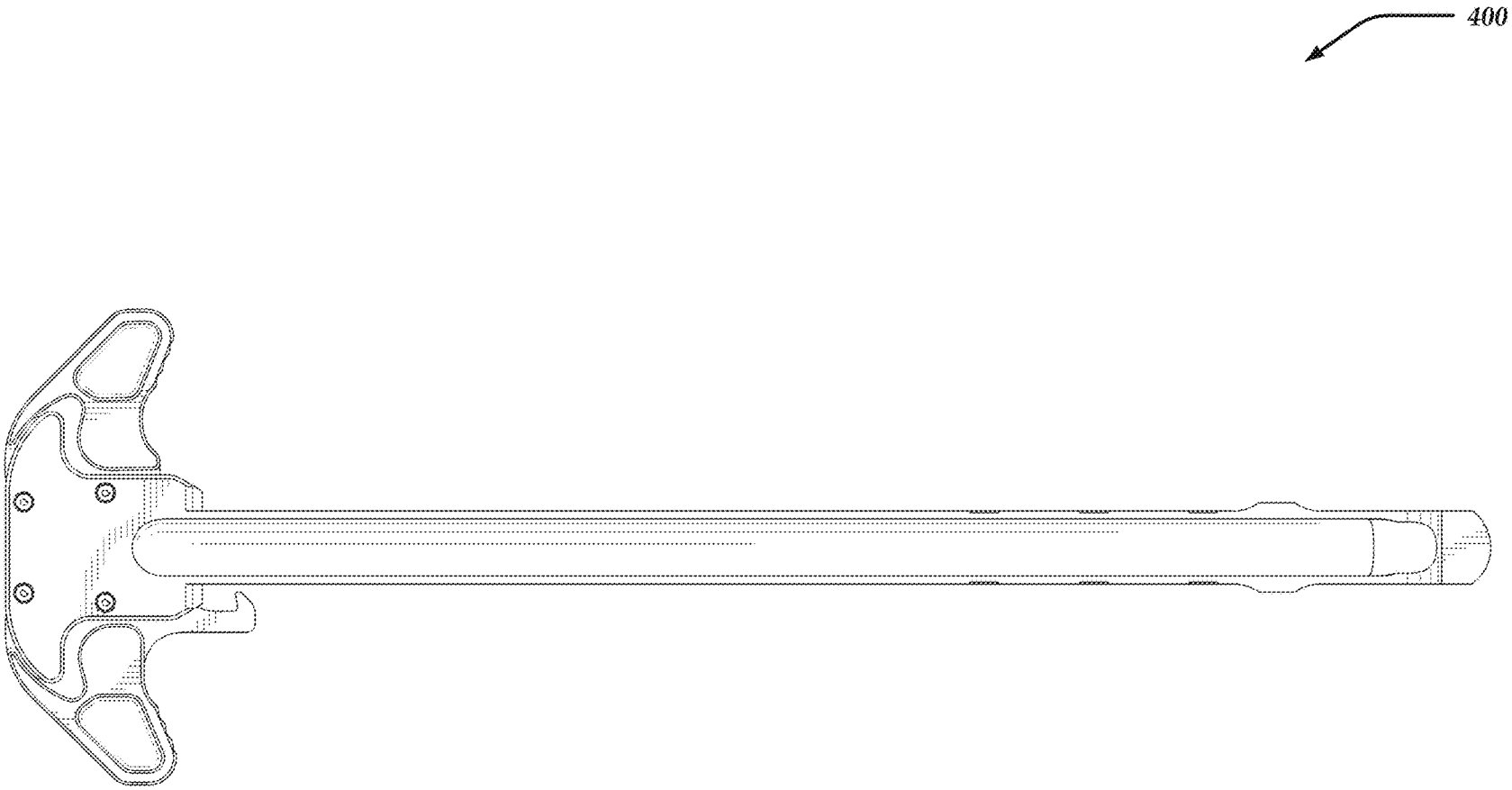
FIG. 46 is a bottom plan view of the charging handle of FIG. 41.
Figure 47:
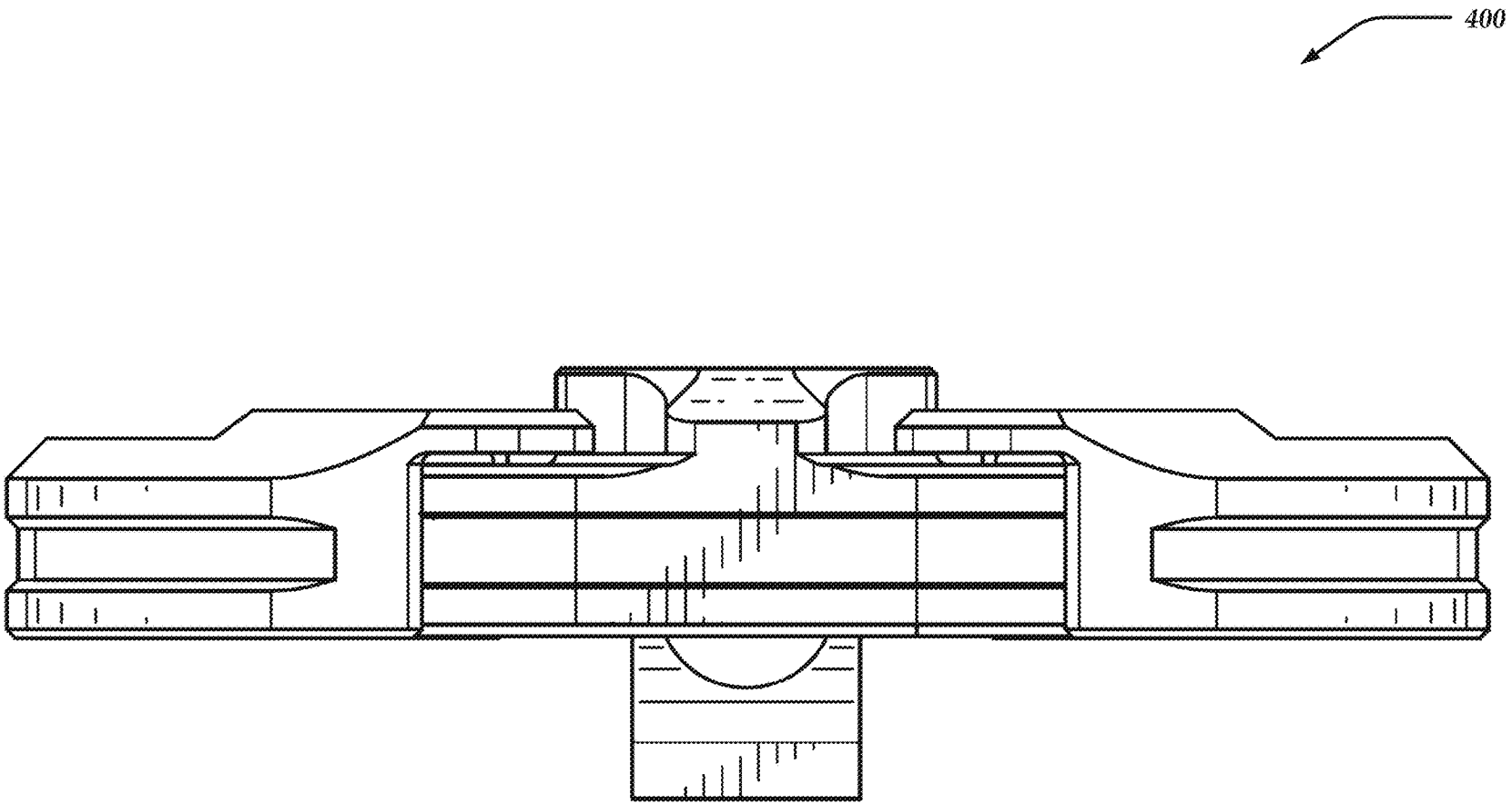
FIG. 47 is a rear elevational view of the charging handle of FIG. 41.
Figure 48:
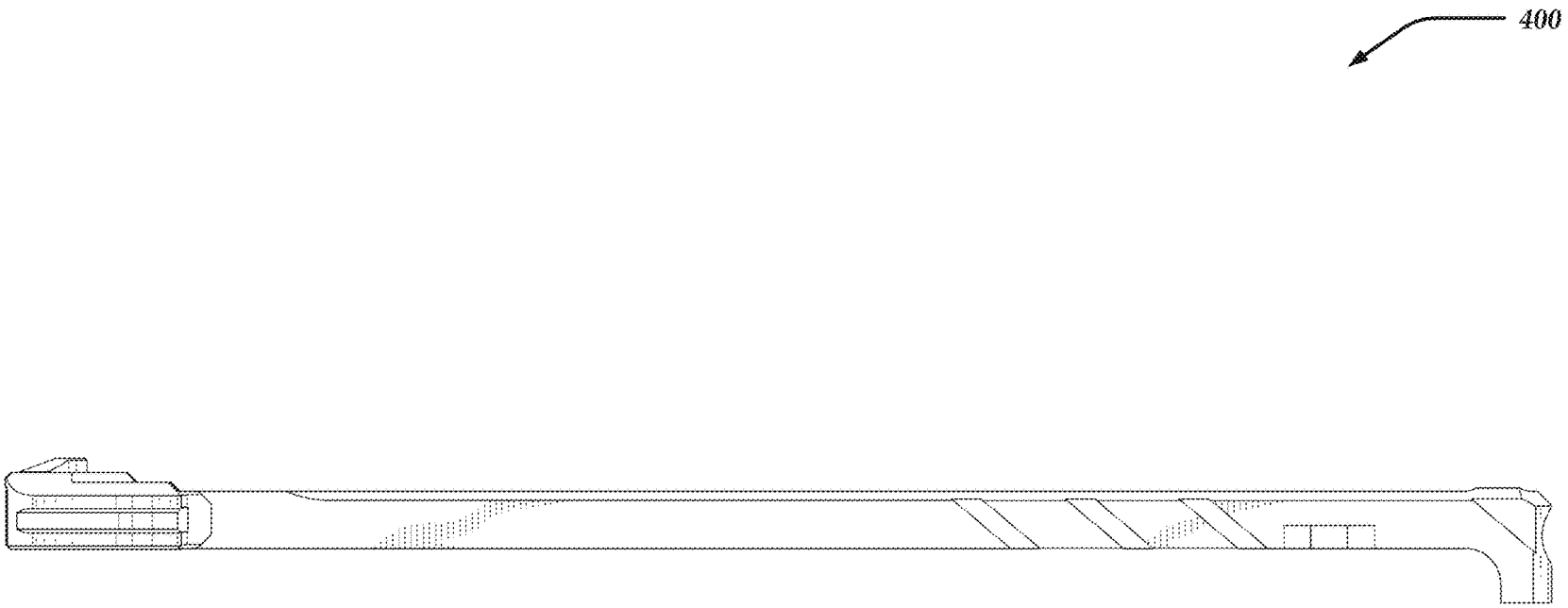
FIG. 48 is a right elevational view of the charging handle of FIG. 41.
Figure 49:
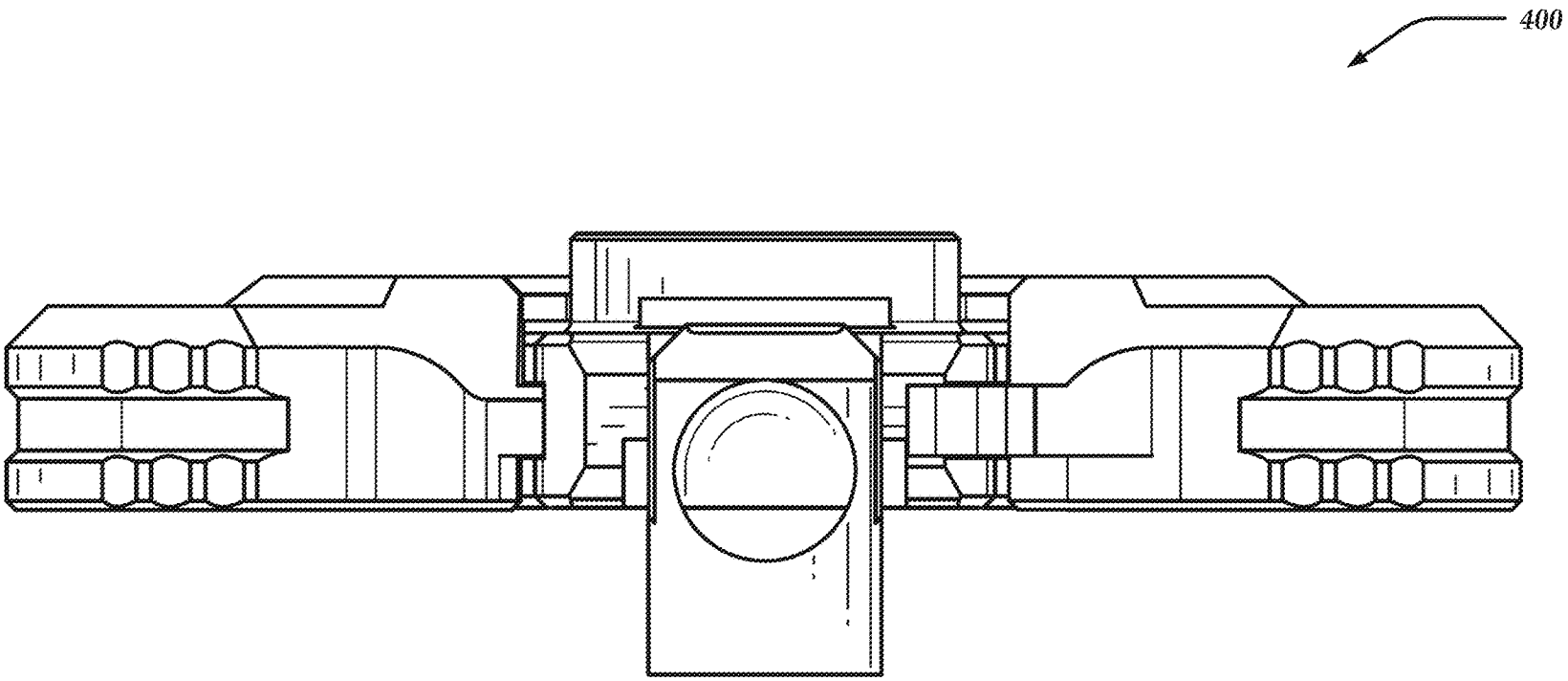
FIG. 49 is a front elevational view of the charging handle of FIG. 41.
Figure 50:
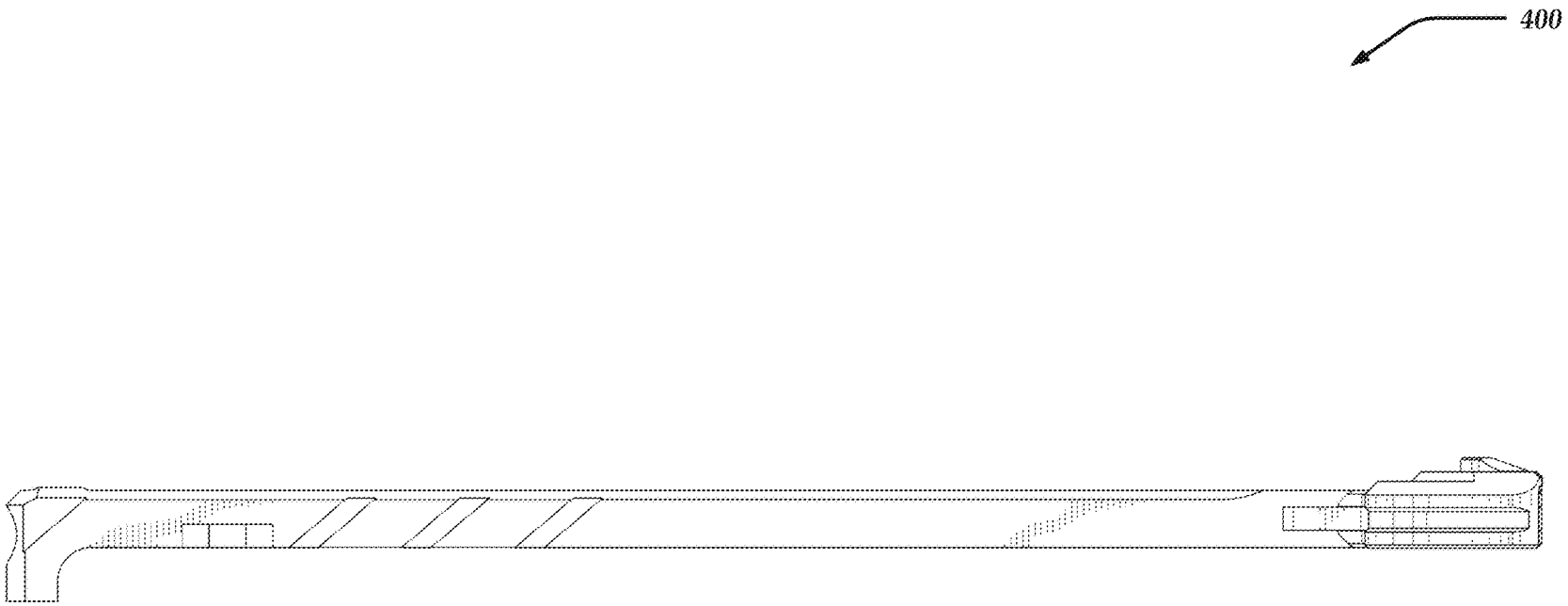
FIG. 50 is a left elevational view of the charging handle of FIG. 41.
Figure 51:
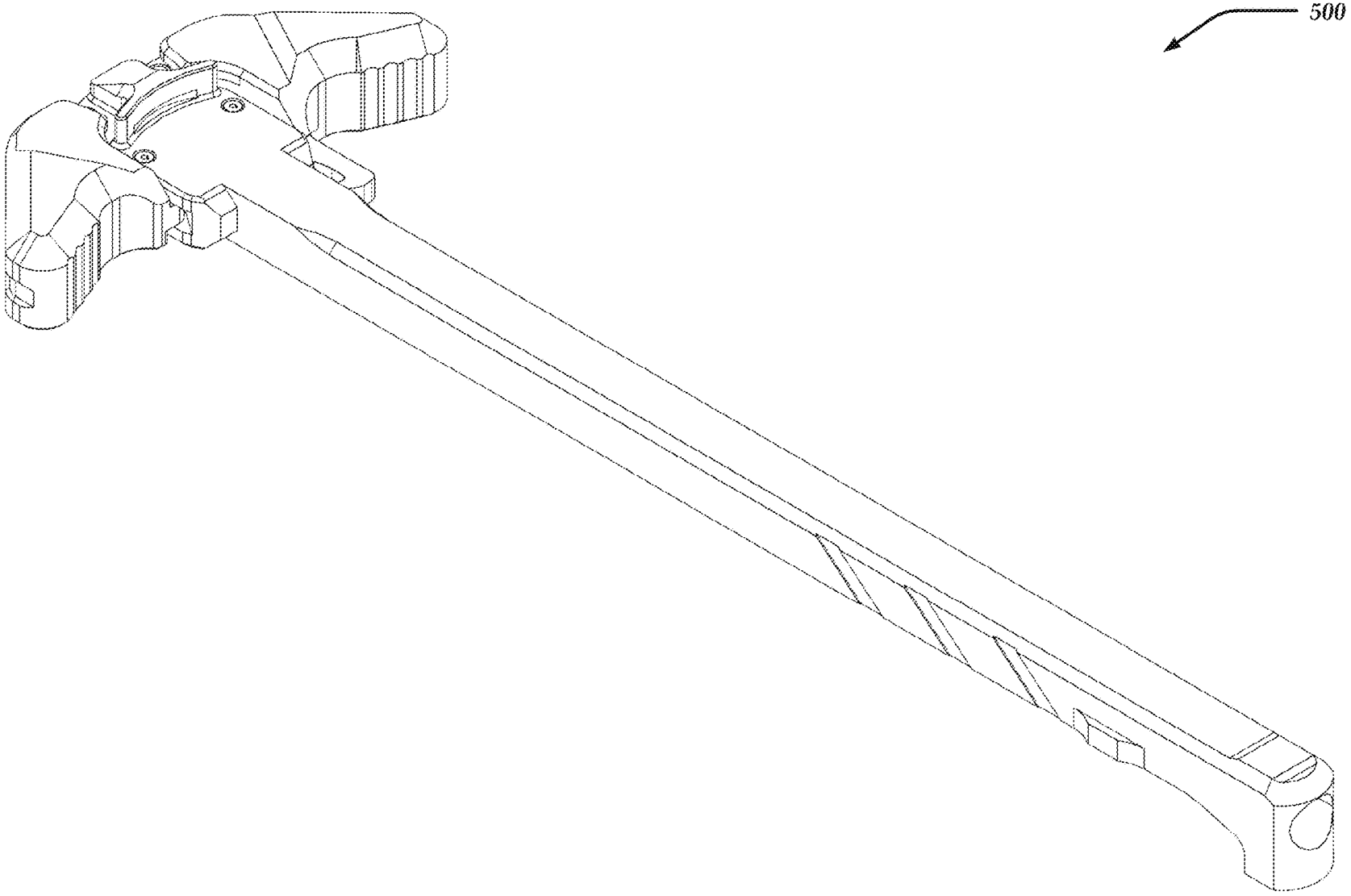
FIG. 51 is a front-right isometric view of a fifth embodiment of the charging handle.
Figure 52:
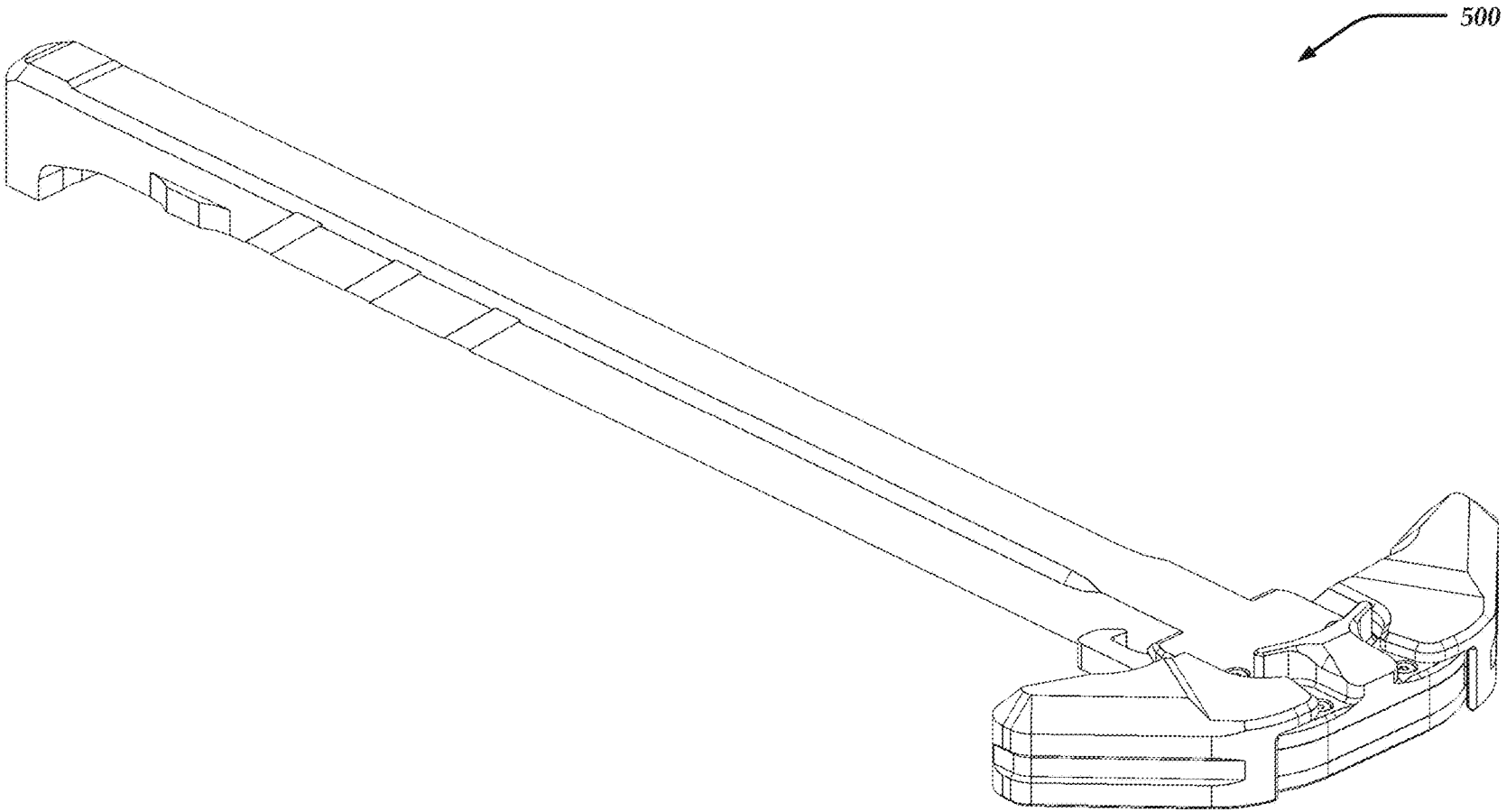
FIG. 52 is a rear-left isometric view of the charging handle of FIG. 51.
Figure 53:
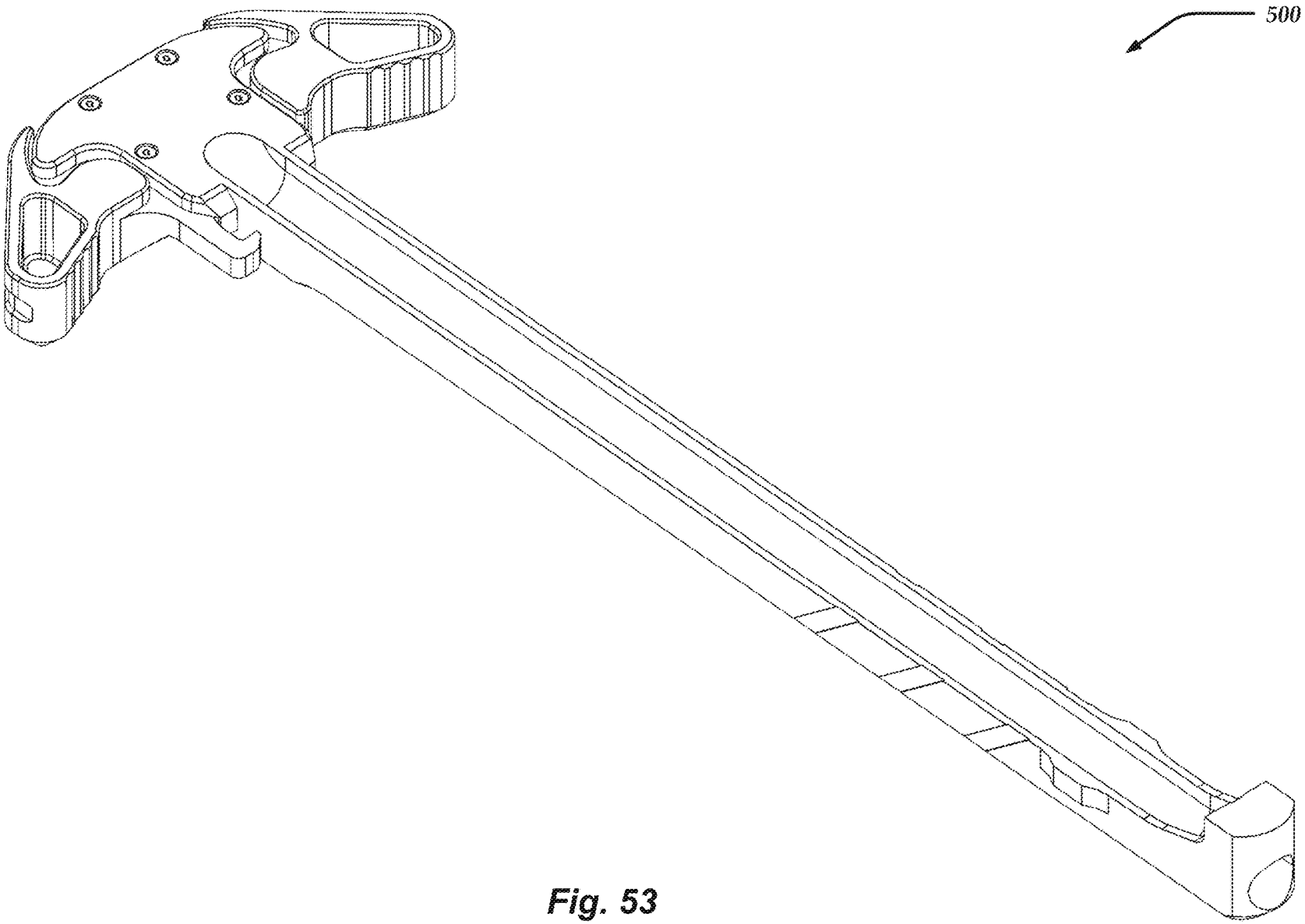
FIG. 53 is a front-left isometric view of the charging handle of FIG. 51.
Figure 54:
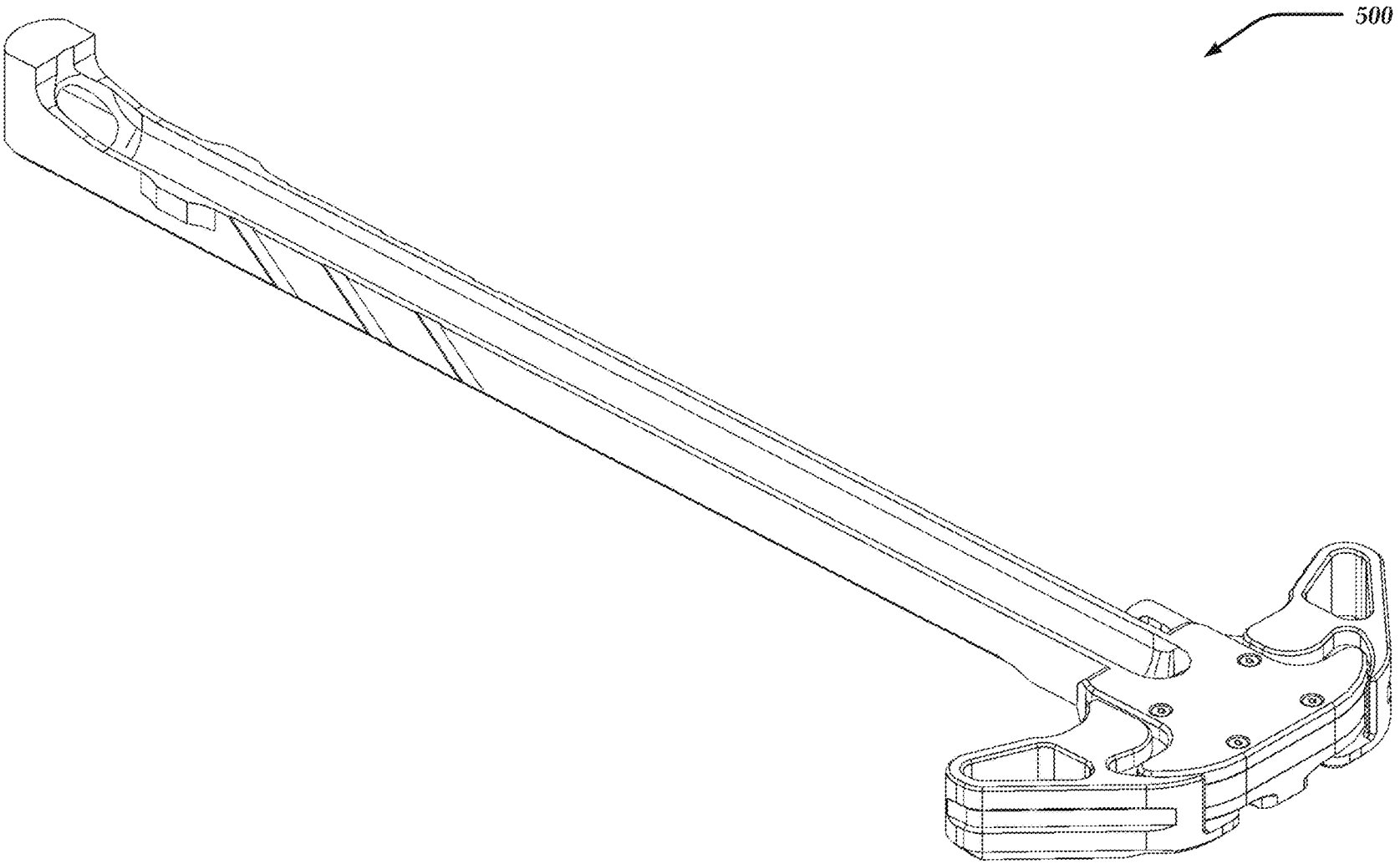
FIG. 54 is a rear-right underside perspective view of the charging handle of FIG. 51.
Figure 55:
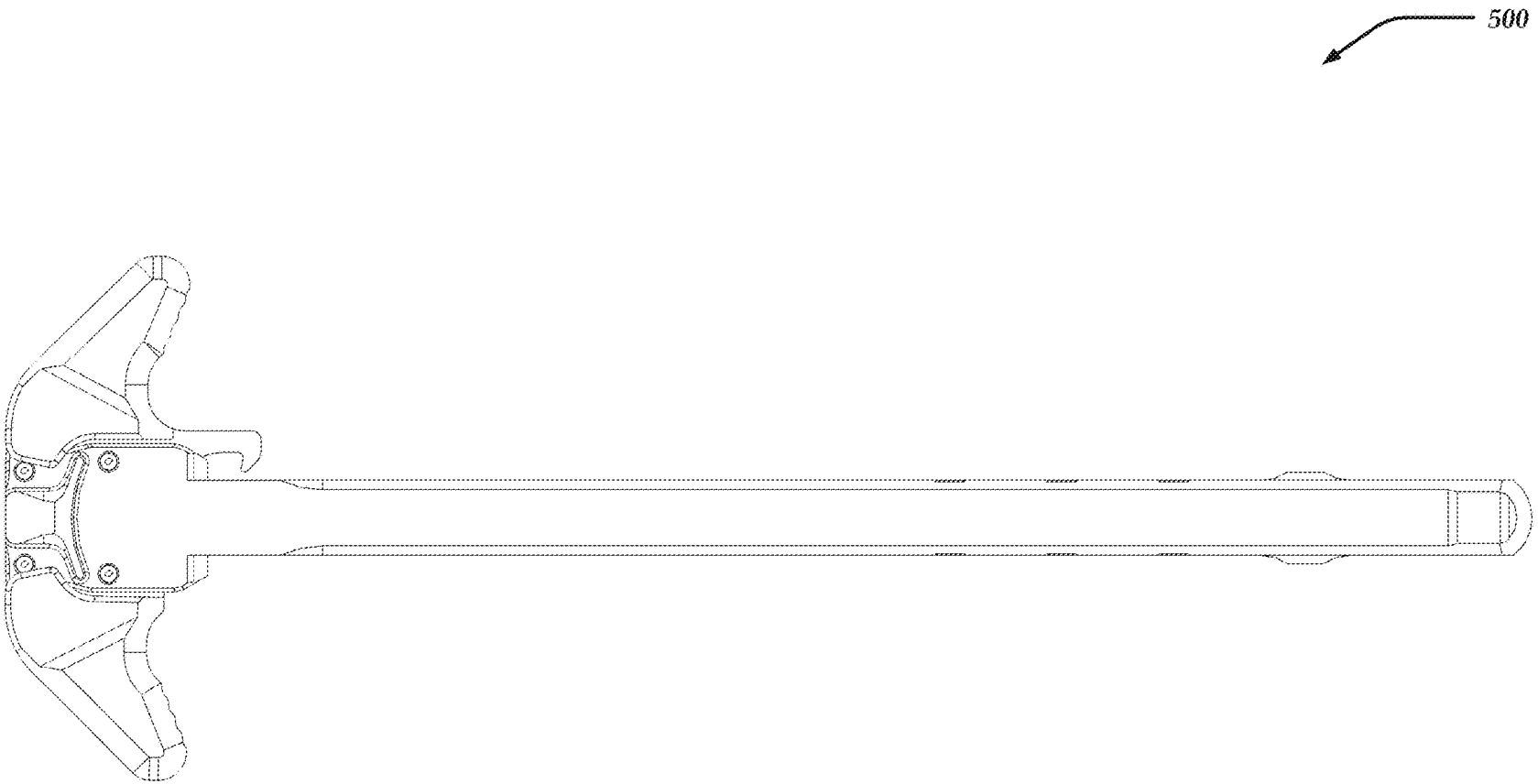
FIG. 55 is a top plan view of the charging handle of FIG. 51.
Figure 56:
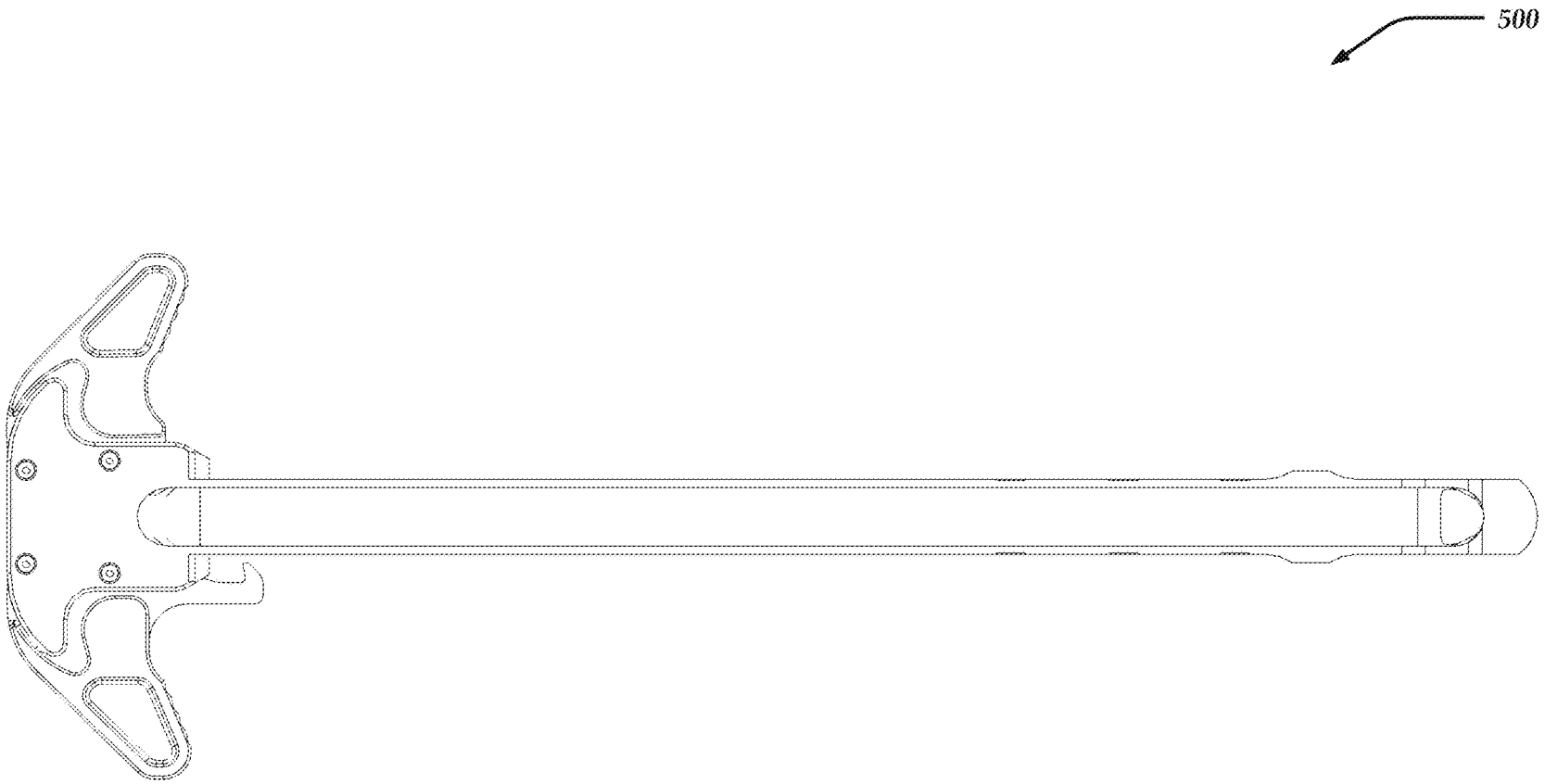
FIG. 56 is a bottom plan view of the charging handle of FIG. 51.
Figure 57:
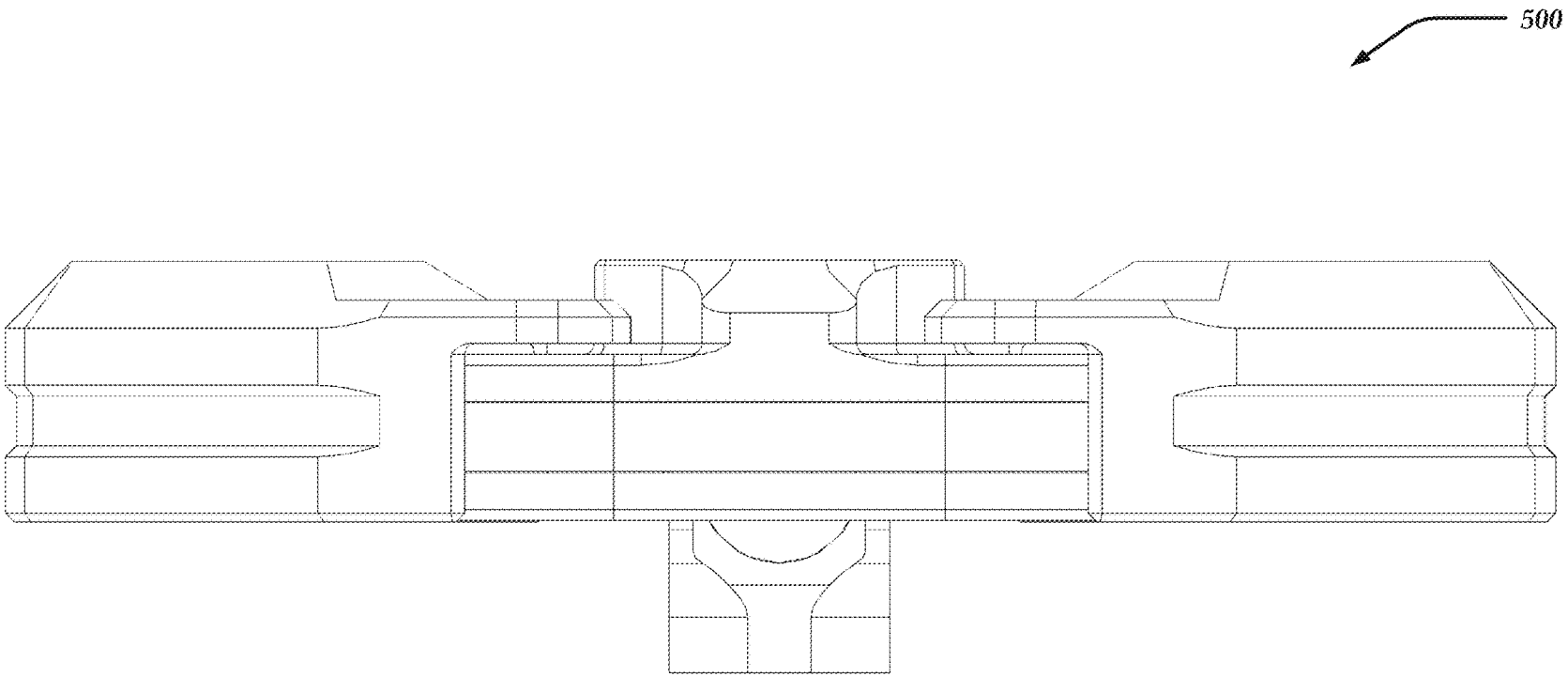
FIG. 57 is a rear elevational view of the charging handle of FIG. 51.
Figure 58:
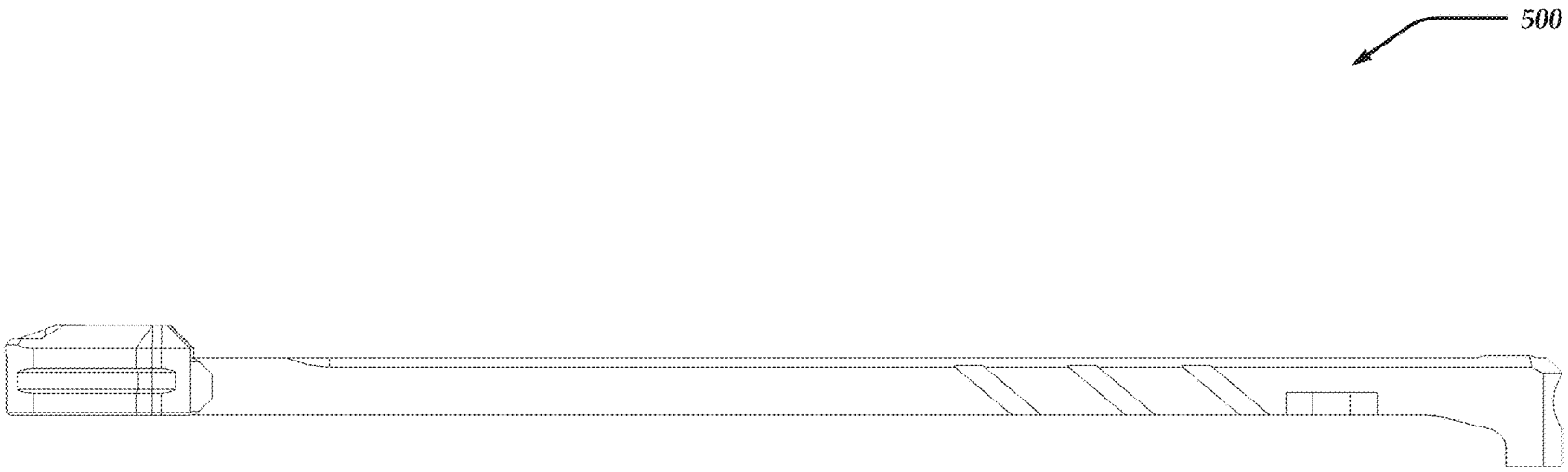
FIG. 58 is a right elevational view of the charging handle of FIG. 51.
Figure 59:
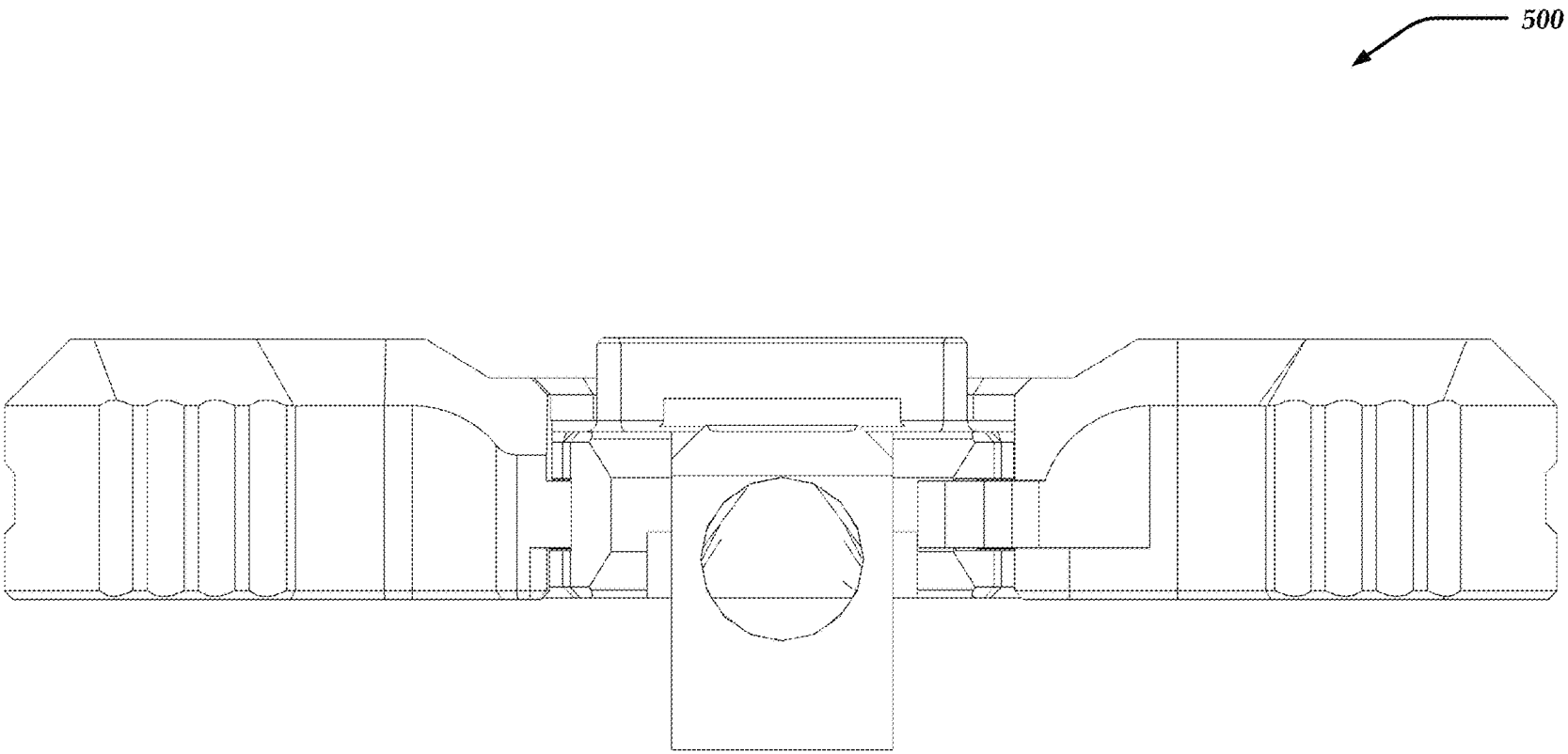
FIG. 59 is a front elevational view of the charging handle of FIG. 51.
Figure 60:
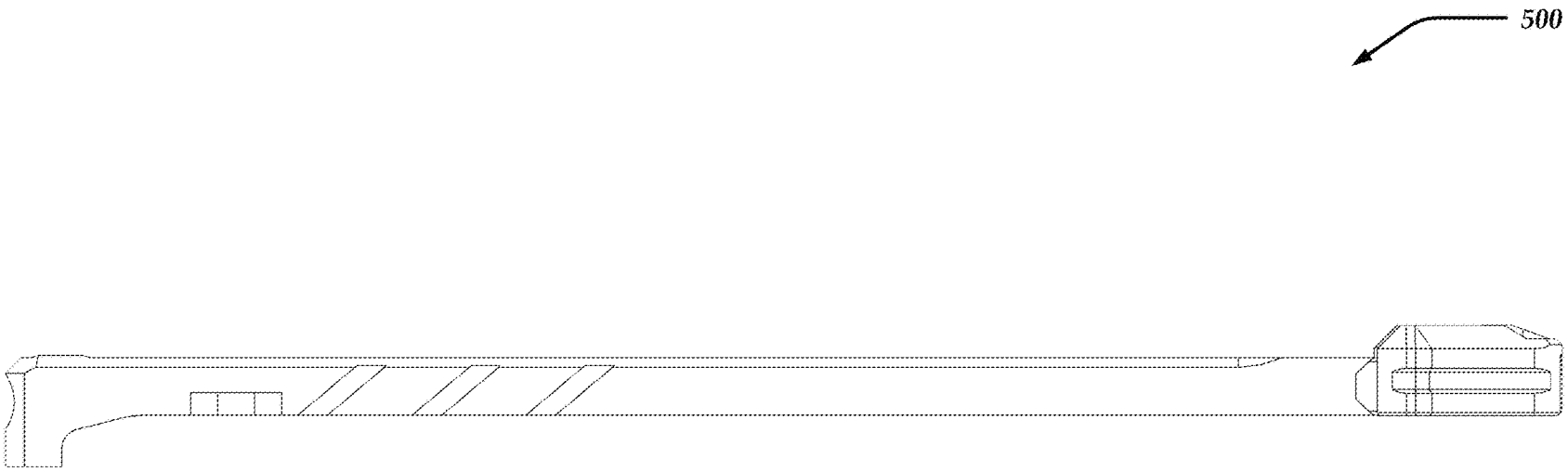
FIG. 60 is a left elevational view of the charging handle of FIG. 51.

FIGS. 21-30 show a second charging handle embodiment 200. The charging handle 200 is preferably substantially the same as the charging handle 8, except the charging handle 200 has left and right levers 202, 204 that have different shapes than the left and right levers 10, 12 of the charging handle 8. The front faces of the left and right levers 202, 204 are configured to be gripped by the user's fingers and preferably define grip elements 206, 208 that extend substantially horizontally (major axis substantially in the horizontal dimension) and facilitate reducing vertical slippage of the user's fingers as the user actuates the charging handle 200. As shown in FIG. 21, the grip elements 206, 208 include recessed slots defined by the front faces of the left and right levers 202, 204. The left and right levers 202, 204 preferably have grip elements 210, 212, 214, 216 (for example, wave-shaped protrusions) that extend substantially vertically and are preferably disposed above and below the grip elements 206, 208 to facilitate reducing horizontal slippage of the user's fingers as the user actuates the charging handle 200.

One or more features of the left lever 202 or the right lever 204 of the charging handle 200 may be implemented in the left lever 10 or the right lever 12 of the charging handle 8 or in the left lever 302 or the right lever 304 of a third charging handle embodiment 300. The charging handles 8, 200 are configured for use in 5.56 mm caliber firearms. The charging handle 300 is substantially the same as the charging handle 8 except that the charging handle 300 is configured for use in 7.62 mm caliber firearms. A fourth charging handle embodiment 400 is substantially the same as the charging handle 200 except that the charging handle 400 is configured for use in 7.62 mm caliber firearms.

As used herein, the following terms take the meanings explicitly associated herein, unless the context clearly dictates otherwise. The term "or" is an inclusive grammatical conjunction to indicate that one or more of the connected terms may be employed. For example, the phrase "one or more A, B, or C" or the phrase "one or more As, Bs, or Cs" is employed to discretely disclose each of the following: i) one or more As, ii) one or more Bs, iii) one or more Cs, iv) one or more As and one or more Bs, v) one or more As and one or more Cs, vi) one or more Bs and one or more Cs, and vii) one or more As, one or more Bs, and one or more Cs. The term "based on" as used herein is not exclusive and allows for being based on additional factors not described. The articles "a," "an," and "the" include plural references.

Plural references are intended to also disclose the singular. The term "one or more" discloses no more than a single one or more than one, up to and including all.

Figure 19:
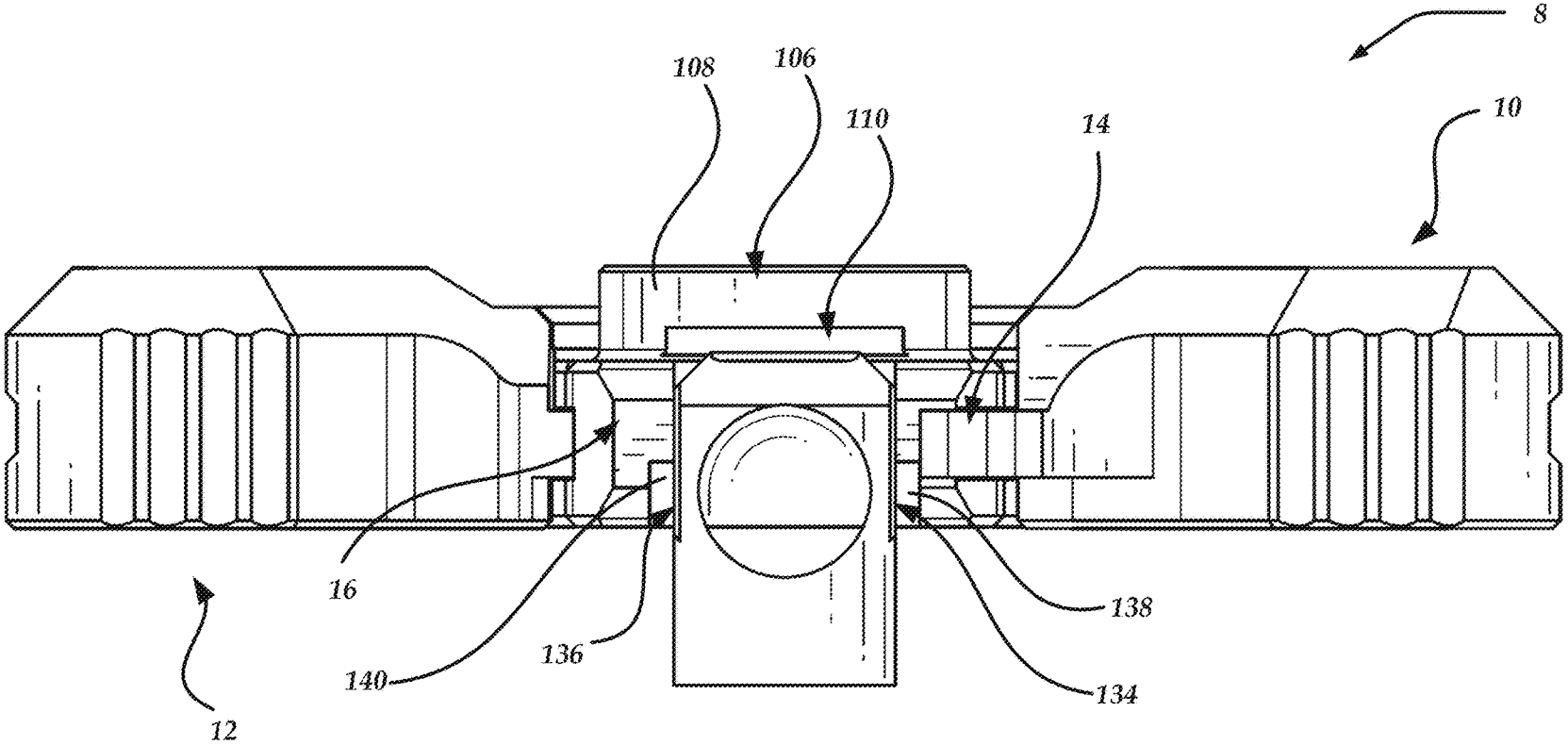
FIG. 19 is a front elevational view of the charging handle of FIG. 2.
Figure 20:
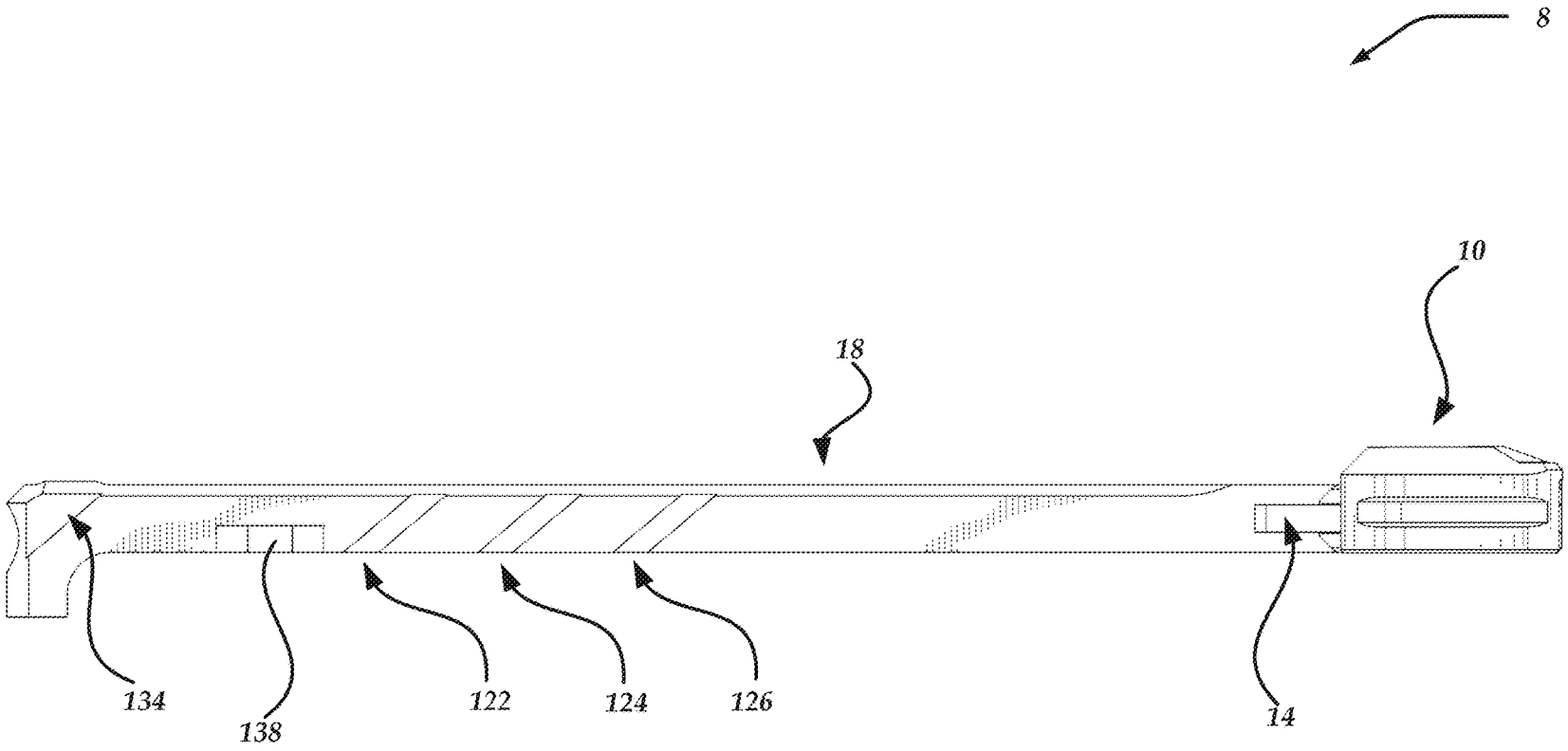
FIG. 20 is a left elevational view of the charging handle of FIG. 2.

The terms "front," "forward," "rear," and "rearward" are defined relative to the shaft 18 of the charging handle to orient the reader and do not limit the orientation of any described component in a given application. The front side of a component faces in the direction that extends from the proximal end portion of the shaft 18 to the distal end portion of the shaft 18. The front side of multiple components of the charging handle 8 are shown in FIG. 19. The rear side of a component faces in the direction that extends from the distal end portion of the shaft 18 to the proximal end portion of the shaft 18. The terms "forward" and "rearward" refer to a position or direction relative to a front or rear side of a described component. The terms "inner", "inward", "outer", and "outward" are defined relative to the longitudinal axis 38 of the charging handle 8, with the terms "inner" and "inward" referencing a direction extending toward the longitudinal axis 38 and with the terms "outer" and "outward" referencing a direction extending away from the longitudinal axis. The term "transverse" refers to a non-parallel orientation and includes but is not limited to a perpendicular orientation.

The term "configured" refers to an element being one or more of sized, dimensioned, positioned, or oriented to achieve or provide the recited function or result. The term "substantially parallel" refers to parallel or within 5, 10, 15, 20, 25, 30, 35, 40, or 45 degrees of parallel. The term "substantially orthogonal" refers to orthogonal or within 5, 10, 15, 20, 25, 30, 35, 40, or 45 degrees of orthogonal. The term "substantially horizontal" or "substantially horizontally" refers to horizontal or within 5, 10, 15, 20, 25, 30, 35, 40, or 45 degrees of horizontal. The term "substantially vertical" or "substantially vertically" refers to vertical or within 5, 10, 15, 20, 25, 30, 35, 40, or 45 degrees of vertical. The term "approximately" means within 5, 10, 15, 25, 30, 35, 40, 45, or 50 percent of the described value. The term "mating surface" refers to a surface that has an area of at least 1.0 $mm^2$, the entirety of which area simultaneously contacts another surface of another component (although different portions of such area may first come into contact with the other surface earlier or later).

The term "directly coupled" refers to a component that contacts (for example, when bolted), is integral with, or is welded to another component. The term "indirectly coupled" refers to a component that is coupled to one or more other components that are coupled to a second component or one or more further components that are coupled to the second component. The term "coupled" should be understood to disclose both direct and indirect coupling of components or elements that are described as being coupled to each other, and different embodiments may be directly coupled or indirectly coupled.

While the preferred embodiment of the invention has been illustrated and described, as noted above, many changes can be made without departing from the spirit and scope of the invention. For example, each disclosure of an element or component preferably having a feature or characteristic is intended to also disclose the element or component as being devoid of that feature or characteristic, unless the principles of the invention clearly dictate otherwise. Accordingly, the scope of the invention is not limited by the disclosure of the preferred embodiments. Instead, the invention should be determined entirely by reference to the claims that follow. Moreover, each feature, characteristic, element, or component described herein may be implemented in combination with one or more other features, characteristics, elements, or components described herein. For example, one or more of the features, characteristics, or elements of any one of the charging handles 8, 200, 300, 400 may be implemented in combination with one or more other features, characteristics, or elements of any other one of the charging handles 8, 200, 300, 400. It should also be noted that the claim dependencies or combinations of elements recited in the claims does not reflect an intention to forgo claiming other subject matter disclosed herein. Instead, this disclosure is intended to also disclose the subject matter of any combination of any two or more of the claims, such that subsequent claim sets may recite that any one of the dependent claims depends from any other one or more claims, up to and including all other claims in the alternative (for example, "The charging handle of any one of the preceding or subsequent claims . . . "). This disclosure is also intended to disclose the subject matter of any one of the dependent claims, as if it was an independent claim, with or without all or a portion of the subject matter of the original independent claim(s) or any other subject matter disclosed herein.

The invention claimed is:

1. A method for modifying a charging handle for an AR-pattern firearm, the method comprising:

providing a charging handle for an AR-pattern firearm, the charging handle including:

a base having an upper body portion and a lower body portion that is spaced apart from and below the upper body portion;

a shaft having a proximal end portion that extends from the base and a distal end portion that is configured to engage a bolt carrier of the firearm, the shaft defining a longitudinal axis that extends through the proximal end portion of the shaft and the distal end portion of the shaft, the shaft defining a forward direction that extends from the proximal end portion of the shaft toward the distal end portion of the shaft and defining outward directions that horizontally extend orthogonal to and away from the longitudinal axis;

a left lever that is pivotably coupled to the base, the left lever having a cam follower disposed between the upper body portion and the lower body portion;

a latch that is coupled to the left lever, the latch being configured to pivot responsive to movement of the left lever and to selectively engage an upper receiver of the firearm in a latched configuration to prevent cocking a bolt of the firearm and disengage the upper receiver in an unlatched configuration to enable cocking the bolt;

a right lever that is pivotably coupled to the base, the right lever having a cam disposed between the upper body portion and the lower body portion, the cam being configured to selectively engage the cam follower of the left lever to actuate the left lever responsive to a user pulling the right lever;

a first spacer configured to removably couple to the base;

a left bias element configured to contact the first spacer when the first spacer is coupled to the base, wherein the first spacer is sized and dimensioned to preload the left bias element a first amount such that the left bias element biases the left lever away from the first spacer with a first bias force; and a right bias element configured to contact the first spacer when the first spacer is coupled to the base, wherein the first spacer is sized and dimensioned to preload the right bias element a second amount such that the right bias element biases the right lever away from the first spacer with a second bias force;

providing a second spacer configured to removably couple to the base, the second spacer being sized and dimensioned to preload the left bias element a third amount such that the left bias element biases the left lever away from the second spacer with a third bias force, the second spacer is sized and dimensioned to preload the right bias element a fourth amount such that the right bias element biases the right lever away from the second spacer with a fourth bias force;

removing the first spacer from the charging handle; and coupling the second spacer to the base, wherein at least one of (i) the third amount of preload is different than the first amount of preload or (ii) the fourth amount of preload is different than the second amount of preload, whereby replacing the first spacer with the second spacer facilitates modifying the first bias force or the second bias force.

2. The method of claim 1, wherein the first spacer defines a first left receptacle configured to receive the left bias element and defines a first right receptacle configured to receive the right bias element, the second spacer defines a second left receptacle configured to receive the left bias element and defines a second right receptacle configured to receive the right bias element, and at least one of (i) the second left receptacle is sized or dimensioned differently than the first left receptacle or (ii) the second right receptacle is sized or dimensioned differently than the second right receptacle, whereby the second spacer facilitates a different preload amount than the first spacer in at least one of the left bias element or the right bias element.

3. The method of claim 1, wherein the upper body portion and the lower body portion define a cavity in which the first spacer is configured to enclose the cam follower and the cam forward of the spacer.

4. The method of claim 1, wherein the left and right bias elements include compression springs disposed forward of the first spacer when the first spacer is coupled to the base, the left and right bias elements being disposed on opposite sides of the longitudinal axis from each other, the left and right levers being in a forward configuration when the first spacer is coupled to the base until the user applies a pulling force to at least one of the left or right levers that exceeds at least one of the first bias force or the second bias force, wherein the left and right bias elements are non-parallel to the longitudinal axis and are disposed at acute angles to the longitudinal axis as measured forward and inward of the left and right bias elements when the first spacer is coupled to the base and the left and right levers are in the forward configuration.

5. The method of claim 4, wherein at least one of the acute angles is between 20° and 45°.

6. The method of claim 4, wherein at least one of the acute angles is between 25° and 40°.

7. The method of claim 4, wherein at least one of the acute angles is between 30° and 35°.

8. The method of claim 1, wherein the right bias element has a different spring constant than the right bias element.

9. The method of claim 1, wherein the lower body portion defines a first mating surface and a second mating surface, the upper body portion defining a third mating surface and a fourth mating surface, the first and third mating surfaces being configured to contact the left lever when the user pulls the left lever, the second and fourth mating surfaces being configured to contact the right lever when the user pulls the right lever, wherein the first mating surface, the second mating surface, the third mating surface, and the fourth mating surface are arranged in planes that are substantially vertical, wherein at least one of the first mating surface, the second mating surface, the third mating surface, or the fourth mating surface faces generally rearward and is disposed at an acute angle to the longitudinal axis as measured forward and inward of the at least one of the first mating surface, the second mating surface, the third mating surface, or the fourth mating surface.

10. The method of claim 9, wherein one or more of the first mating surface, the second mating surface, the third mating surface, or the fourth mating surface faces generally forward.

11. A charging handle for a firearm, the charging handle comprising:

a base having an upper body portion and a lower body portion that is spaced apart from and below the upper body portion;

a shaft having a proximal end portion that extends from the base and a distal end portion that is configured to engage a bolt carrier of the firearm, the shaft defining a longitudinal axis that extends through the proximal end portion of the shaft and the distal end portion of the shaft, the shaft defining a forward direction that extends from the proximal end portion of the shaft toward the distal end portion of the shaft and defining outward directions that horizontally extend orthogonal to and away from the longitudinal axis;

a left lever that is pivotably coupled to the base, the left lever having a cam follower disposed between the upper body portion and the lower body portion;

a latch that is coupled to the left lever, the latch being configured to pivot responsive to movement of the left lever and to selectively engage an upper receiver of the firearm in a latched configuration to prevent cocking a bolt of the firearm and disengage the upper receiver in an unlatched configuration to enable cocking the bolt; and a right lever that is pivotably coupled to the base, the right lever having a cam disposed between the upper body portion and the lower body portion, the cam being configured to selectively engage the cam follower of the left lever to actuate the left lever responsive to a user pulling the right lever, wherein the lower body portion defines a first mating surface and a second mating surface, the upper body portion defining a third mating surface and a fourth mating surface, the first and third mating surfaces being configured to contact the left lever when the user pulls the left lever, the second and fourth mating surfaces being configured to contact the right lever when the user pulls the right lever, wherein the first mating surface, the second mating surface, the third mating surface, and the fourth mating surface are arranged in planes that are substantially vertical, wherein at least one of the first mating surface, the second mating surface, the third mating surface, or the fourth mating surface faces generally rearward and another of the first mating surface, the second mating surface, the third mating surface, or the fourth mating surface faces generally forward.

12. A method for modifying a charging handle, the method comprising:

providing the charging handle of claim 11;

providing a first spacer configured to removably couple to the base;

providing a left bias element configured to contact the first spacer when the first spacer is coupled to the base, wherein the first spacer is sized and dimensioned to preload the left bias element a first amount such that the left bias element biases the left lever away from the first spacer with a first bias force;

providing a right bias element configured to contact the first spacer when the first spacer is coupled to the base, wherein the first spacer is sized and dimensioned to preload the right bias element a second amount such that the right bias element biases the right lever away from the first spacer with a second bias force;

providing a second spacer configured to removably couple to the base, the second spacer being sized and dimensioned to preload the left bias element a third amount such that the left bias element biases the left lever away from the second spacer with a third bias force, the second spacer is sized and dimensioned to preload the right bias element a fourth amount such that the right bias element biases the right lever away from the second spacer with a fourth bias force;

removing the first spacer from the charging handle; and coupling the second spacer to the base, wherein at least one of (i) the third amount of preload is different than the first amount of preload or (ii) the fourth amount of preload is different than the second amount of preload, whereby selecting the first spacer or the second spacer facilitates selecting the first bias force or the second bias force.

13. The method of claim 12, wherein the first spacer defines a first left receptacle configured to receive the left bias element and defines a first right receptacle configured to receive the right bias element, the second spacer defines a second left receptacle configured to receive the left bias element and defines a second right receptacle configured to receive the right bias element, and at least one of (i) the second left receptacle is sized or dimensioned differently than the first left receptacle or (ii) the second right receptacle is sized or dimensioned differently than the second right receptacle, whereby the second spacer facilitates a different preload amount than the first spacer in at least one of the left bias element or the right bias element.

14. The method of claim 12, wherein the upper body portion and the lower body portion define a cavity in which the first spacer is configured to enclose the cam follower and the cam forward of the spacer.

15. The method of claim 12, wherein the left and right bias elements include compression springs disposed forward of the first spacer when the first spacer is coupled to the base, the left and right bias elements being disposed on opposite sides of the longitudinal axis from each other, the left and right levers being in a forward configuration when the first spacer is coupled to the base until the user applies a pulling force to at least one of the left or right levers that exceeds at least one of the first bias force or the second bias force, wherein the left and right bias elements are non-parallel to the longitudinal axis and are disposed at acute angles to the longitudinal axis as measured forward and inward of the left and right bias elements when the first spacer is coupled to the base and the left and right levers are in the forward configuration.

16. The method of claim 15, wherein at least one of the acute angles is between 20° and 45°.

17. The method of claim 15, wherein at least one of the acute angles is between 25° and 40°.

18. The method of claim 15, wherein at least one of the acute angles is between 30° and 35°.

19. The method of claim 12, wherein the right bias element has a different spring constant than the right bias element.

20. The charging handle of claim 11, wherein the at least one of the first mating surface, the second mating surface, the third mating surface, or the fourth mating surface is disposed at an acute angle to the longitudinal axis as measured forward and inward of the at least one of the first mating surface, the second mating surface, the third mating surface, or the fourth mating surface, the acute angle being between 5° and 25° or between 10° and 20°.

21. The charging handle of claim 11, wherein the first mating surface is non-parallel to the third mating surface, and the second mating surface is non-parallel to the fourth mating surface.

22. The charging handle of claim 11, further comprising a left compression spring and a right compression spring, the left and right compression springs being disposed on opposite sides of the longitudinal axis from each other, the left compression spring being configured to apply a first bias force to the left lever, the right compression spring being configured to apply a second bias force to the right lever, the left and right compression springs being configured to maintain the left and right levers in a forward configuration until a user applies a pulling force to at least one of the left or right levers that exceeds at least one of the first bias force or the second bias force, wherein the left and right compression springs are non-parallel to the longitudinal axis and are disposed at acute angles to the longitudinal axis as measured forward and inward of the left and right compression springs when the left and right levers are in the forward configuration.

* * * * *